US007578012B2

(12) United States Patent
Palay et al.

(10) Patent No.: US 7,578,012 B2
(45) Date of Patent: Aug. 25, 2009

(54) PATIENT TRANSFER SYSTEM WITH ASSOCIATED FRAMES AND LIFT CARTS

(75) Inventors: Frederic Palay, Sugarloaf Key, FL (US); William E. Burak, Jr., Green Cove Springs, FL (US)

(73) Assignee: Ergo-Asyst Technology LLC, Austin, TX (US)

( * ) Notice: Subject to any disclaimer, the term of this patent is extended or adjusted under 35 U.S.C. 154(b) by 381 days.

(21) Appl. No.: 11/375,536

(22) Filed: Mar. 14, 2006

(65) Prior Publication Data

US 2006/0213007 A1 Sep. 28, 2006

Related U.S. Application Data

(60) Provisional application No. 60/661,372, filed on Mar. 14, 2005, provisional application No. 60/704,372, filed on Aug. 1, 2005.

(51) Int. Cl.
*A61G 7/10* (2006.01)

(52) U.S. Cl. ..... 5/81.1 R; 5/83.1; 5/86.1; 5/89.1

(58) Field of Classification Search ..... 5/81.1 R, 5/83.1, 86.1, 87.1, 89.1
See application file for complete search history.

(56) References Cited

U.S. PATENT DOCUMENTS 662,477 A * 11/1900 Ulrich ..... 5/85.1
935,170 A * 9/1909 Smith ..... 5/86.1
1,876,832 A * 9/1932 Bancroft ..... 5/89.1
1,961,119 A * 5/1934 Ettinger ..... 5/89.1
2,362,721 A 11/1944 Reynolds
2,666,930 A * 1/1954 Lenahan ..... 5/86.1
2,673,987 A * 4/1954 Upshaw et al. ..... 5/86.1
2,739,783 A * 3/1956 Pentecost ..... 254/124
3,131,404 A * 5/1964 Bowers et al. ..... 5/86.1
3,271,796 A 9/1966 Dillman
3,310,816 A * 3/1967 James et al. ..... 5/83.1
3,732,584 A * 5/1973 James ..... 5/87.1
3,811,140 A 5/1974 Burpo
3,829,916 A * 8/1974 James ..... 5/83.1
3,940,808 A * 3/1976 Petrini ..... 5/83.1
3,981,484 A * 9/1976 James ..... 264/148
4,010,499 A * 3/1977 Davis et al. ..... 5/87.1

(Continued)

FOREIGN PATENT DOCUMENTS

EP 452072 A2 * 10/1991

(Continued)

*Primary Examiner*—Robert G Santos
(74) *Attorney, Agent, or Firm*—DuBois, Bryant & Campbell, LLP; J. Seth Randle

(57) ABSTRACT

The invention is directed to a patient transfer system with associated patient support frames, lift carts, lifts, carts, and other accessories for use therewith. The support frames of the present invention as depicted in the exemplary embodiments are designed to: (a) provide rigidity (exoskeleton) to the human body for positioning to provide stability for purposes of transferring, lifting and/or transporting the subject via a mobile device, such as a powered lift device; (b) a male/female coupling for coupling to a tine or other carriage mechanism of a lifting device thereto for the purpose of moving or lifting the subject; and/or (c) be used as a support or frame that will interact with the body as an exoskeleton to aid with the activities of daily living.

35 Claims, 39 Drawing Sheets

U.S. PATENT DOCUMENTS 4,138,750 A * 2/1979 Michalowski ..... 5/89.1
4,232,412 A * 11/1980 Petrini ..... 5/83.1
4,393,529 A 7/1983 Britz
4,432,359 A * 2/1984 James ..... 5/87.1
4,579,381 A 4/1986 Williams
4,633,538 A * 1/1987 James ..... 5/83.1
4,669,943 A * 6/1987 Zamotin ..... 414/343
4,783,862 A 11/1988 Murphy
4,862,997 A * 9/1989 Eberle ..... 182/148
4,920,590 A * 5/1990 Weiner ..... 5/86.1
4,970,738 A 11/1990 Cole
4,997,200 A 3/1991 Earls
5,038,425 A 8/1991 Merry
5,112,076 A 5/1992 Wilson
5,255,934 A * 10/1993 Wilson ..... 280/657
5,263,213 A 11/1993 Robertson et al.
5,333,887 A 8/1994 Luther
5,375,277 A 12/1994 Carr et al.
5,379,468 A * 1/1995 Cassidy et al. ..... 5/86.1
5,388,289 A * 2/1995 Casperson ..... 5/86.1
5,572,756 A 11/1996 Muuranen et al.
5,626,398 A 5/1997 Wooldridge
5,704,081 A 1/1998 Bollinger
5,754,992 A * 5/1998 Melnick et al. ..... 5/89.1
5,934,282 A 8/1999 Young, III et al.
5,966,754 A 10/1999 Schuster
5,996,150 A * 12/1999 Blevins et al. ..... 5/613
6,154,899 A 12/2000 Brooke et al.
6,336,235 B1 1/2002 Ruehl
6,381,781 B1 5/2002 Bourgraf et al.
6,427,270 B1 * 8/2002 Blevins et al. ..... 5/613
6,430,761 B1 8/2002 Brandorff et al.
6,477,728 B1 11/2002 Faz
6,691,349 B2 2/2004 Blevins
6,854,137 B2 * 2/2005 Johnson ..... 5/88.1
7,000,268 B2 * 2/2006 Johnson ..... 5/81.1 R
2003/0213064 A1 * 11/2003 Johnson ..... 5/86.1
2004/0049855 A1 3/2004 Leoutsakos
2004/0154097 A1 * 8/2004 Blevins ..... 5/81.1 R
2005/0135907 A1 6/2005 Romano et al.
2006/0213007 A1 * 9/2006 Palay et al. ..... 5/81.1 R
2007/0028381 A1 * 2/2007 Palay et al. ..... 5/81.1 R

FOREIGN PATENT DOCUMENTS

EP 518692 A1 * 12/1992
EP 1 142 550 10/2001
GB 2 213 735 8/1989
GB 2242885 A * 10/1991
GB 2 277 020 10/1994
WO WO-91/12975 A1 9/1991
WO WO-98/34575 A2 8/1998
WO WO-2004/039300 A1 5/2004
WO PCT/US06/09066 9/2007
WO PCT/US2008/086672 2/2009

* cited by examiner

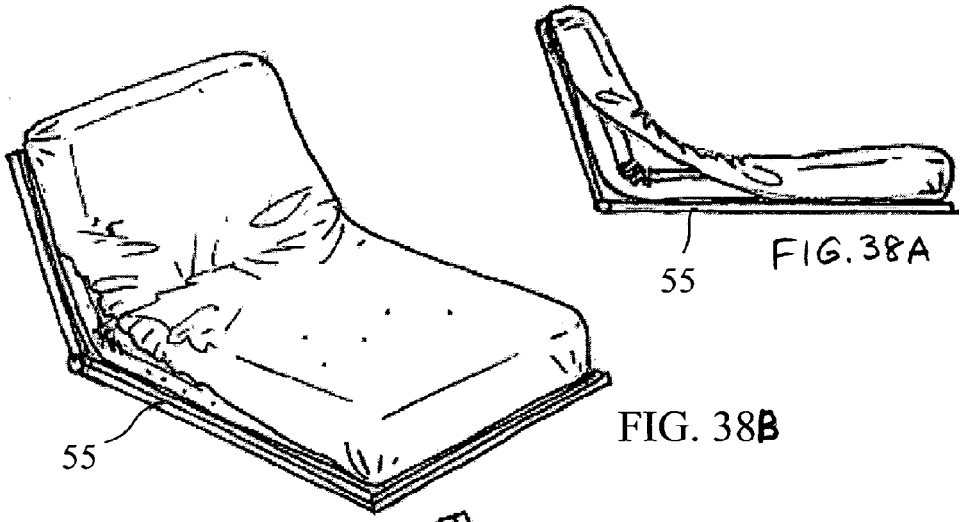
FIG. 38A
FIG. 38B
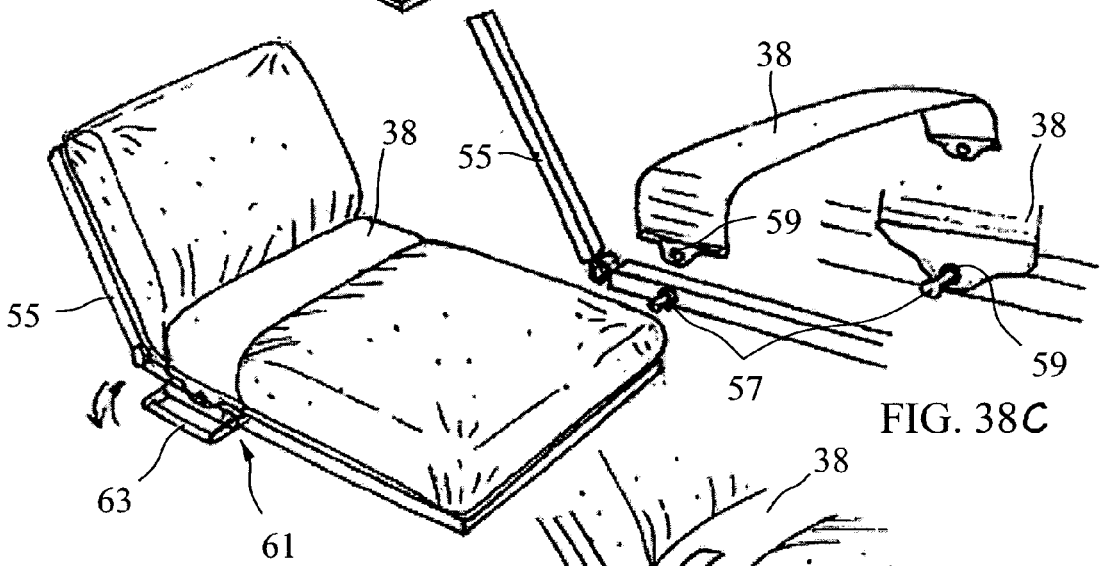
FIG. 38C
FIG. 38D
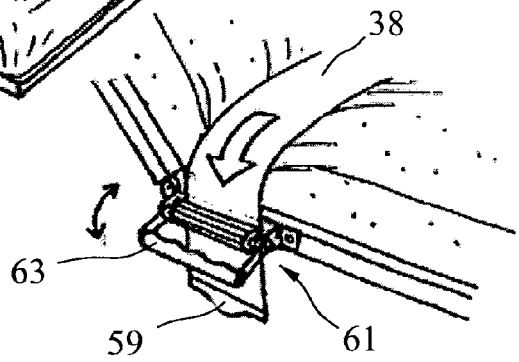
FIG. 38E

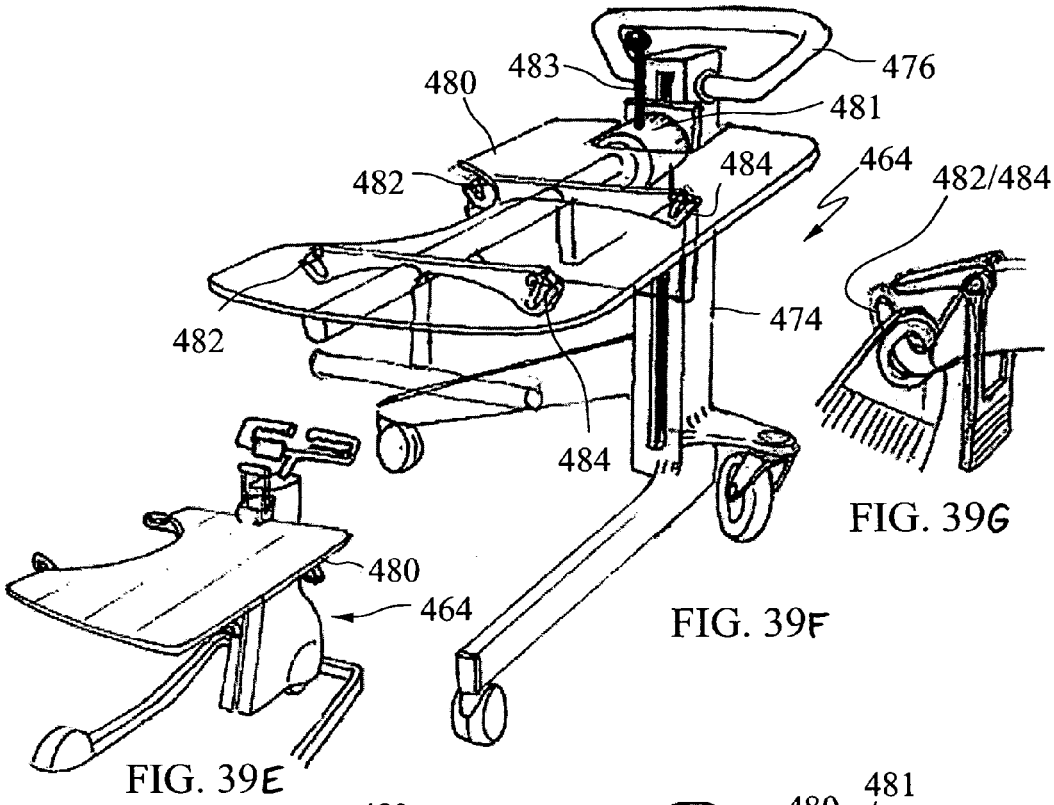
FIG. 39E
FIG. 39F
FIG. 39G
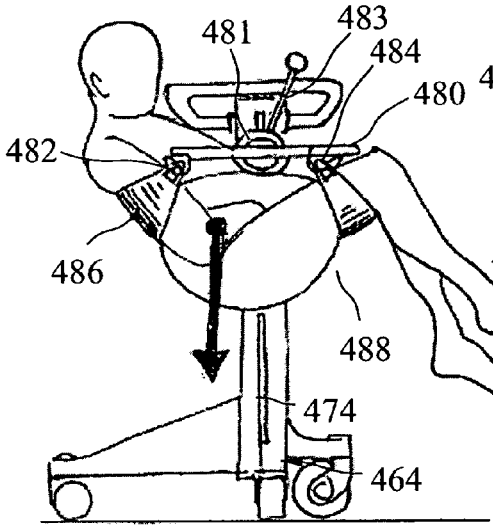
FIG. 39H
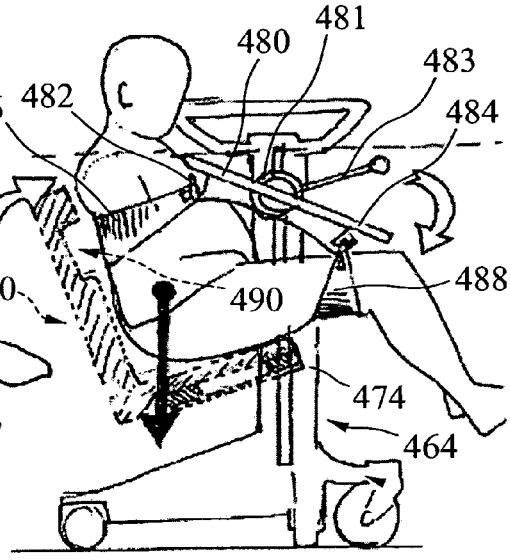
FIG. 39I

PATIENT TRANSFER SYSTEM WITH ASSOCIATED FRAMES AND LIFT CARTS

CROSS REFERENCE TO RELATED APPLICATIONS

The present application claims the benefit of U.S. Provisional Application Ser. No. 60/661,372, filed Mar. 14, 2005 and also claims the benefit of U.S. Provisional Application Ser. No. 60/704,372, filed Aug. 1, 2005.

BACKGROUND

The act of simply moving a patient from one location to another can be readily performed with various existing devices such as the wheelchair. However, most activities of daily living require transfer to and from specific settings such as the bed, chair, commode, shower, bath or vehicle. Traditionally, this transfer has been a manual task performed by caregivers. Unfortunately, the risk of low back pain and musculoskeletal injury increases with the frequency of patient handling.

Rapid growth in the lift segment is outpacing pure demographics due to the epidemic shortage in the nursing workforce. Occupational Safety and Health Administration (OSHA) regulatory policies, and public concern for quality care in nursing homes and hospitals. Workplace injury as a result of lifting and moving patients is a major problem for the nursing industry, which is already in high demand. In fact, there are "safe-lifting" or "no-lift" policies in effect in nursing homes and hospitals across the country. OSHA has concluded that workers' injuries in nursing homes alone will reach 200,000 incidents, at a cost of almost $1 billion dollars, per year. Most of these injuries are directly related to patient transfers. Injuries to caregivers in the home care setting are estimated to be even higher due to the lack of proper equipment.

Proper use of patient lift products and systems has been shown to dramatically reduce workplace injury. Known products include hoist floor-based lifts and ceiling-based lifts. Floor-based lifts utilize a large "crane-line" lift unit that lifts the patient with a fabric sling. These products are outdated in design, difficult to use, can be unsafe, and do not serve as a solution to mobility (transportation) aid. Furthermore, many known institutional floor-based lifts cannot be stored in the patients' room due to their large size and, instead, are kept in distant locations and shared among all patients on the nursing unit or floor. This practice is not conducive to easy access and leads to underutilization. Ceiling-based lifts, using the same fabric slings, are becoming popular because of these storage issues, but are very expensive and require changes to infrastructure for installation. Other drawbacks include patient anxiety and patient safety issues.

SUMMARY

Development of the present invention is based on the observation that the disabled individual is limp or 'flaccid,' and due to this physical property, cannot be easily maneuvered. Some form of rigidity needs to be provided to make this inert 'load' more easy to manipulate. To make a simplified analogy, if one were to move a flaccid load in a warehouse, an interface in the form of a pallet would be used to provide this rigidity, thereby allowing very heavy and fragile loads to be moved with precision. Using similar principles, the present invention has been developed to utilize a rigid interface, that when placed between the disabled individual and their support surface (i.e., bed or chair), provides this necessary structure to facilitate safe and effective handling. In essence, the present invention provides an exoskeleton, providing strength and support to the patient's trunk. Another basic principle of the present invention is that this interface may remain in place throughout many different daily processes. It serves as a framework that can then support different accessories, such as wheels for a wheelchair or scooter, thus eliminating the need for multiple transfers while the disabled individual performs activities of daily living.

Thus, the present invention is directed to a patient transfer system with associated patient support frames, lift carts, lifts, carts, and other accessories for use therewith.

The support frames of the present invention as depicted in the following exemplary embodiments are designed to: (a) provide rigidity (exoskeleton) to the human body for positioning to provide stability for purposes of transferring, lifting and/or transporting the subject via a mobile device; (b) create a female coupling, such as a space (usually between the human body and its existing support surface), to allow insertion/coupling of a tine or other carriage of a lifting device thereto for the purpose of moving or lifting the subject, and/or to provide some other type of coupling with a lifting mechanism of the lifting device, such as a male coupling; and/or (c) be used as a support or frame that will interact with the body as an exoskeleton to aid with the activities of daily living.

Exemplary embodiments of the present invention describe an ergonomically rigid frame assembled from two or more parts about the patient, for assisting the transport of the patient from a bed to another bed or to another location, position or activity.

Exemplary embodiments of the present invention also describe a frame, seat, or chair such as summarized above that is able to be positioned under the patient without lifting or moving the patient's center of gravity (i.e., without lifting, moving or rolling the patient's buttocks).

Exemplary embodiments of the present invention also describe a frame, seat, or chair such as summarized above that is able to be positioned above a patient and affixed to a patient without lifting or moving the patient's center of gravity (i.e., without lifting, moving, or rolling the patient's buttocks).

Exemplary embodiments of the present invention also describe a frame, seat, or chair such as summarized above that includes a receptacle for receiving a tine, fork, or other coupling device of a lift cart, lift, cart or a carriage of another lifting device (such as a hoist, a stair-lift, etc.); or alternatively includes some other sort of coupling, such as a male coupling, for coupling to a complementary coupling of a mobile lift cart, lift, cart or carriage of another lifting device (such as a hoist, a stair-lift, etc.).

Exemplary embodiments of the present invention also describe a frame, seat, or chair such as summarized above that has a dual functionality of assisting in movement of the patient as summarized above, but also serving as a platform for a patient mobility device (such as a wheelchair, motorized scooter, or motor vehicle).

Exemplary embodiments of the present invention also describe a frame, seat, or chair such as summarized above that has articulating hinges so that the patient can be repositioned for different activities.

Exemplary embodiments of the present invention also describe a frame, seat, or chair such as summarized above that have a lock that automatically engages when the lifting device is coupled to the frame.

Exemplary embodiments of the present invention also describe a frame, seat, or chair such as summarized above with the rigid frame portion designed to be attached to the anterior side of the patient; or, alternatively designed to be attached to the posterior side of a patient.

Exemplary embodiments of the present invention also describe a frame, seat, or chair such as summarized above with separate or combined coupling mechanisms for mounting to both a lift device and a mobility device.

Exemplary embodiments of the present invention also describe a patient support frame, seat, or chair for assisting the transport of the patient from a bed to another bed or to another location, position or activity that includes a rigid upper body component pivotally coupled to a rigid lower body component and includes at least one strap/belt adapted to be situated between the bed and the patient (having opposed flaps extending laterally from beneath the patient) for fastening to one of the upper or lower body components when the frame is installed on the patient.

Exemplary embodiments of the present invention also describe a frame, seat, or chair such as summarized above where the lower body component is provided beneath the legs of the patient and the upper body component includes a pair of vertically extending bars adapted to be positioned on opposite lateral sides of the patient and fastened to the respective pair of opposed flaps.

Exemplary embodiments of the present invention also describe a frame, seat, or chair such as summarized above that includes at least one strap/belt positioned beneath the patient's back (while lying on the bed, chair, stretcher and the like) and at least one strap/belt positioned beneath the patient's legs (while lying on the bed, chair, stretcher and the like), which respectively are fastened to a frontal, upper-body component and a frontal leg component of the frame.

Exemplary embodiments of the present invention also describe a frame, seat, or chair such as summarized above that includes a receptacle(s) for receiving a tine(s) or a carriage(s) of a lifting/transporting cart or device.

Exemplary embodiments of the present invention also describe a patient support frame, seat, or chair for assisting the transport of the patient from a bed to another bed or to another location, position or activity that includes at least a pair of hollow-spaces/receptacles provided between the frame and the bed for receiving a corresponding pair of tines/carriages of a patient transfer device/cart, where one hollow-space/receptacle is provided approximate a leg region and one hollow-space/receptacle is provided approximate a back region.

Exemplary embodiments of the present invention also describe a frame, seat, or chair such as summarized above where the receptacle(s) or hollow-space(s) are built into the frame.

Exemplary embodiments of the present invention also describe a frame, seat, or chair such as summarized above where the receptacle(s) or hollow-space(s) are provided by jacks or other lifts between the frame and the bed.

Exemplary embodiments of the present invention also describe a frame, seat, or chair such as summarized above that includes a hinge approximate the hip and a hinge approximate the knee and the tines/carriages of the lift device are adjustable to configure the frame and patient between a flat position and a sitting and/or kneeling position, for example.

Exemplary embodiments of the present invention also describe a method for transporting a patient from a bed to another bed or to another location, position or activity that includes the steps of: installing a frame, seat, or chair (as described in any of the above points of novelty) beneath the patient lying on his/her back; lifting the legs portion of the frame so that the patient's knees are extending upwardly; rolling the frame/patient to the side such that the patient's feet/shin are at least partially extending over a side of the bed; lifting the back portion of the frame/patient until the patient rotates to a seated position with the patient's feet/shins extending down the side of the bed; and coupling a tine(s)/carriage(s) of a lifting/transporting device to the frame and transporting the patient from the bed to the patient's destination.

Exemplary embodiments of the present invention also describe a method as summarized above where the tine(s)/carriage(s) is coupled to a receptacle provided by the frame, seat, or chair.

The above method where the receptacle provided by the frame, seat, or chair is positioned between the legs of the patient.

Exemplary embodiments of the present invention also describe a method as summarized above where the step of lifting the back portion of the patient/frame, seat, or chair to a seated position on the bed involves the assistance of an adjustable bed.

Exemplary embodiments of the present invention also describe a patient mobility device with configurable appendages which allow it to be used as a bed lift in one configuration and a cart in another configuration.

Exemplary embodiments of the present invention also describe a combination patient mobility and lifting device with folding handles.

Exemplary embodiments of the present invention also describe a patient lift device including an extendable horizontal member supported on each end.

BRIEF DESCRIPTION OF THE DRAWINGS

FIGS. 1-8 illustrate various perspective views and uses of first embodiments of the present invention; more specifically.

FIGS. 10-12 illustrate various perspective views and uses of third embodiments of the present invention; more specifically.

FIGS. 14-15 illustrate various perspective views and uses of fifth embodiments of the present invention; more specifically.

FIG. 17 shows a frame assembly;

FIG. 18 shows a patient in a sitting position with the frame assembly donned;

FIG. 19 shows a lateral bed extractor;

FIG. 20 shows the lateral bed extractor coupled with the frame assembly holding a patient;

FIG. 21 shows a forward cart unit;

FIG. 22 shows the cart unit holding a frame assembly with a patient;

FIG. 23 shows the cart unit in its collapsed configuration;

FIG. 24 shows an exemplary space-saving storage scheme;

FIG. 25 shows frame assembly;

FIG. 26 shows the frame donned to a patient;

FIG. 27 shows the extensible bed extractor;

FIG. 28 shows the extensible bed extractor attached to the frame assembly containing a patient;

FIG. 29 shows a pallet;

FIG. 30 shows a pallet placed on a chair ready to receive a patient;

FIG. 31 shows a frame assembly;

FIG. 32 shows the frame assembly in place on a patient;

FIG. 33 shows a rotating fork cart;

FIG. 34 shows a rotating fork cart holding a patient who is fastened within a frame assembly;

FIG. 35 illustrates the rotating fork cart in another configuration;

FIG. 36 shows the forks being inserted into the front receptacles of the frame assembly;

FIG. 37 shows a rotating fork cart with its forks mated with a pallet;

FIGS. 38A-38E illustrate mechanisms for retaining retainer straps (or similar devices) associated with certain embodiments of the present invention to a bed frame or bed;

FIGS. 39A-39I illustrate various perspective and elevational views and uses of a ninth embodiment of the present invention;

DETAILED DESCRIPTION

Figure 1A:
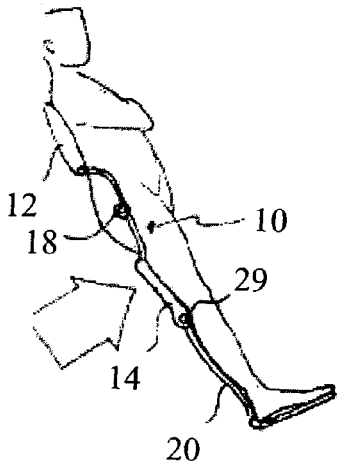
FIGS. 1A-1C and 1E illustrate side views of the exemplary patient support frame supporting a patient in various positions.
Figure 1B:
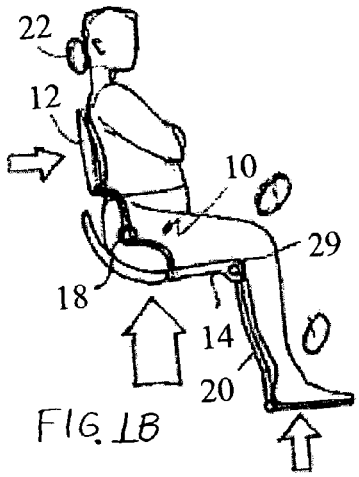
Figure 1C:
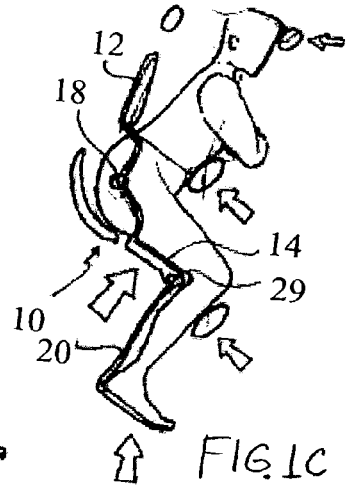
Figure 1D:
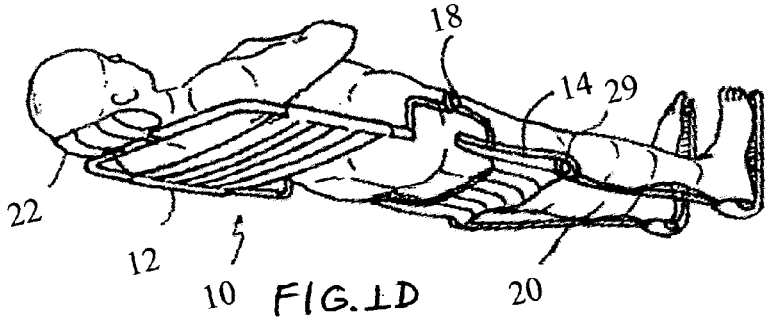
FIG. 1D is a perspective view of the patient support frame supporting a patient in a supine position.
Figure 1E:
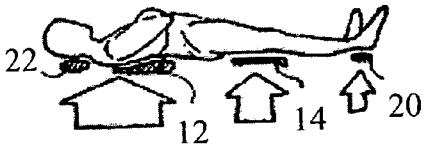

The present invention is directed to patient transfer systems with associated patient support frames, lift carts, lifts, carts, and other accessories for use therewith. The present invention is also directed to methods associated with such systems, components and accessories. The support frames of the present invention as depicted in the exemplary embodiments are designed to: (a) provide rigidity (exoskeleton) to the human body for positioning to provide stability for purposes of transferring, lifting and/or transporting the subject via a mobile device, such as a powered lift device; (b) create or provide female coupling such as a space or a receptacle to allow insertion/coupling of a tine or other carriage of a lifting/mobility device thereto for the purpose of moving or lifting the subject, or provide some other sort of coupling mechanism (such as a male coupling) for coupling to a lift mechanism of a lifting device; and/or (c) be used as a support or frame that will interact with the body as an exoskeleton to aid with the activities of daily living.

Each exemplary system and frame is designed according to an intended use in supporting, lifting and/or transporting patients in at least one of three Out of Bed Assistance Categories (OBAC) for non-ambulatory disabled individuals: Category 1—disabled, self sufficient (requires no human assistance); Category 2—disabled and partially bedridden (requires some human assistance) and (c) Category 3—disabled and completely bedridden (requires substantially 100% human assistance).

FIGS. 1A-1F, 2A-2C, 3A-3C, 4A-4C, 5A-5C, 6A-6C, 7A-7D, 8A 8F depict a patient transfer system with an associated two-piece patient support frame and lift cart according to first exemplary embodiments of the present invention. The first exemplary embodiments are designed specifically to assist Category 2 patients. The exemplary embodiments of FIGS. 1A-1F, 2A-2C, 3A-3C, 4A-4C, 5A-5C, 6A-6C, 7A-7D, 8A-8F provide a two-piece patient support frame 10 (referred to in the attached figures as the "ErgoFrame") for providing rigid support to a patient's body to facilitate transfers of the patient bed-to-bed or bed-to-chair, etc. The frame 10 includes an upper back support component 12 and a lower thigh support component 14 adapted to be coupled together and at an attachment point 16. There may also be an articulating hinge 18 present at the hip area of the patient when assembled. Optionally, the lower thigh support portion may also include heel and foot support components 20 extending therefrom (including an articulating knee hinge) while the upper back support component 12 may optionally include a head supporting component 22.

The upper back support component 12 essentially includes a U-shaped rigid framework with flexible webbing or straps extending laterally between the two vertical bars of the U-shaped rigid framework for supporting the patient's torso. The lower thigh support component 14 includes a pair of opposed, rigid vertical bars and includes a cushioned rigid platform extending therebetween for supporting the patient's thighs.

Figure 2A:
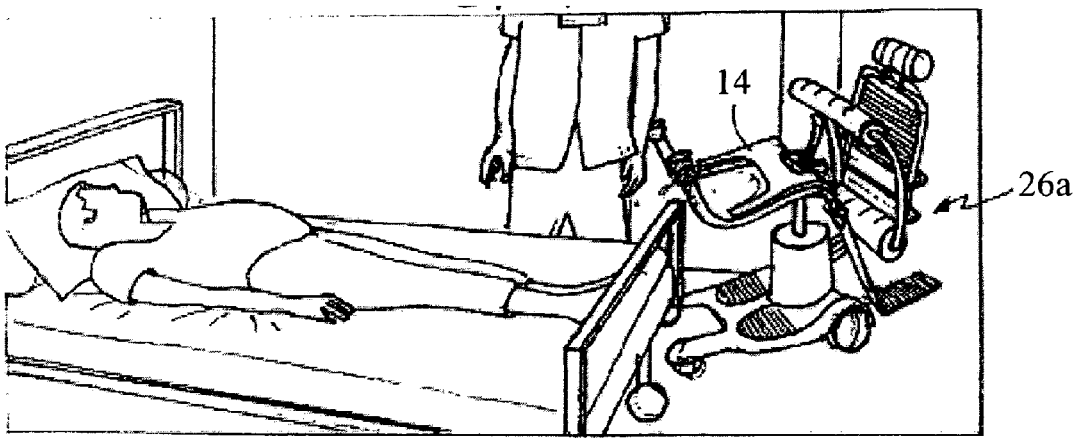
FIGS. 2A-2C disclose a first step in the process of positioning the frame on the patient.
Figure 2B:
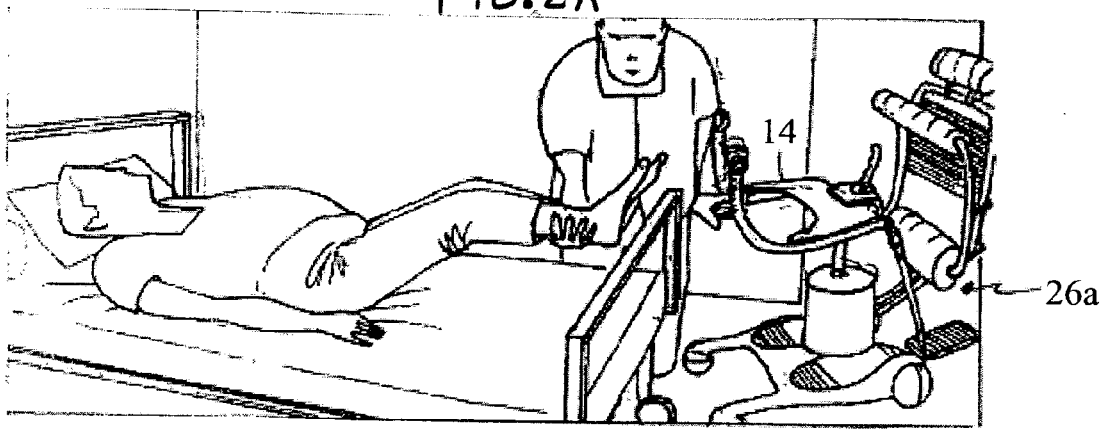
Figure 2C:
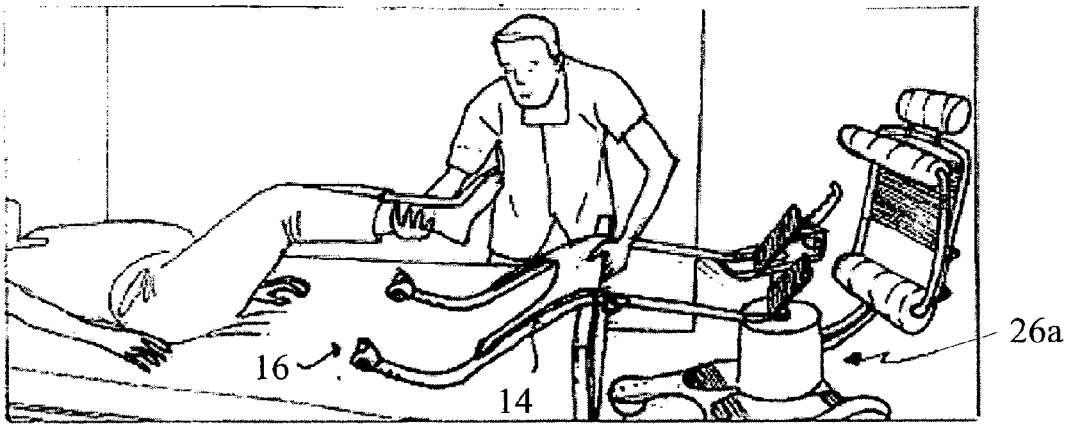
Figure 3A:
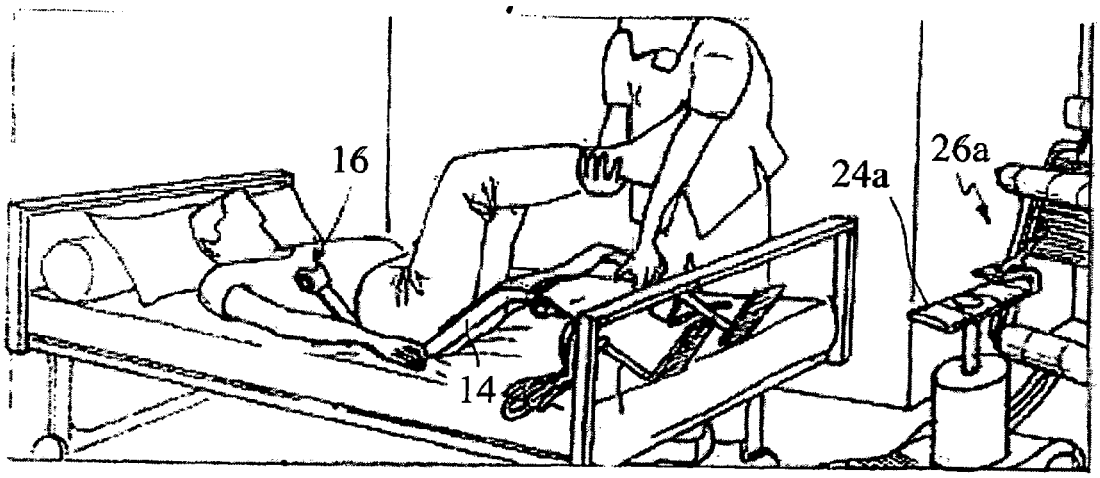
FIGS. 3A-3C illustrate the patient's legs being strapped to the lower thigh support component.
Figure 3B:
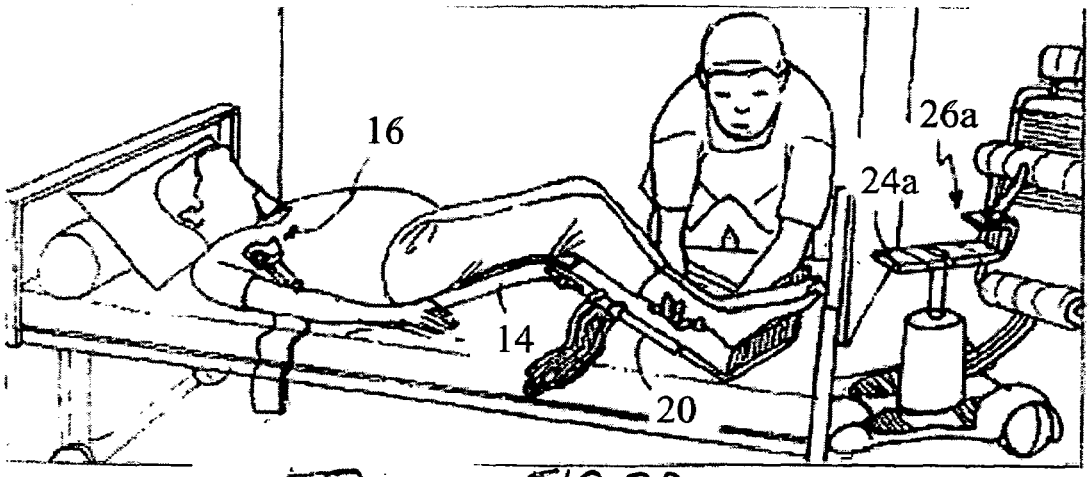
Figure 3C:
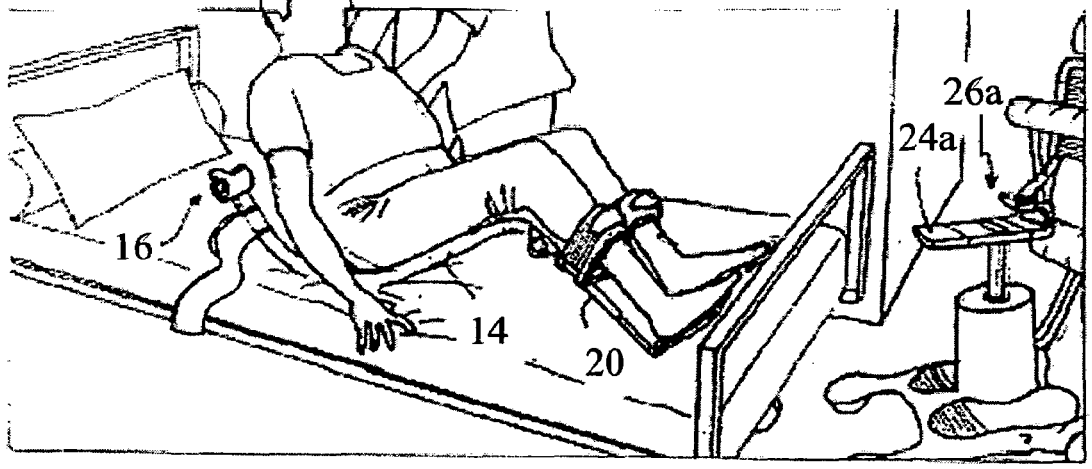
Figure 4A:
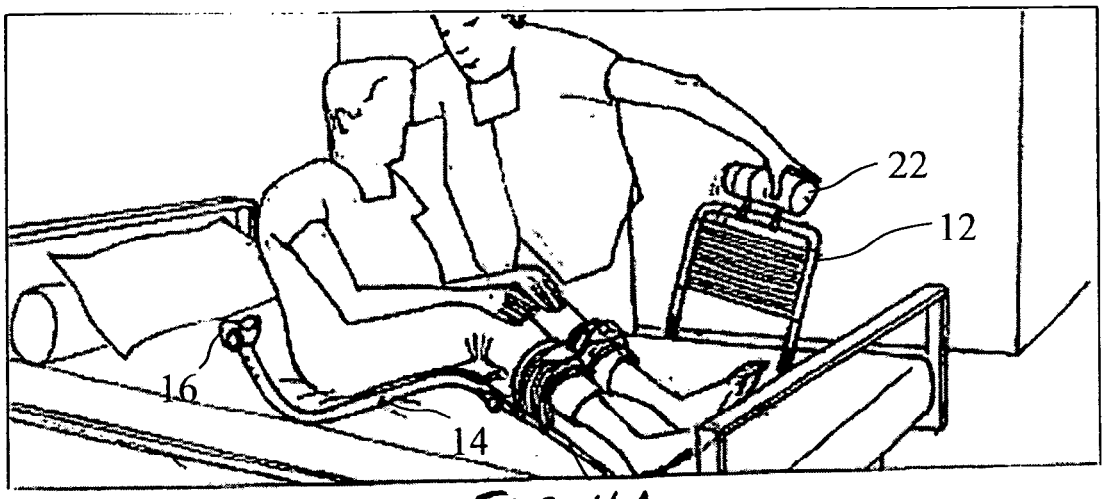
FIGS. 4A-4C show lifting the patient's head or back and positioning the upper back support portion and coupling it to the lower thigh support portion.
Figure 4B:
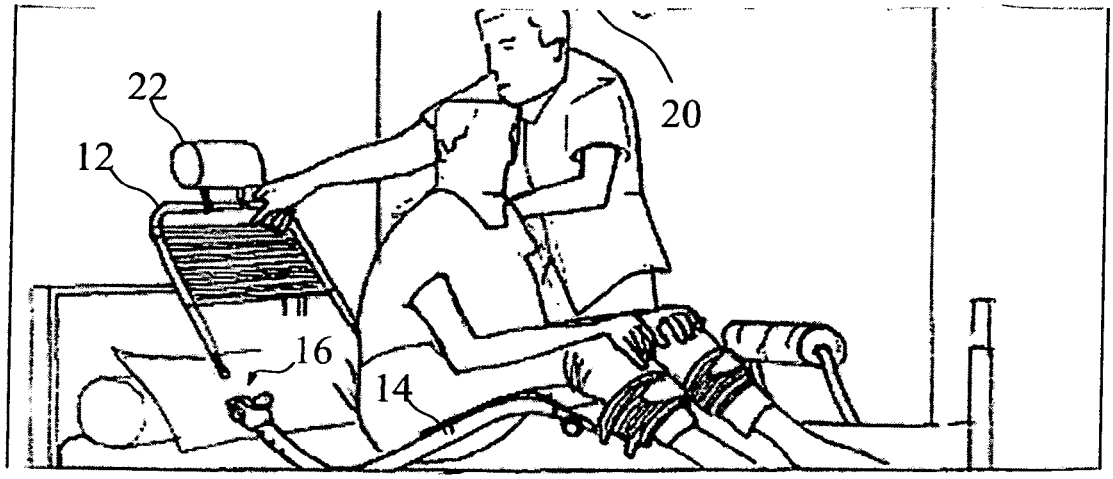
Figure 4C:
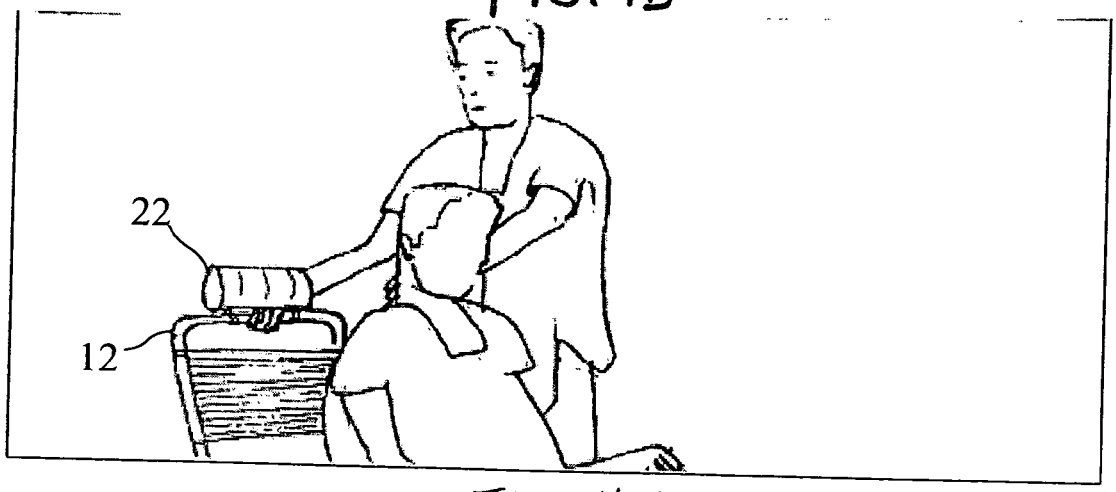
Figure 5A:
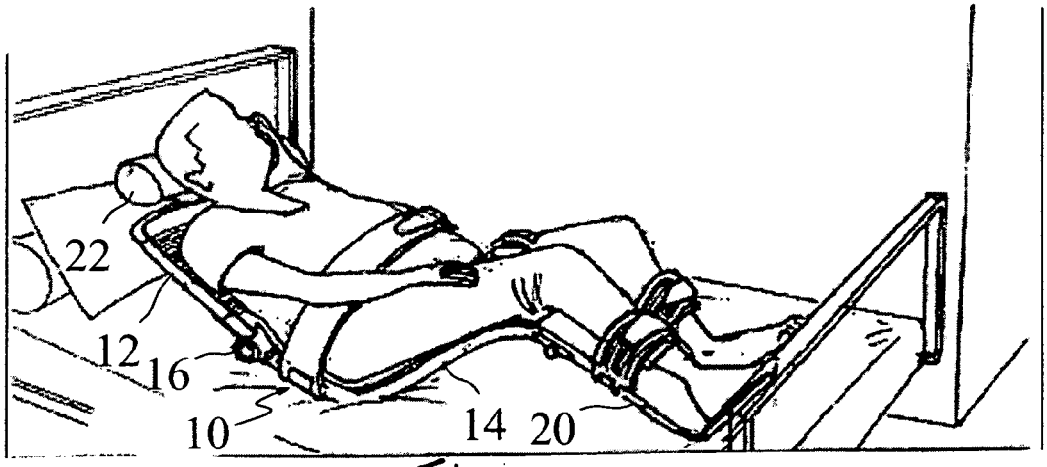
FIGS. 5A-5C show the patient strapped to the rigid assembled frame.
Figure 5B:
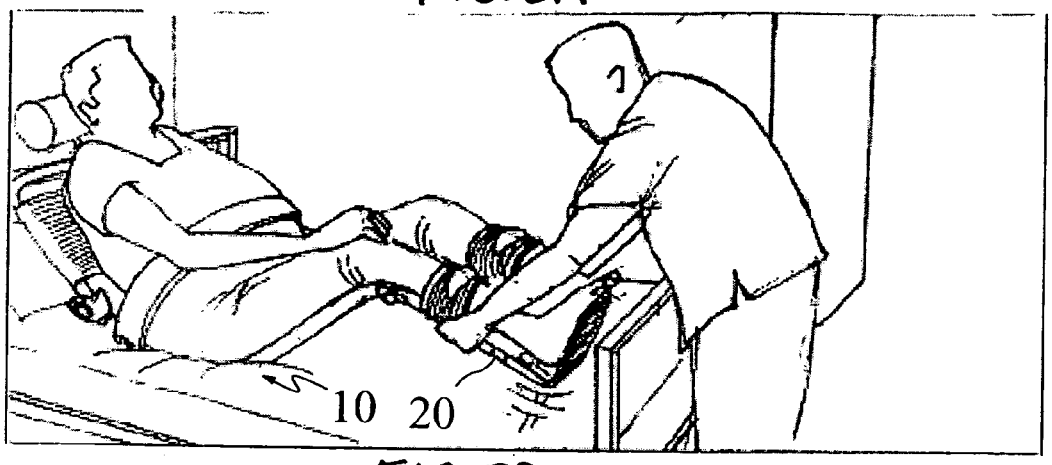
Figure 5C:
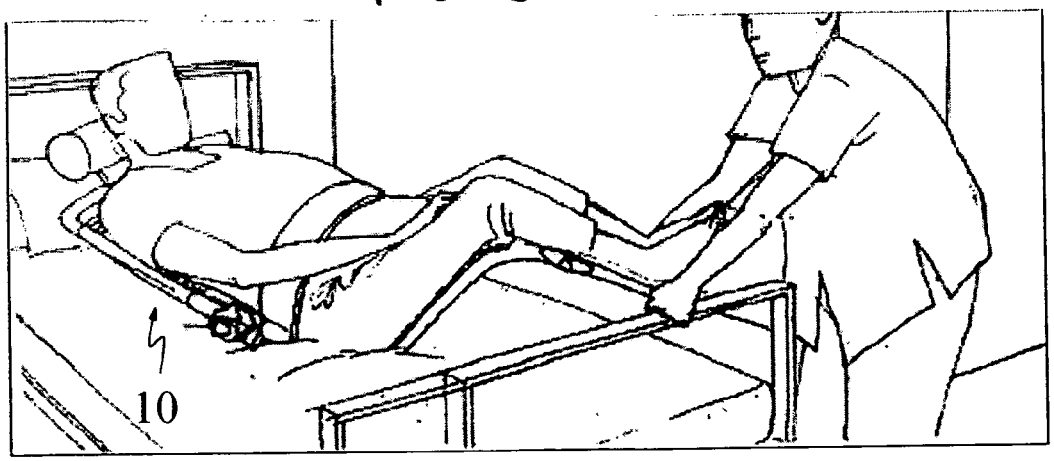

As shown in FIGS. 2A-2C, 3A-3C, 4A-4C, 5A-5C, 6A-6C, the two-piece frame 10 allows the frame to be positioned under the patient by a single assistant without necessitating the assistant to lift the patient completely from the bed or necessitating the assistant to roll the patient to his or her side. As shown in FIGS. 2A-2C, a first step in the process of positioning the frame on the patient is to first lift the patient's legs and then insert the lower thigh support component 14 beneath the patient's legs. As shown in FIGS. 3A-3C, the legs are then strapped to this lower thigh support component 14. The next step as shown in FIGS. 4A-4C of the attached drawings, is to lift the patient's head or back and then position the upper back support portion 12 therebehind coupling it to the lower thigh support portion 14 at the coupling 16. It will be appreciated that adjustable hospital beds may provide a lift-able back support to assist with lifting the patient's back, if desired. As shown in FIGS. 5A-5C, the patient is then strapped to the rigid assembled frame 10.

Figure 1F:
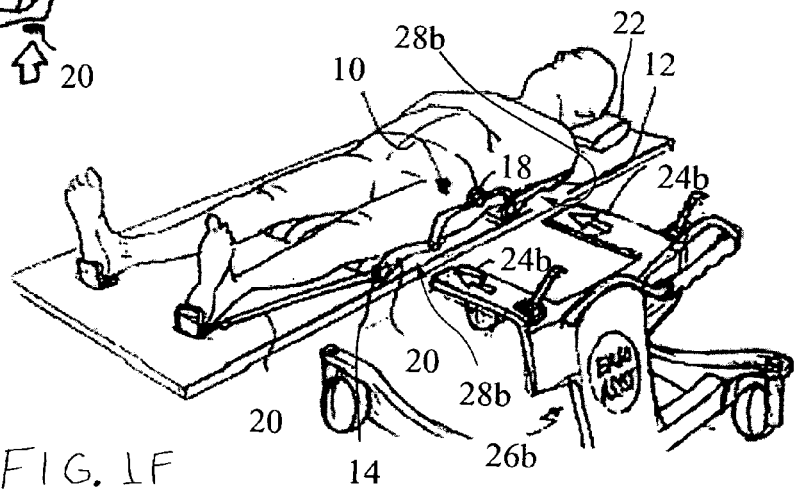
FIG. 1F is a perspective view of the patient support frame supporting a patient in a supine position and an associated lift cart.
Figure 6A:
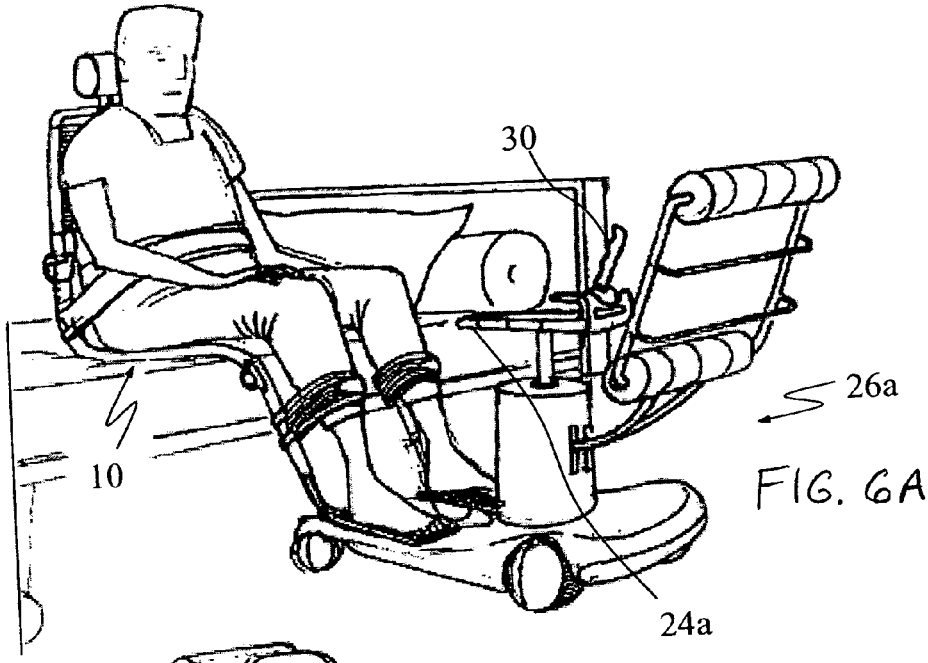
FIGS. 6A-6C illustrate lifting the patient from the bed and moving the patient to the desired location or activity.
Figure 6B:
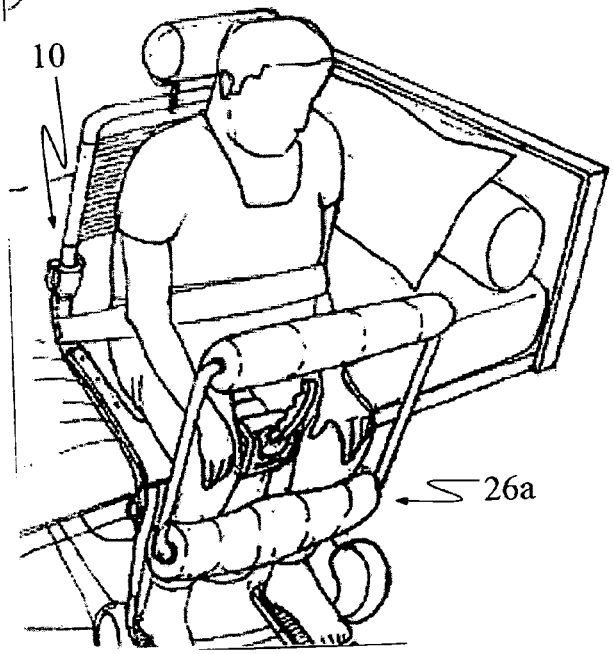
Figure 6C:
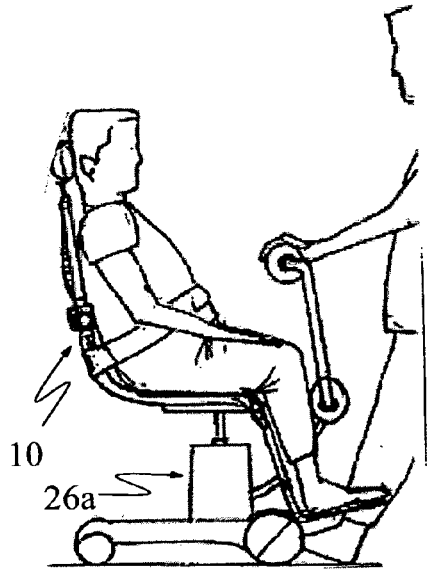

As shown in FIGS. 6A-6C, once the patient is strapped to the rigid, assembled frame 10, a tine 24*a* of a lift cart 26*a* will mate with an associated receptacle 28*a* (See also FIGS. 7D and 8F, for example), so as to lift the patient from the bed and move the patient to the desired location or activity. The lift cart 26*b* shown FIG. 1F is a lateral-access device specialized for transferring the patient bed-to-bed. This dual tines 24*b* of this lift cart 26*b* are received within a corresponding pair of hollow-spaces/receptacles 28*b*, which are respectively formed by the frame 10 between the back support portion 12 of the frame and the bed and between the thigh support portion 14 and the bed. The lift cart 26*a* shown in FIGS. 2A-2C, 3A-3C, 6A-6C, 7D, 8E-8F 8 is a front access lift device for lifting the patient in a sitting position. The single, centered tine 24*a* of this lift cart 26*a* is received within a corresponding hollow-space/receptacle 28*a* provided by the thigh support portion 14 of the frame, between the legs of the patient.

As shown in FIGS. 1A-1F, the assembled frame 10 has hinges such as the hip hinge 18 and the knee hinge 29 for respective articulation at the hip joint and knee joint for example to allow the subject to change body position to suit the desired activity.

Figure 7A:
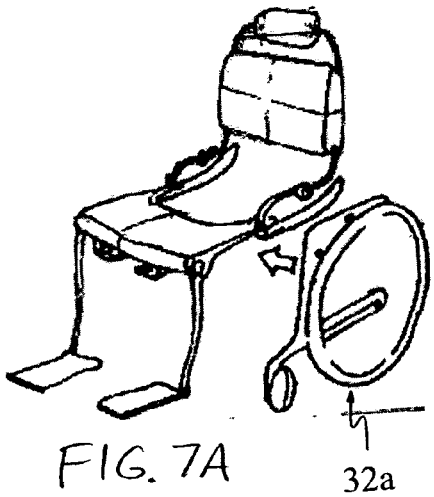
FIGS. 7A-7D illustrate a mobility base that can be coupled to the frame.
Figure 7B:
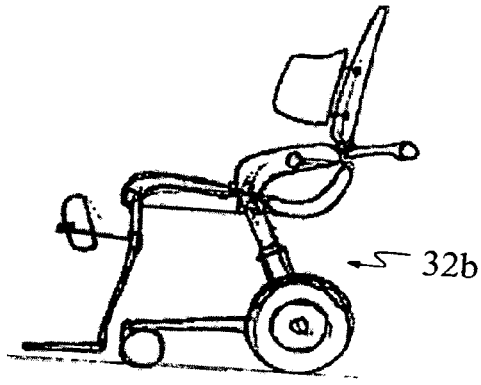
Figure 7C:
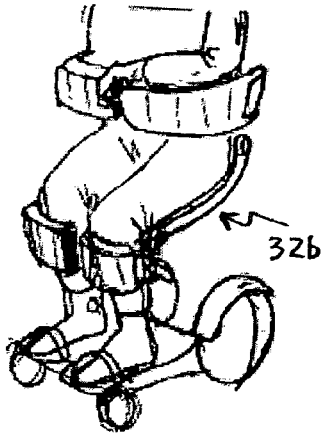
Figure 7D:
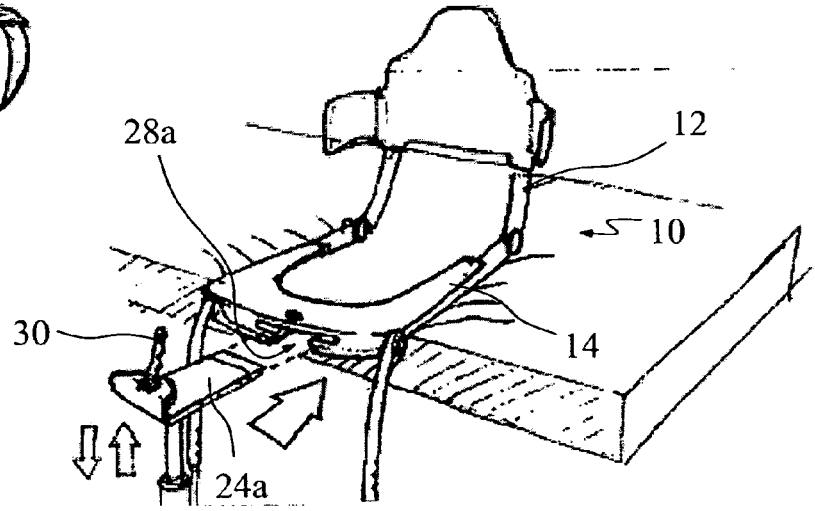
Figure 8A:
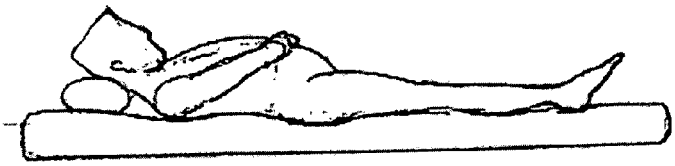
FIGS. 8A-8F shows the patient strapped to the frame and an associated receptacle.
Figure 8B:
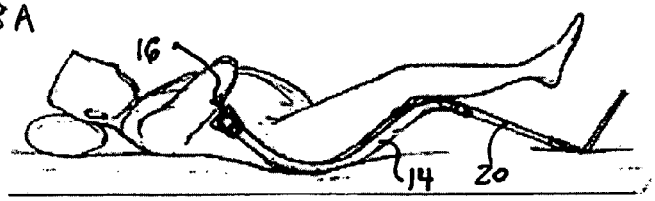
Figure 8C:
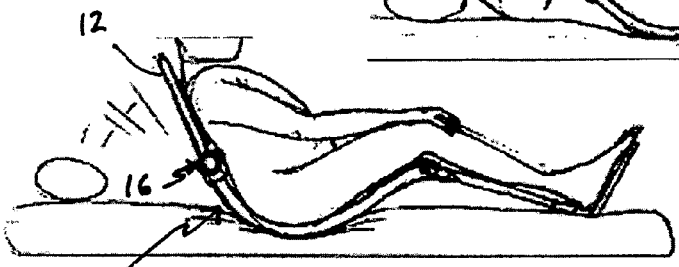
Figure 8D:
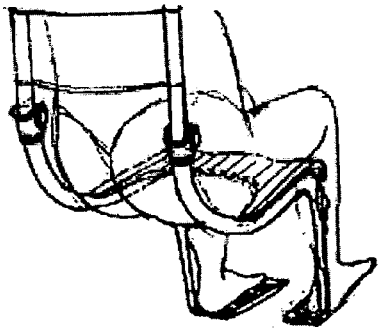
Figure 8E:
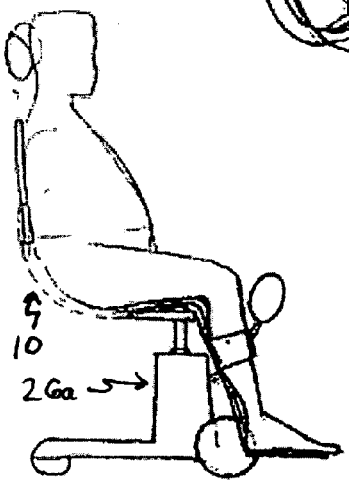
Figure 8F:
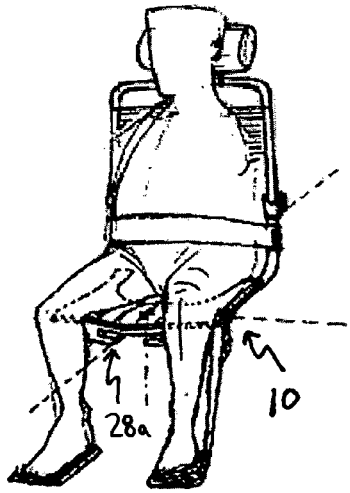

As shown in FIGS. 7A-7C, the first exemplary embodiments may also utilize accessories such as a mobility base 32*a/b* that can be coupled to the frame 10 so that the frame can act as a wheelchair for example.

Preferably, the tine 24*a/b* of the lift cart 26*a/b* engages with the receptacle 28*a/b* of the frame 10 automatically locks when engaged. A lever 30 may be provided, for example, (see FIG. 7D) to release the lock when necessary.

FIGS. 9A-9F depict a patient transfer system with an associated two-piece patient support frame and lift cart according to second exemplary embodiments of the present invention. The second exemplary embodiments are also designed specifically to assist Category 2 patients. The exemplary embodiment of FIGS. 9A-9F provides a two-piece patient support frame 36 for providing rigid support to a patient's body to facilitate transfers of the patient bed-to-bed or bed-to-chair, etc. The frame 36 includes detachable back-rest pad component 38 and a rigid frame component 40. The back-rest pad component 38 is adapted to be extended between, and attached across a pair of vertically extending, rigid, outer bars 42 of an upper, back portion 44 of the frame 36, which is attached to a lower thigh-support portion 46 of the frame 36 at a hinge articulation point 48. Optionally, the lower thigh support portion 46 may also include heel and foot support components (not shown) extending therefrom (including an articulating knee hinge) while the upper back portion 44 of the frame 36 may optionally include a head supporting component 50. It is within the scope of the invention that the upper back portion 44 of the frame is selectively detachable/re-attachable to the lower thigh-support portion 46 of the frame as described in the first exemplary embodiments (shown in FIGS. 1A-1F, 2A-2C, 3A-3C, 4A-4C, 5A-5C, 6A-6C, 7A-7D, 8A 8F).

Figure 9A:
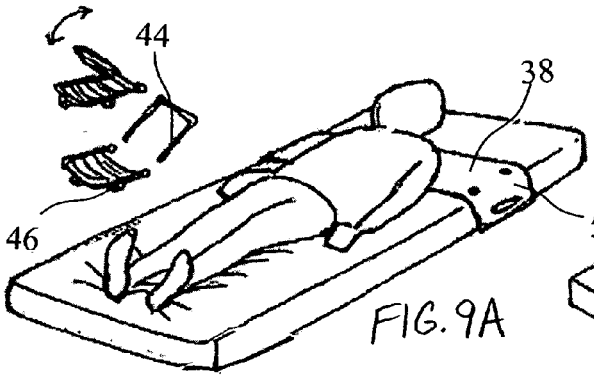
FIGS. 9A-9F illustrate various perspective views and uses of second embodiments of the present invention.
Figure 9B:
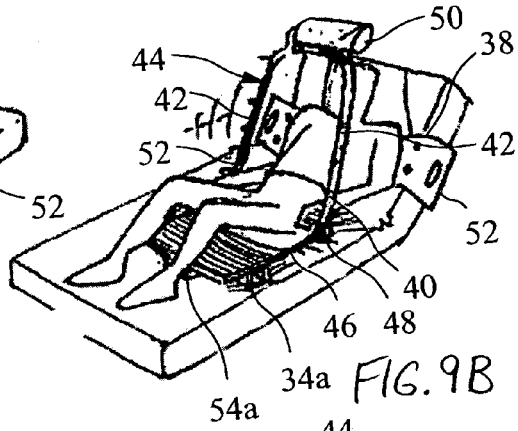
Figure 9C:
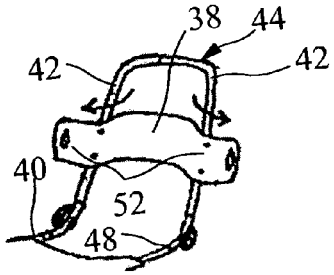
Figure 9D:
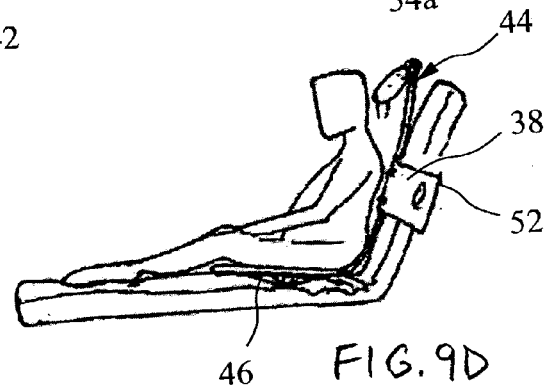

To don the frame to the patient, (1) the back-rest pad component 38 is first laid on the mattress beneath the shoulders and back of the patient such the opposed pair of flaps 52 extend laterally out from below the patient's shoulders as shown in FIG. 9A. (2) The thigh-support portion 46 of the frame 36 is then laid beneath the thighs of the patient such that the upper back portion 44 of the frame 36 extends above the patient as shown in FIG. 9B. (3) The patient's back is then lifted (with the assistance of the adjustable bed, for example) through the upper back portion 44 of the frame, such that the flaps 52 of the back-rest pad component 38 can be attached to the vertically extending outer bars 42 as shown in FIGS. 9C and 9D. Once the frame is thus assembled, the patient is then strapped to the frame 36.

Figure 9E:
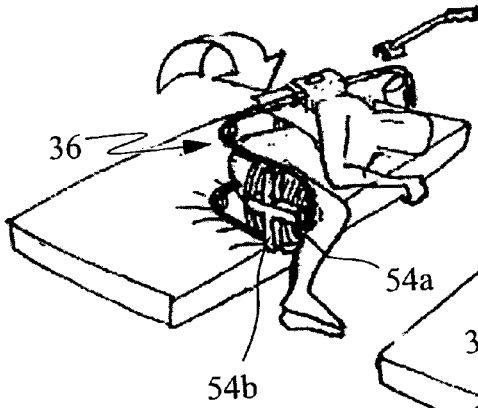
Figure 9F:
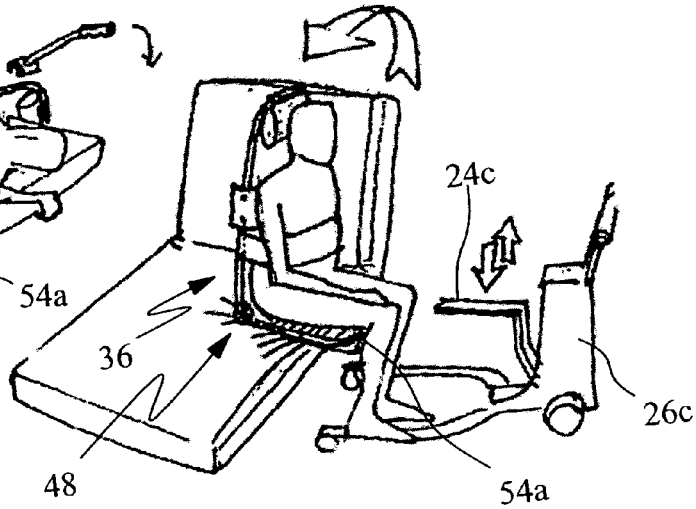

To manipulate the patient and frame to the seated position with the patient's legs dangling over the side of the bed (so that the frame can be coupled to a lift cart 26*c* at the side of the bed): the bed is adjusted back to its flat configuration again, where the weight of the patient's upper body causes the back portion 44 to lay flat on the bed and the thigh portion 46 to extend upwardly (this is not shown in FIG. 9); next, (4) the patient is turned on his/her side such that his/her legs extend over the side of the bed as shown in FIG. 9E; and, finally, (5) the adjustable bed is used again to help flip up the back portion 44 such that the patient is flipped to the seated position with his/her legs dangling over the side of the bed as shown in FIG. 9F.

The thigh-support portion (seat) 46 of the frame 36 includes forward and side receptacles (hollow spaces) 54*a/b* for receiving and being coupled to a tine 24*c* of a corresponding lift cart 26*c* in a manner as described above.

Referring to FIGS. 38A-38E, the back-rest pad component 38 (or any of the other lifting or support belts, straps or webbing described herein and adapted to be releasably secured behind the patient to one of the exemplary frames, pallets, seats or otherwise) can be initially attached or secured to the bed mattress or the bed frame. For example, as shown in FIG. 38C, the back-rest pad component 38 is secured to the bed frame 55 by hooks 57 extending from the bed frame which are received within eyelets 59 extending through the lateral ends of the back-rest pad component 38. As another example, as shown in FIG. 38D, the back-rest pad component 38 is secured to the bed frame 55 by a buckle component 61 having a lever 63 that opens and closes the buckle 61 onto the lateral ends of the back-rest pad component 38.

Figure 10A:
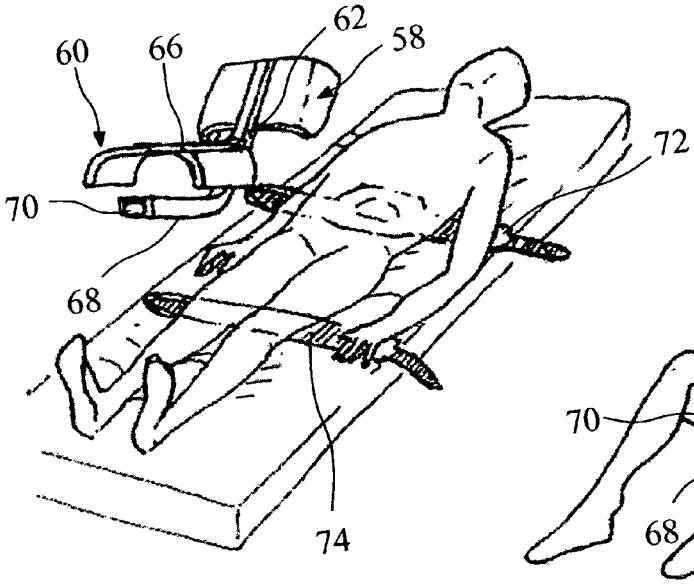
FIGS. 10A-10E show the support frame of the third exemplary embodiment.
Figure 10B:
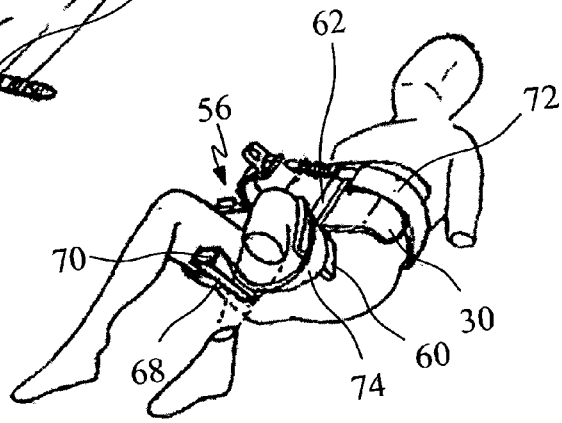
Figure 10E:
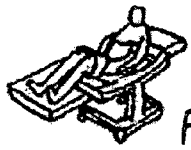

FIGS. 10A-10D, 11A-11D, 12A-12D depict a patient transfer system with an associated multi-piece patient support frame and lift cart according to third exemplary embodiments of the present invention. The third exemplary embodiments are designed specifically to assist Category 2 patients. The support frame 56 of the third exemplary embodiments include frontal waist plate 58 and a frontal thigh plate 60, each of which include respective central bars 62/64 respectively extending downward and upwardly therefrom and connected together at an articulating hinge 66. The downward extending bar 62 also includes an extension 68 that is adapted to extend forwardly between the legs of the patient and this includes a receptacle 70 at an end thereof for receiving and being coupled to a tine 24*d* of a lift cart 26*d* (see FIGS. 11A-11D, 12A-12D). The support frame 56 of the third exemplary embodiments also includes an upper-body belt 72 and a thigh belt 74, each of which are adapted to lie on the bed between the patient and the bed and to be respectively strapped to the frontal waist plate 58 and frontal thigh plate 60, respectively as shown in FIGS. 10A and 10B.

Figure 10C:
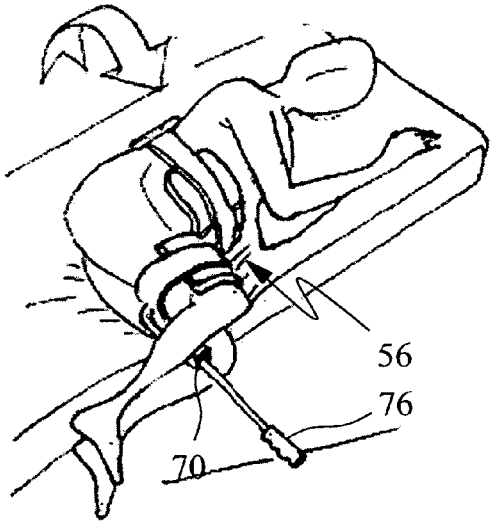
Figure 10D:
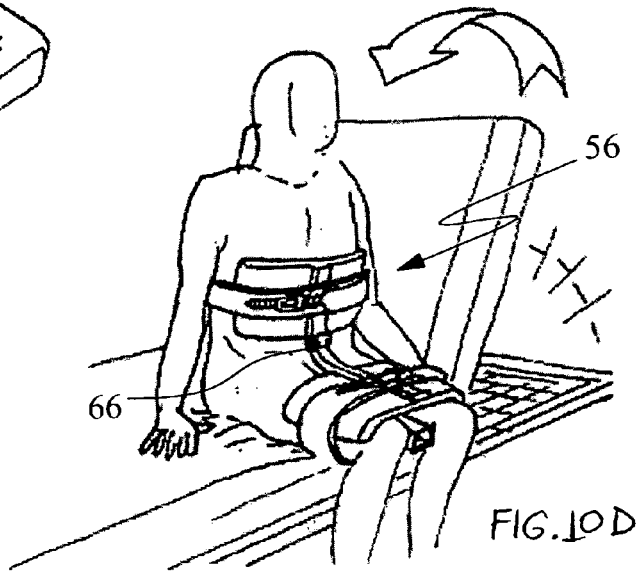

To manipulate the patient and frame to the seated position with the patient's legs dangling over the side of the bed (so that the frame can be coupled to a lift cart 26*d* at the side of the bed): after strapping the frame 56 about the patient as described above, the patient is turned on his/her side such that his/her legs extend over the side of the bed (a lever 76 received within the receptacle 70 may assist with this step) as shown in FIG. 10C; and, next, the adjustable bed is used to help flip up the patient to the seated position with his/her legs dangling over the side of the bed as shown in FIG. 10D.

Figure 11A:
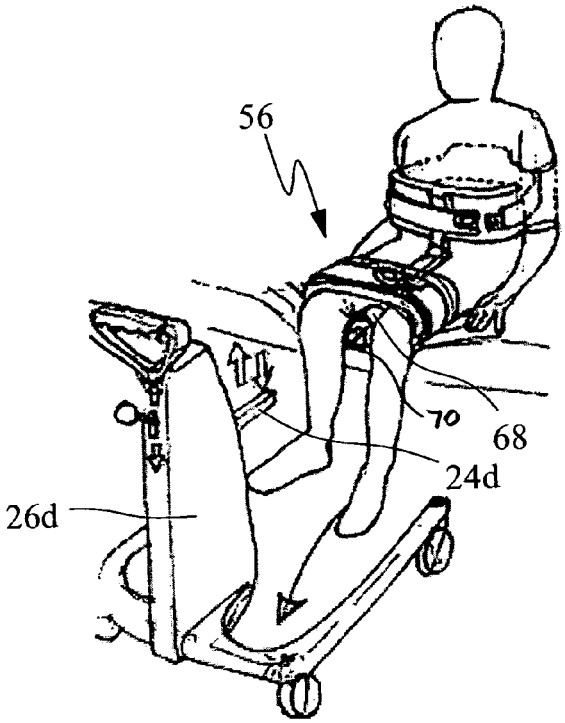
FIGS. 11A-11D further depict the support frame of the third exemplary embodiment.
Figure 11B:
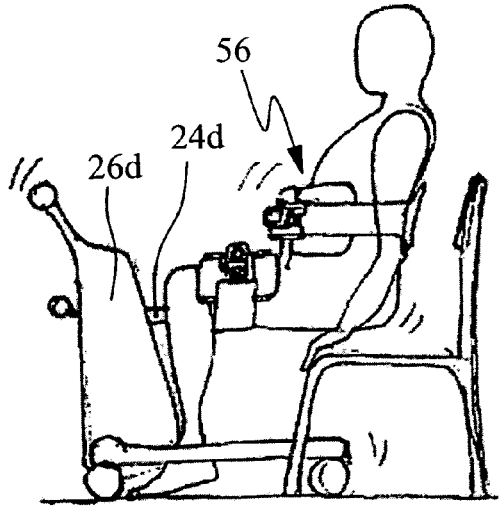
Figure 11C:
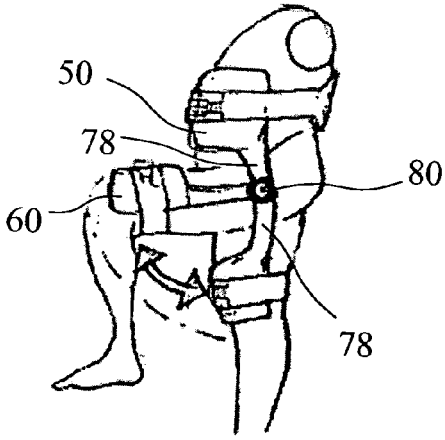
Figure 11D:
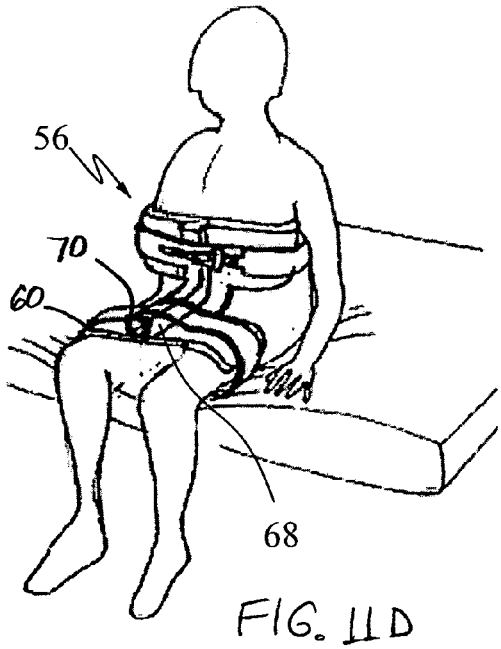

As shown in FIGS. 11A and 11B, the lift cart 26*d* includes a tine 24*d* that is coupled to the receptacle 70, allowing the patient to be easily transported from the bed. As shown in FIGS. 11A and 11D, the extension 68 may extend both above or below the frontal thigh plate 60. As also shown in FIG. 11C, it is within the scope of the invention to couple the frontal thigh plate 60 to the upper waist plate 58 with opposing pairs of side bars 78, each pair of which is coupled at a hip hinge 80.

Figure 12A:
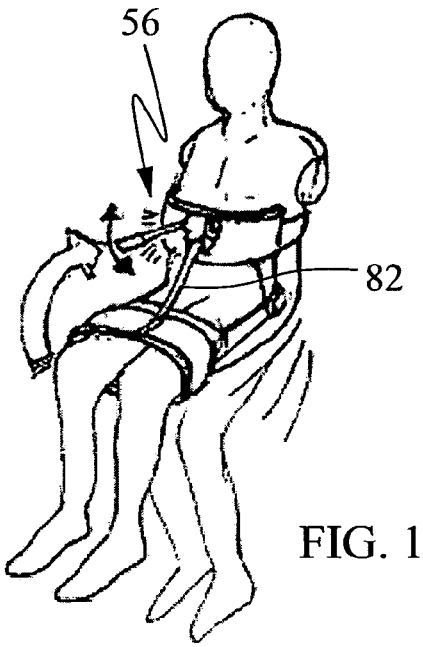
FIGS. 12A-12D illustrate various adaptations of and accessories for use with the third exemplary embodiments.
Figure 12B:
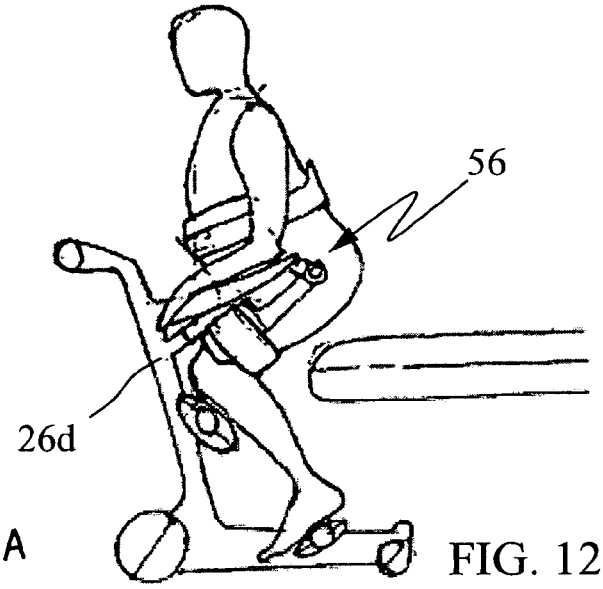
Figure 12C:
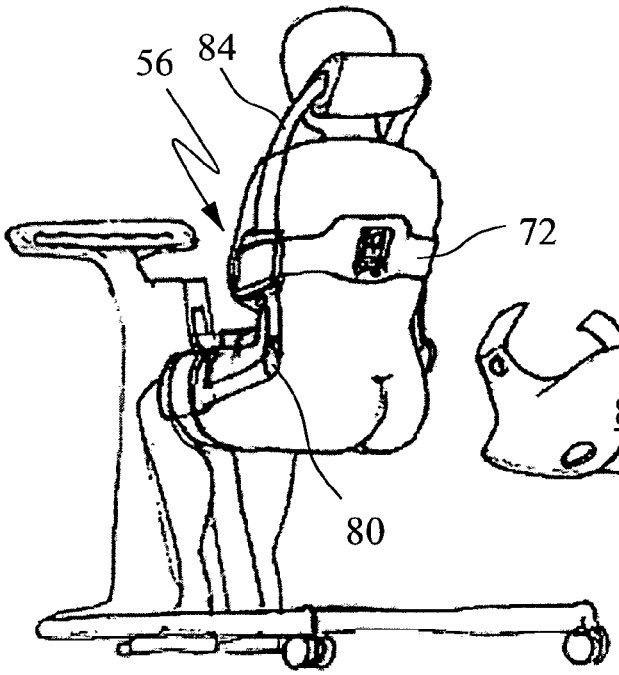
Figure 12D:
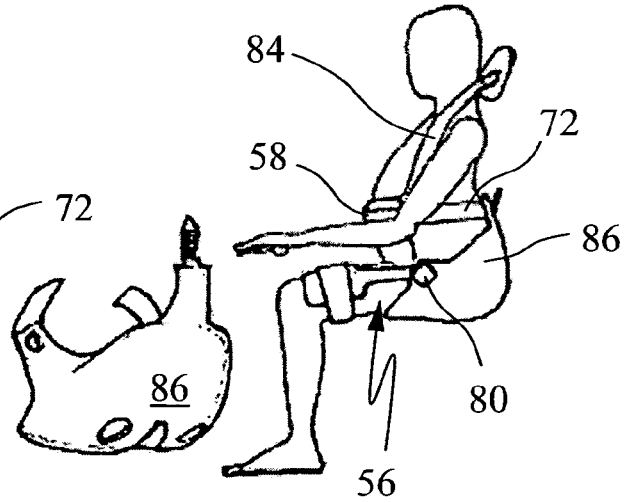
Figure 13A:
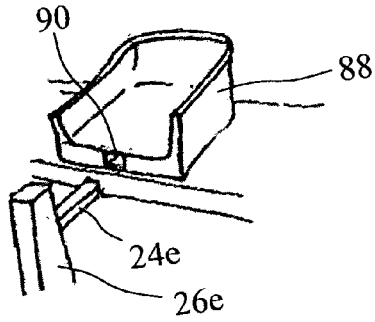
FIGS. 13A-13E illustrate various perspective views and uses of a fourth embodiment of the present invention.
Figure 13B:
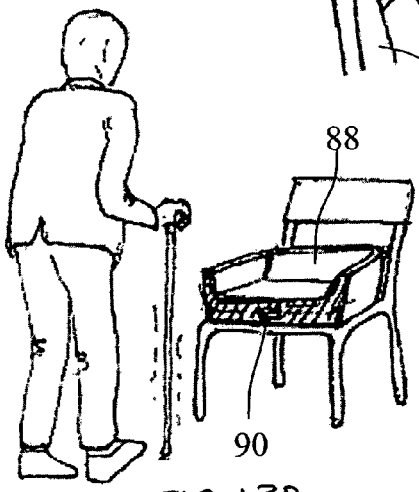
Figure 13C:
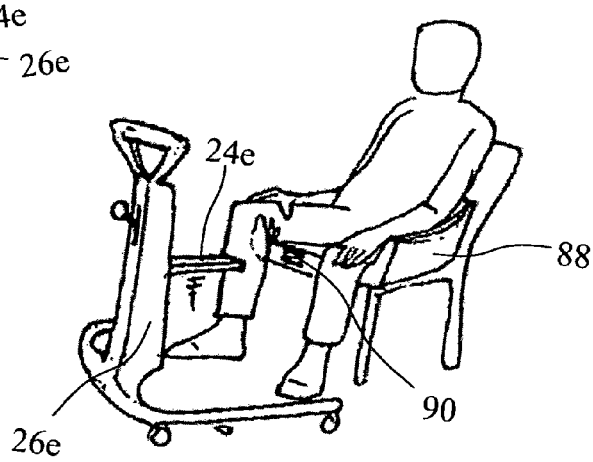
Figure 13D:
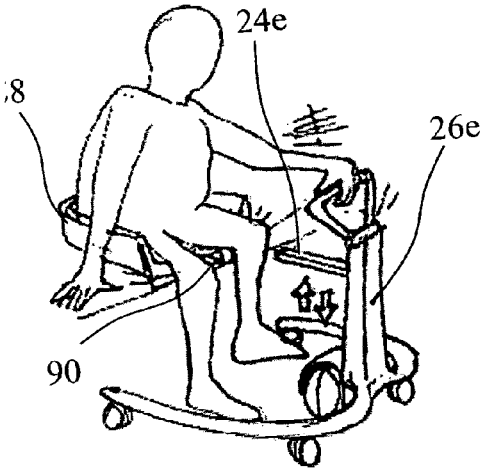
Figure 13E:
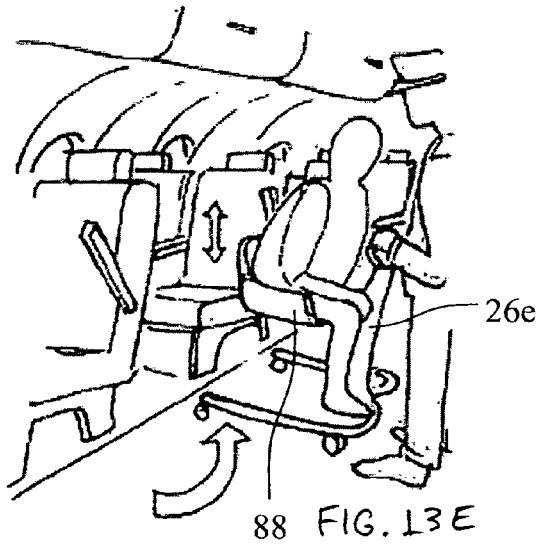

FIGS. 12A-12D illustrate various adaptations of, and accessories for use with the third exemplary embodiments. FIG. 12B illustrates that the patient may be received by the lift cart 26*d* in a kneeling-seating posture. FIG. 12A illustrates an accessory that provides an articulating lever/sling assembly 82 to assist with articulating the patient's legs with respect to his/her waist. FIGS. 12C and 12D illustrate an accessory that provides a neck and head support component 84 that may be coupled to the upper waist plate 58 to extend behind the patient's neck and head. FIGS. 12C and 12D also illustrate an accessory that provides a bottom/seat support 86, which may be attachable to the hip hinges 80 and the body belt 72 (the bottom/seat support 86 may also include openings for communication with a human-waste receptacle or tank).

FIGS. 13A-13E depicts a patient transfer system with an associated patient support palette and lift cart according to a fourth exemplary embodiment of the present invention. The fourth exemplary embodiment is designed specifically to assist Category 1 patients. As shown in FIGS. 13A-13E, the fourth exemplary embodiment is essentially a rigid seat 88, which includes a front-central receptacle 90 (positioned between the legs of the seated patient) adapted to couple the seat 88 to a tine 24*e* of a lift cart 26*e*.

Figure 14A:
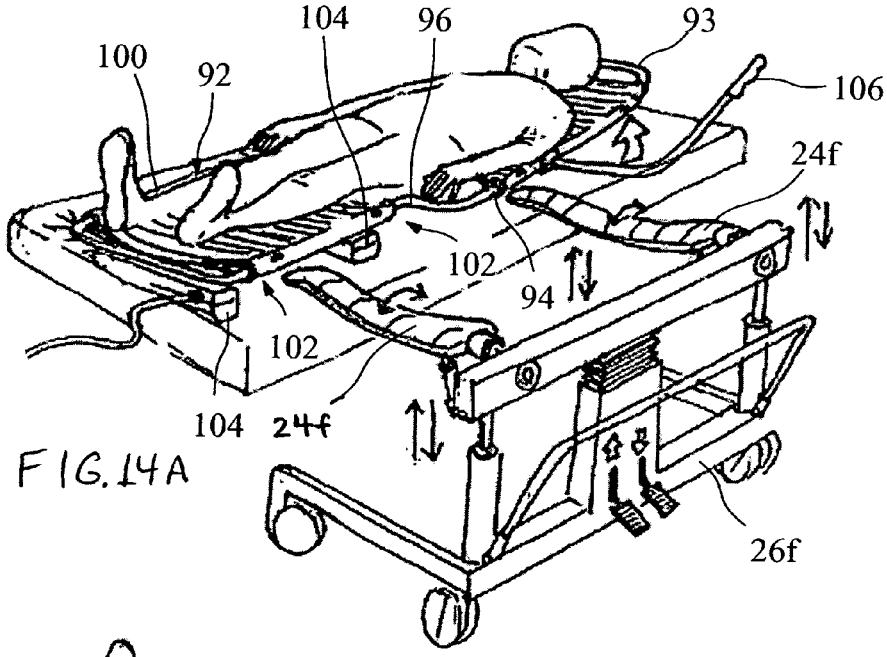
FIGS. 14A-14C show a patient transfer system with an associated patient support frame and lift cart according to fifth exemplary embodiments of the present invention.
Figure 14B:
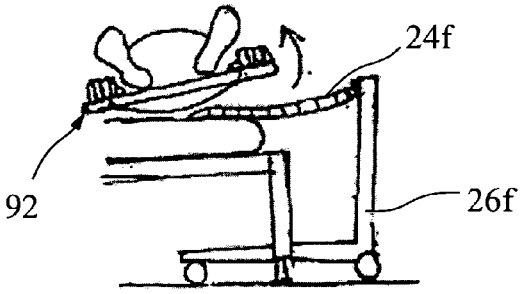
Figure 14C:
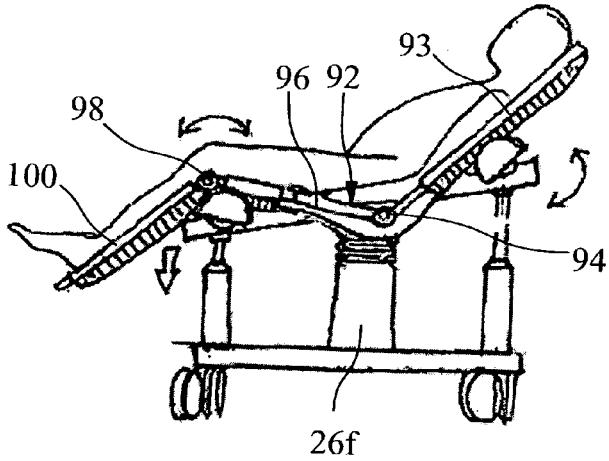

FIGS. 14A-14C & 15A-15G depict a patient transfer system with an associated patient support frame and lift cart according to fifth exemplary embodiments of the present invention. The fifth exemplary embodiments are designed specifically to assist Category 3 patients. Similar to the frame of the first exemplary embodiments (See FIGS. 1A-1F, 2A-2C, 3A-3C, 4A-4C, 5A-5C, 6A-6C, 7A-7D, 8A 8F), the frame 92 of the fifth exemplary embodiment includes a back/head-support segment 93 attached at a hip-hinge 94 to a thigh-support segment 96, which is attached by a knee hinge 98 to a shin/foot-support segment 100. The lift cart 26*f* shown FIGS. 14A-14C, 15B-15F is a lateral-access device specialized for transferring the patient bed-to-bed. This dual tines 24*f* of this lift cart 26*f* are received within a corresponding pair of hollow-spaces/receptacles 102, which are respectively formed by inflatable jacks 104 between the three segments 93, 96 & 100, and the bed. As shown in FIGS. 14A-14B, the dual tines 24*f* are preferably adjustable in height and orientation, so as to coordinate with the hinges 94 & 98 of the frame 92 to manipulate the patient between a flat position and a sitting position, for example. As also, shown in FIG. 14A, a lever 106 may be provided to assist in lifting the back/head-support segment 93 from the flat position to a sitting position when lying on the bed.

Figure 15A:
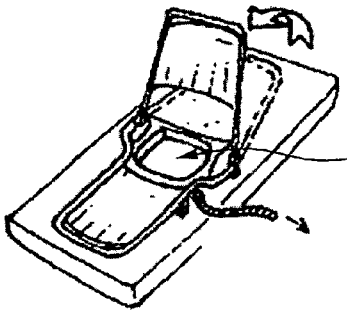
FIGS. 15A-15G further depict a patient transfer system with an associated patient support frame and lift cart according to fifth exemplary embodiments of the present invention.
Figure 15B:
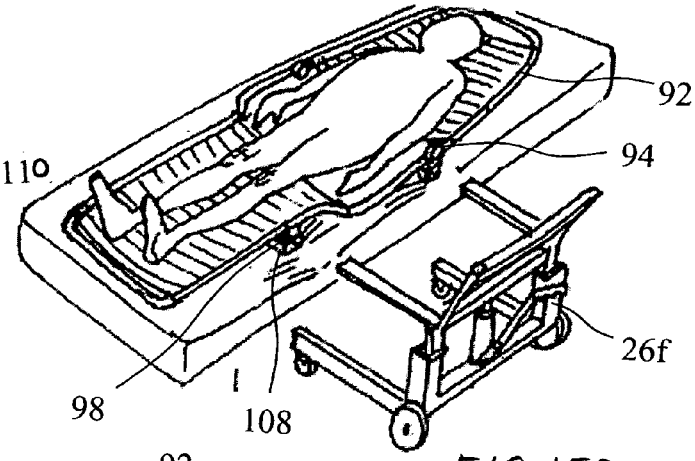
Figure 15C:
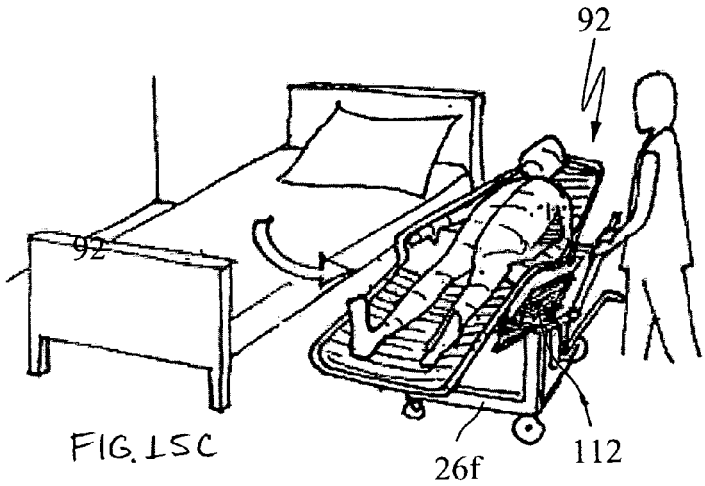
Figure 15D:
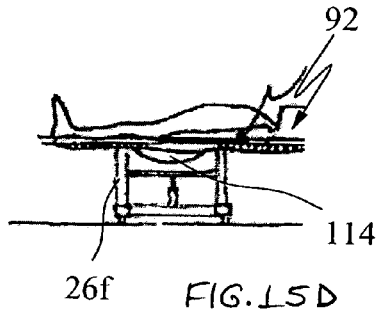
Figure 15F:
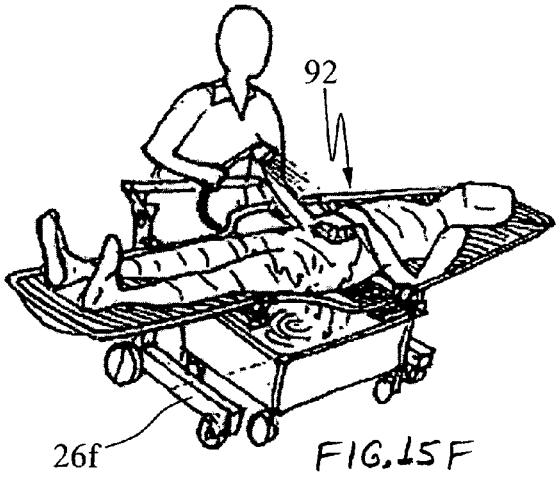
Figure 15E:
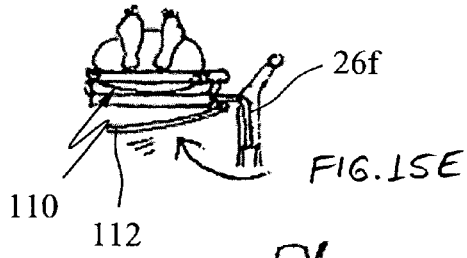
Figure 15G:
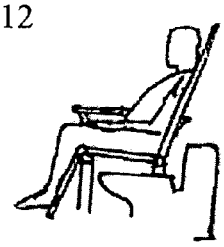
Figure 16A:
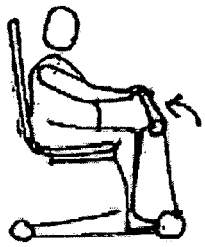
FIGS. 16A-16E illustrate various perspective views of alternate uses of the lift cart devices disclosed with respect to the present invention.
Figure 16B:
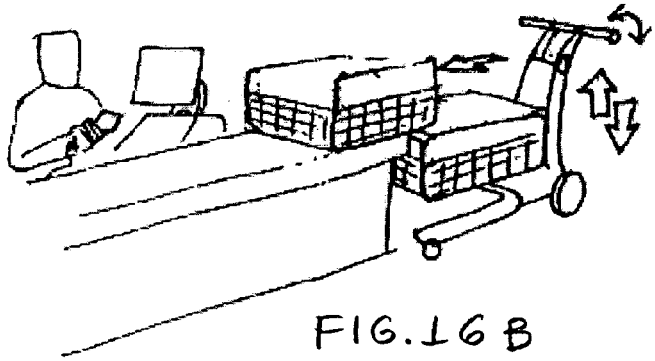
Figure 16C:
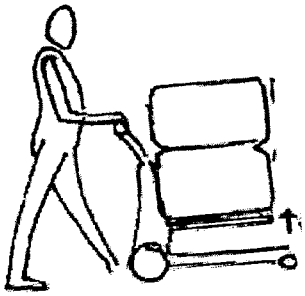
Figure 16D:
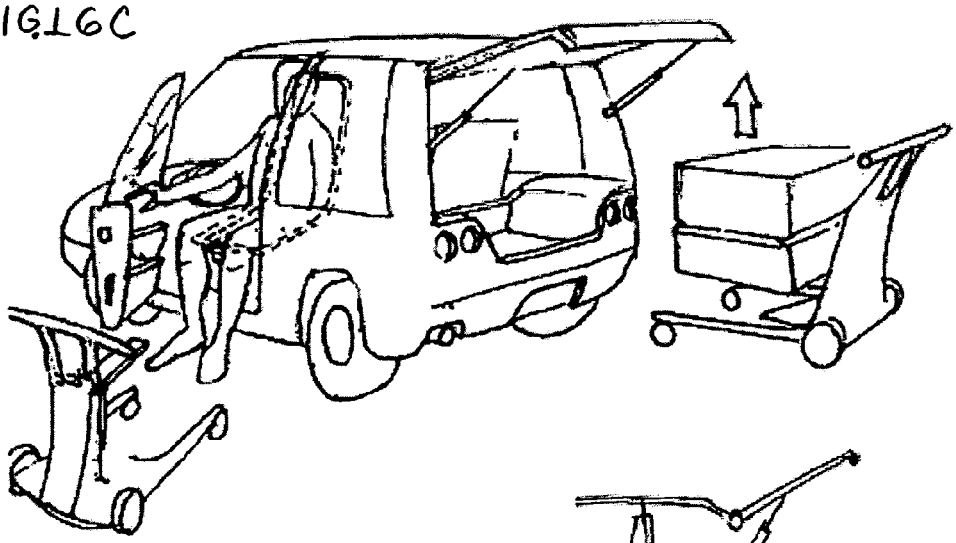
Figure 16E:
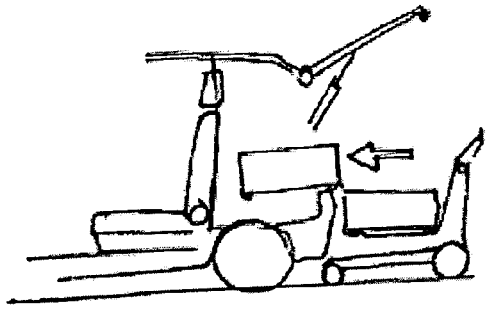

As shown in FIG. 15B, the frame itself may include laterally extending receptacles 108, respectively positioned at the hinges 94 & 98, for receiving the tines 24*f* of the lift cart 26*f*. As also shown in FIGS. 15A and 15E, the frame includes an opening 110 approximate the buttocks area to allow for human waste to pass therethrough. In association with this opening 110, the lift cart 26*f* may include an under-buttocks support panel 112 that pivots to cover the opening 110 during transport of the patient, and the system may also utilize a disposable waste receptacle 114 that may be coupled below the opening 110.

FIGS. 16A-16E illustrate how the lift cart may be useful to transport a patient, for example, to his/her automobile and then may be used to load other objects/cargo into the automobile.

Figure 17:
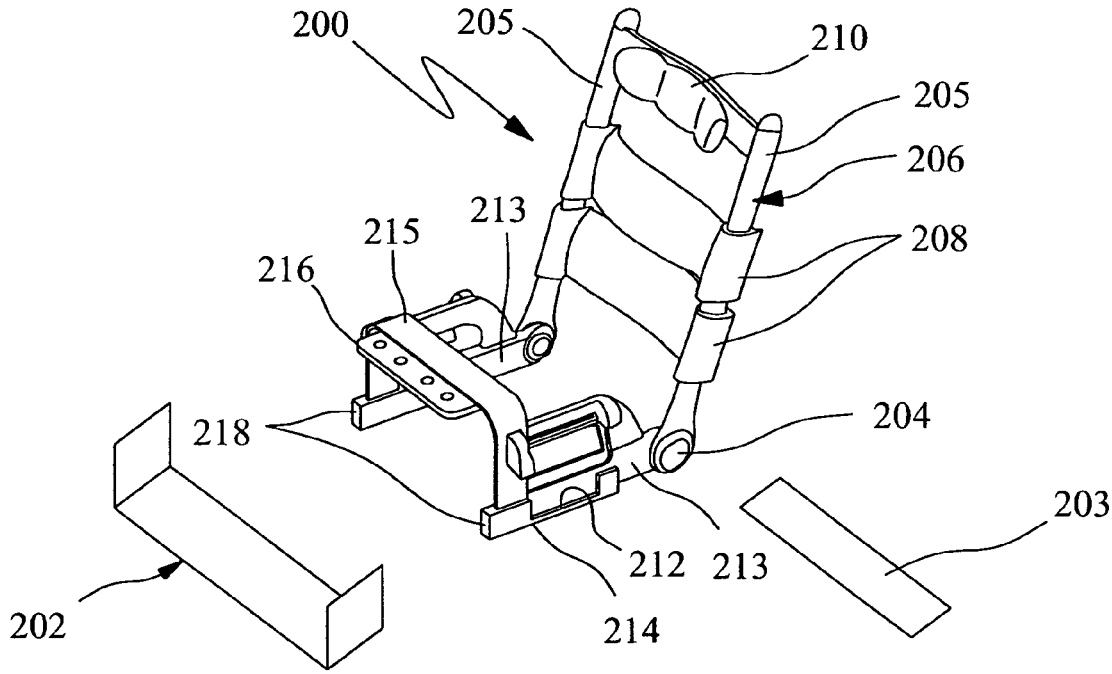
FIGS. 17-24 illustrate various perspective views and uses of sixth embodiments of the present invention; more specifically.
Figure 19:
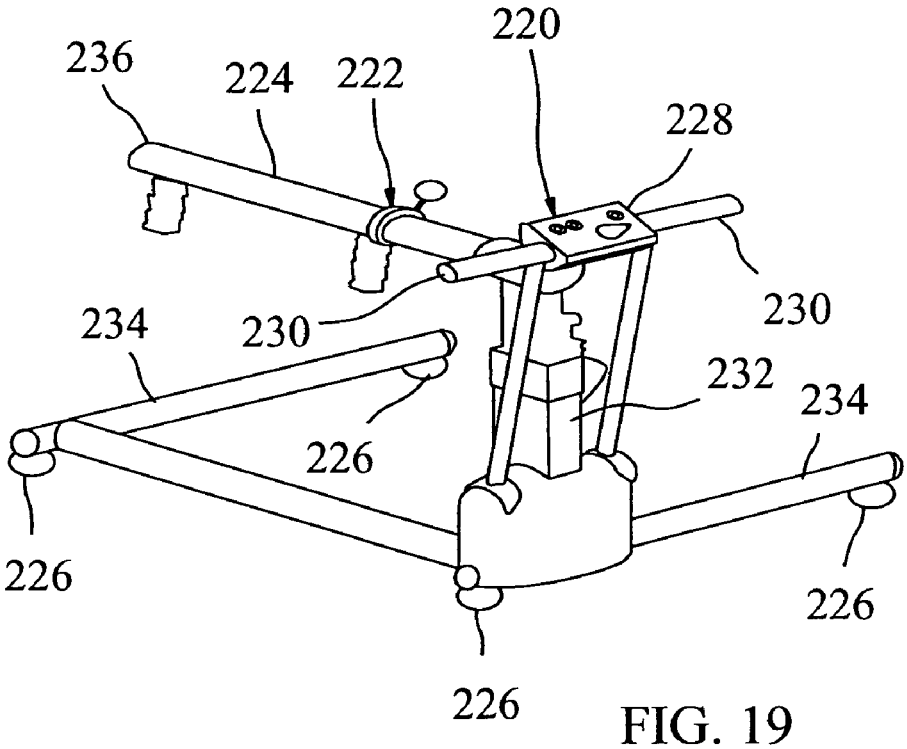
Figure 20:
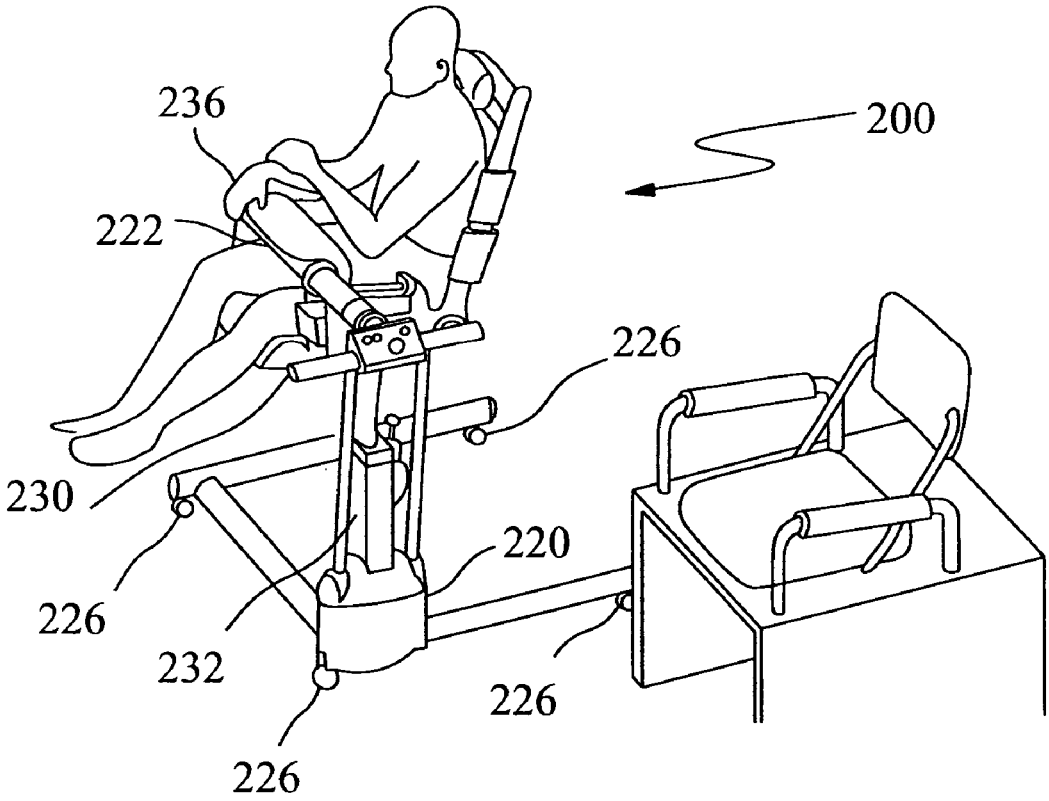
Figure 21:
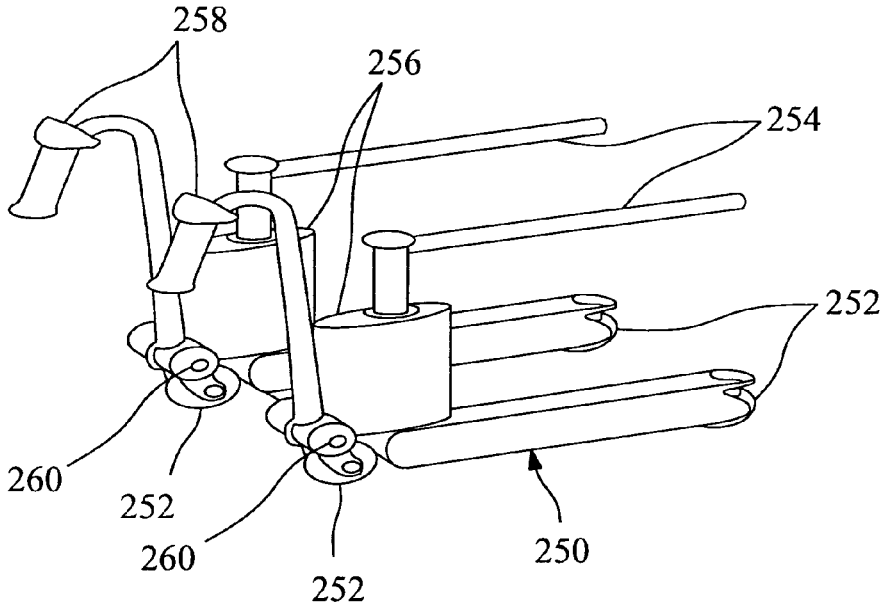

Another exemplary embodiment of the system is shown in FIGS. 17-24. FIG. 17 shows a frame assembly 200 that is comprised of an upper frame 206 and a lower frame 214 connected with an articulated joint 204. The upper frame 206 includes a pair of rigid vertical bars 205 and at least one rigid cross-bar 207 extending therebetween. The lower frame 214 includes a pair or rigid vertical bars 213 and at least one rigid cross-bar 215 extending therebetween. In this embodiment, the pair of rigid vertical bars 213 of the lower frame 214 are adapted to extend along the back and sides of a patient's thighs, while the cross-bar 215 extending therebetween is substantially u-shaped so as to be adapted to curve over the top of the patient's thighs. Lateral ends of under-thigh strap 202 are adapted to be coupled to corresponding attachment points 212 on the vertical bars 213 of the lower frame 214. The articulated joint 204 is located proximate to the patient's hip when the frame assembly 200 is in use. Back support webbing or straps 208 are mounted between the rigid vertical bars 205 of the upper frame 206 and a shoulder/neck support pad/cushion 210 is mounted on the rigid cross-bar 207 of the upper frame 206. Attachment coupling 216 in the form of a forwardly extending shelf, extending from the rigid cross-bard 215 of the lower frame 214 is designed to mate with a corresponding attachment coupling 224 on the lateral bed extractor 220 shown in FIG. 19. The lower frame 214 also includes forwardly extending receptacles 218 (extending into the vertically extending bars 213) for a different cart unit's 250 forks 254 as shown in FIG. 21. Complementary strap 203 can optionally be attached to lower frame 214 to provide additional support for a patient's buttocks.

Figure 18:
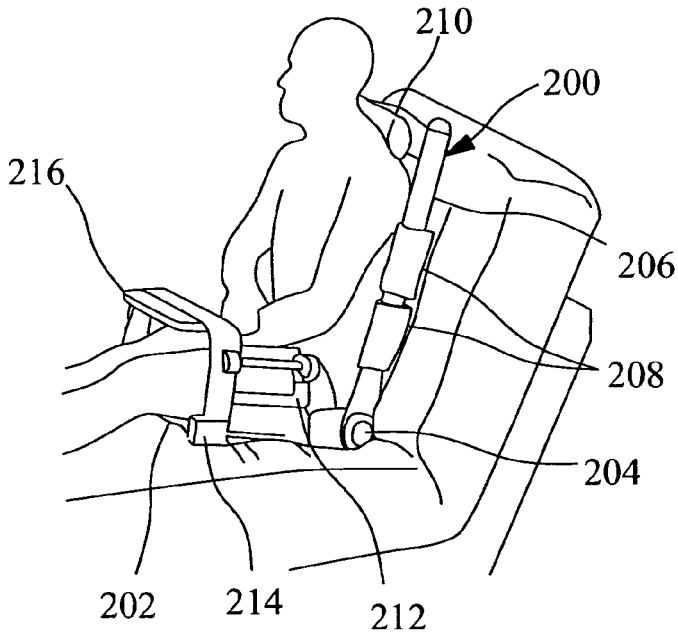

FIG. 18 shows a patient in a sitting position with the frame assembly 200 donned thereon. To don this frame assembly 200, the under-thigh strap 202 extends under the patient's thighs and is attached at the attachment points 212 on the lower frame 214. The articulated joint 204 can be articulated to set the necessary angle between the lower frame 214 and the upper frame 206 so that the patient is supported by the under-thigh strap 202, the back supports 208, and the shoulder/neck support 210.

The frame assembly 200 is used by positioning the upper frame 206 behind the patient's back and the lower frame 214 around the patient's thighs. The under-thigh strap 202 previously placed on the bed under the patient's thighs and attached to the lower frame 214 at attachment points 212.

FIG. 19 shows the lateral bed extractor 220. The lateral bed extractor 220 includes a horizontal arm 236 with an integral attachment coupling 224 and locking mechanism 222 for attaching to the chair unit 200 at attachment coupling 216 as shown in FIGS. 17 and 18. The horizontal arm 236 is supported by a powered lift unit 232, which manipulates the horizontal arm 236. The extractor 220 is operated from the control panel 228 and can be moved using the handles 230. The lift mechanism 232 is supported from the floor on wheels 226 and a base unit 234. The lift unit 232 can be operated hydraulically, pneumatically, by a motorized mechanism, manually, or by any other means capable of raising and lowering (or other manipulations of) the horizontal arm 236.

FIG. 20 shows the lateral bed extractor 220 coupled with the frame assembly 200 holding a patient. In this configuration, the patient can be raised from or lowered to a bed or chair or be moved by rolling the lateral extractor 220 on its wheels 226.

The lateral bed extractor 220 is used by moving it adjacent to a patient attached to the frame assembly 200 and coupling the integral attachment coupling 224 with the frame assembly 200 attachment coupling 216. It may be necessary to raise or lower the horizontal arm 236 using the lift unit 232 to allow the attachment couplings 224 and 216 to interact properly. The attachment couplings 224 and 216 are locked together using the locking mechanism 222 and the patient is lifted using the lift unit 232. The patient is wheeled to the desired location using handles 230. The patient is then lowered to the desired position using the lift unit 232, the locking mechanism 222 is released, the couplings 224 and 216 are decoupled, and the horizontal arm 236 is moved away from the chair unit 200. The patient may remain in the frame assembly 200 or the frame assembly 200 may be removed.

FIG. 21 shows a forward cart unit 250. The cart unit 250 is supported from the floor by wheels 252 and is moved using handles 258. Handles 258 pivot at joints 260. Forks 254 extend horizontally and are designed to couple with the forwardly extending receptacles 218 on the frame assembly 200 shown in FIG. 18. Lift units 256 raise and lower the forks 254. The lift units 256 can be operated hydraulically, pneumatically, by a motorized mechanism, manually, or by any other means capable of raising and lowering the forks 254.

Figure 22:
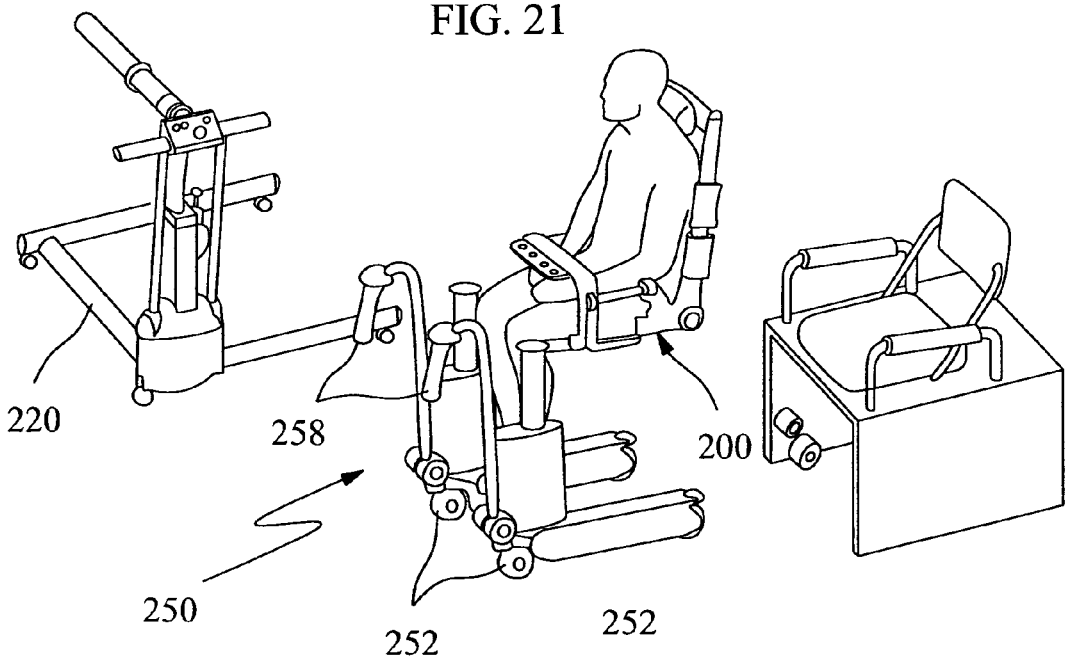

FIG. 22 shows the cart unit 250 holding a frame assembly 200 with a patient. The cart unit 250 can be moved using handles 258 and wheels 252.

Figure 23:
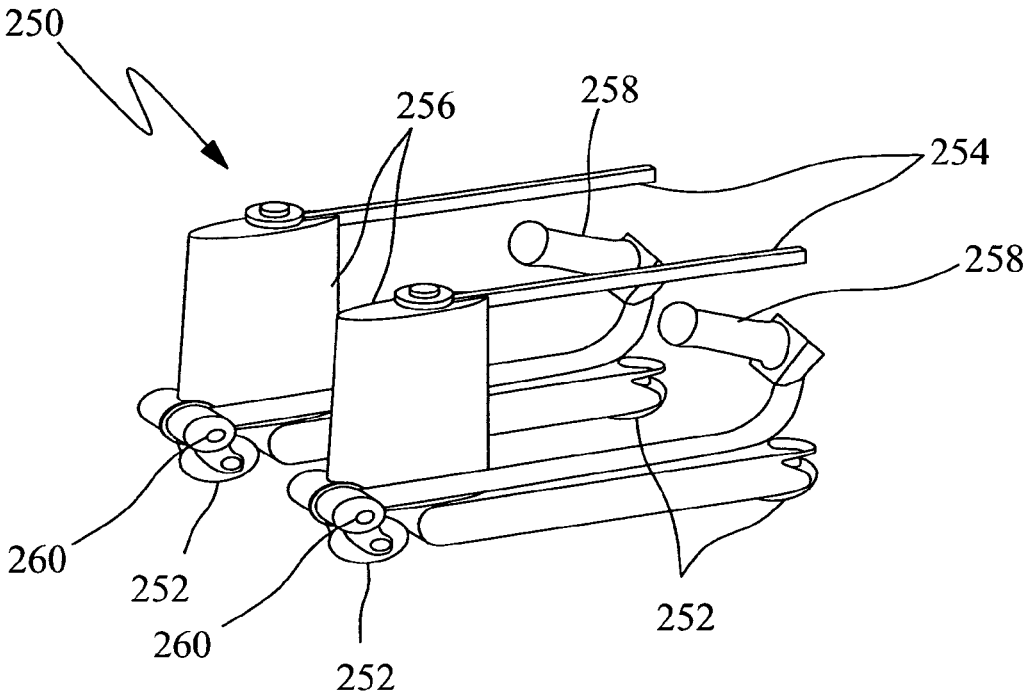

FIG. 23 shows cart unit 250 in its collapsed configuration. Handles 258 are folded down and lift units 256 are fully lowered to reduce the height of the forks 254. The chair unit can be rolled in this configuration on the wheels 252.

The cart unit 250 is used by first removing it from its storage location. The handles 258 are swung to their vertical position shown in FIG. 21. The forks 254 are raised using the lift mechanisms 256 to the height of the receptacles 218 on the frame assembly 200. The forks 254 are inserted into the receptacles 218 and the lift mechanisms 256 are used to lift the patient. The patient is then moved to the desired destination using the handles 258. The patient may remain on the cart unit 250 or may be deposited in another location by lowering the frame assembly 200 using the lift mechanisms 256 and removing the forks 254 from the receptacles 218.

Figure 24:
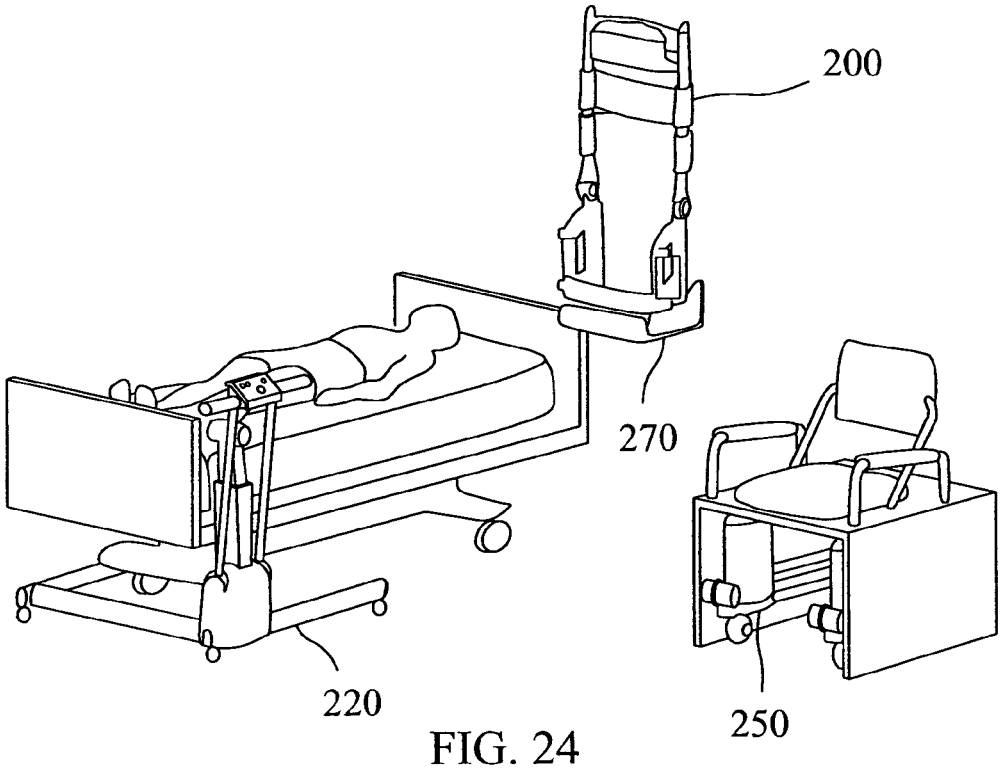

FIG. 24 shows an exemplary space-saving storage scheme. The frame assembly 200 is stored on a shelf 270 mounted to the wall, the lateral extractor 220 is stored near the foot of the patient's bed, and the cart unit 250 is stored beneath a chair.

In a further embodiment of the invention, the frame assembly 200 is used by the patient on other carts, wheelchairs, scooters, motor vehicles, etc.

Figure 25:
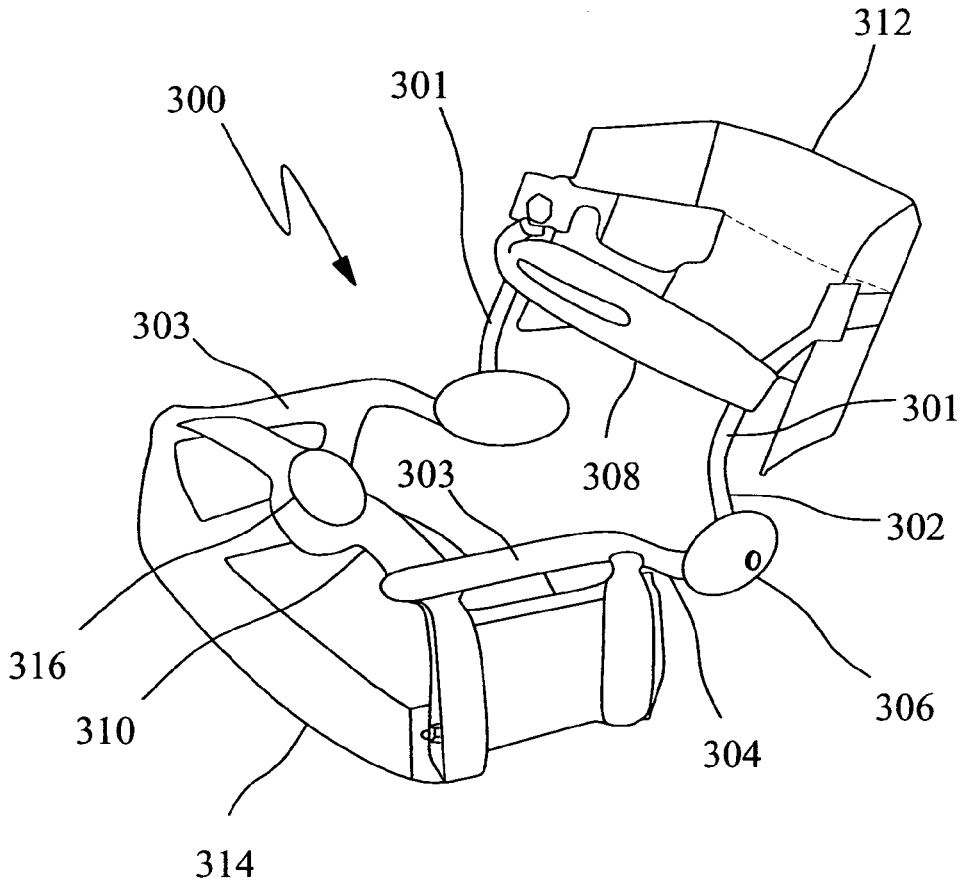
FIGS. 25-28 illustrate various perspective views and uses of seventh embodiments of the present invention; more specifically.

Another exemplary embodiment of the invention is shown in FIGS. 25-30. FIG. 25 shows frame assembly 300 which is comprised of an upper frame 302 and a lower frame 304 connected by an articulated joint 306. The upper frame 302 includes an opposed pair of vertically extending rigid bars 301 and a rigid cross-bar 308 extending therebetween, which is adapted to extend across a patient's chest. The vertically extending rigid bars 301 are curved and include an upper rearwardly facing upper end (which extends to the patient's back) to which a back strap 312 extends laterally therebetween. The lower frame 304 includes a pair of vertically extending rigid bars 303 and a rigid cross-bar 310 extending therebetween, which is adapted to extend across the patient's thighs. A pair of rigid arms extend rearwardly (to the back of the patient's thighs) from each of the vertically extending rigid bars 303, where each pair of rigid arms are coupled to a respective lateral end of a thigh strap 314. The back strap 312 and the thigh strap 314 are made of flexible materials (such as fabric). The cross-bar 310 includes an attachment coupling 316 that is of a complementary design to couple to the attachment mechanism 336 on the extensible bed extractor shown in FIG. 27.

Figure 26:
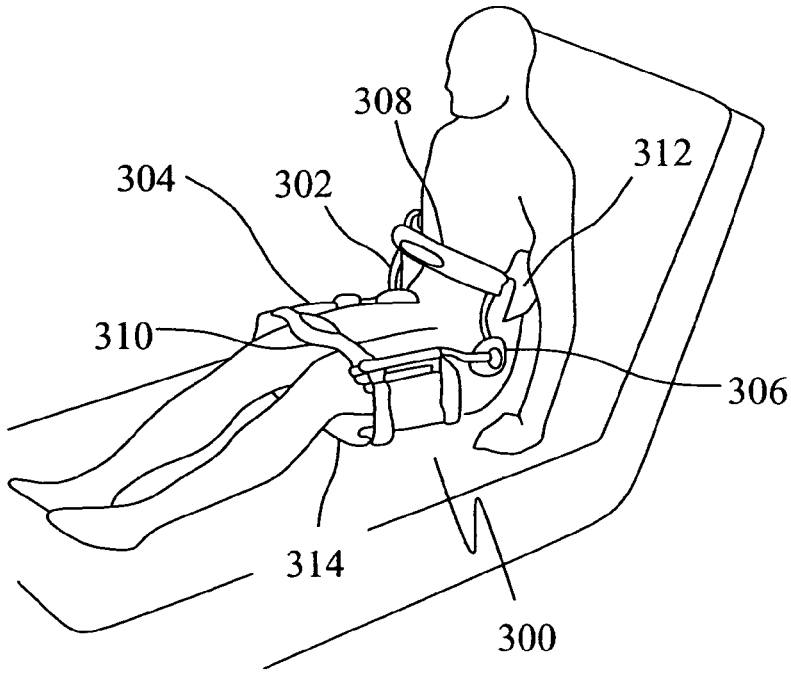

FIG. 26 shows the frame 300 donned to a patient. To don the frame 300, the back strap 312 and the thigh strap 314 are placed behind the patient's back and under the patient's legs, respectively; or are previously placed on the bed before the patient (desirably while the bed is raised to the sitting position shown in FIG. 26). The rigid components of the frame 300 are then placed on the patient as shown. The back strap 312 and thigh strap 314 are then reattached as shown. If necessary, the angle between the upper frame 302 and the lower frame 304 can be adjusted by articulating the joint 306.

Figure 27:
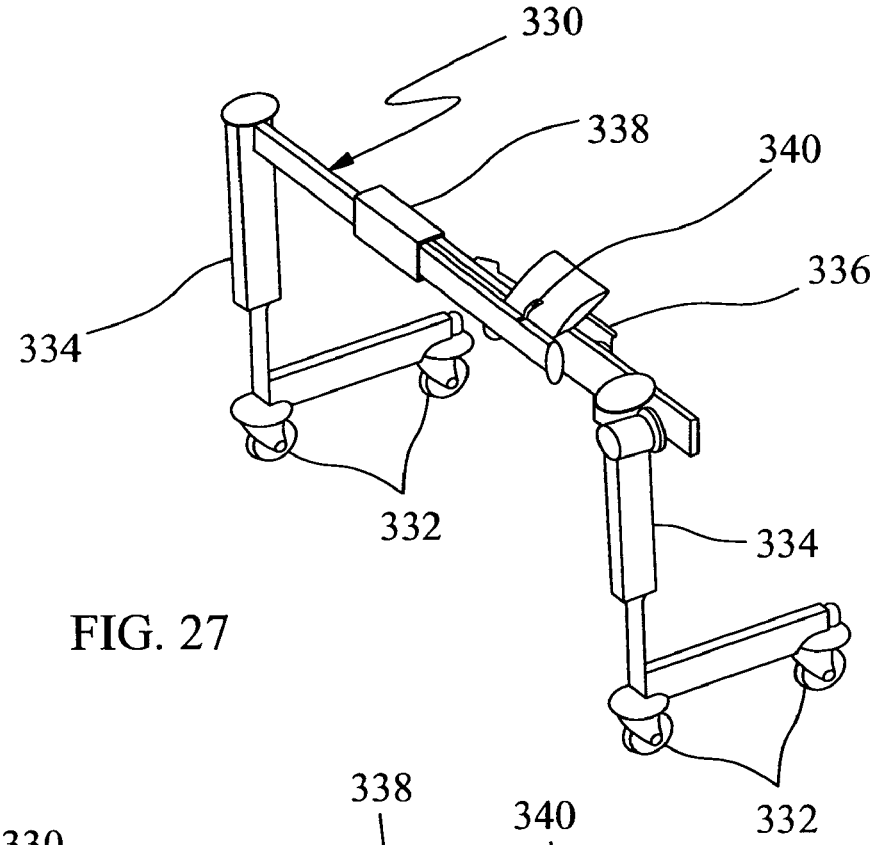

FIG. 27 shows the extensible bed extractor 330 which comprises a horizontal member 338 and two lift units 334 supported from the floor on wheels 332. The horizontal member 338 can be laterally extended and collapsed. Mounted to the horizontal member 338 is an attachment mechanism 336 with a locking mechanism 340. The attachment mechanism 336 can be moved along the horizontal member 338. The lift units 334 can be operated hydraulically, pneumatically, by a motorized mechanism, manually, or by any other means capable of raising and lowering the horizontal member 338.

Figure 28:
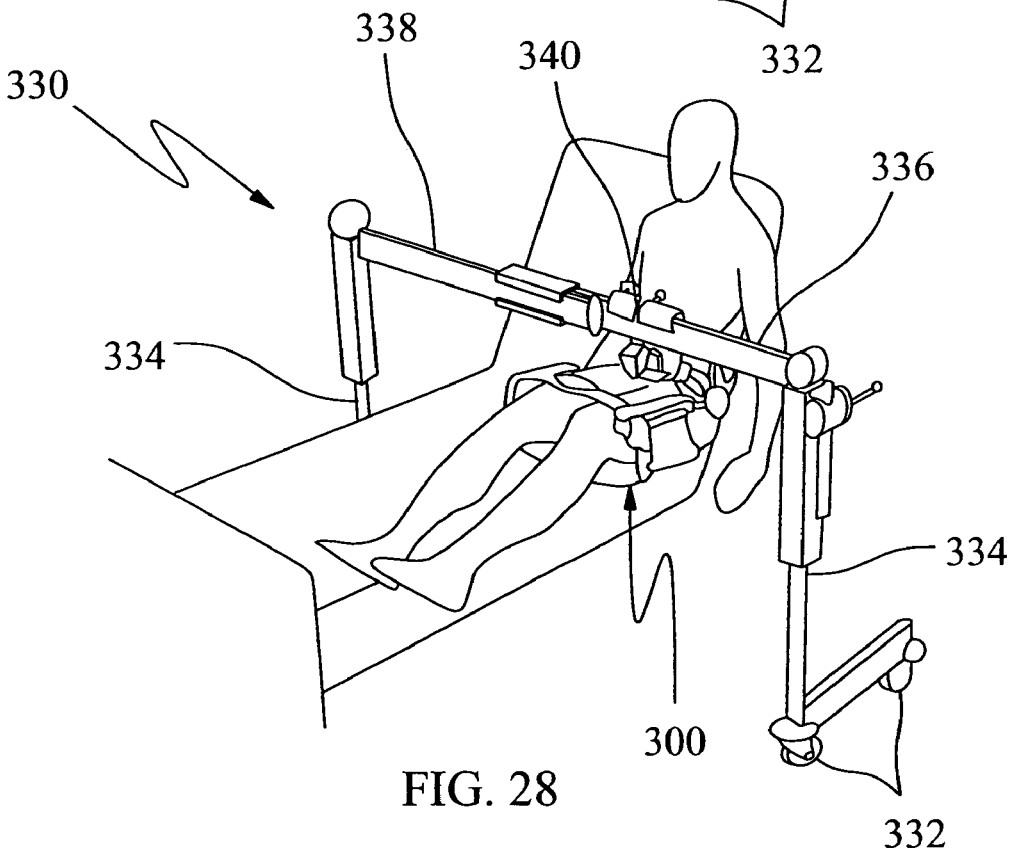

FIG. 28 shows the extensible bed extractor 330 attached to the frame assembly 300 containing a patient. To use the extensible bed extractor 330, the patient is first placed into the frame assembly 300 as described above. The extensible bed extractor 330 is maneuvered near the patient such that the attachment coupling 316 on the frame assembly 300 can be coupled with the attachment mechanism 336 of the extensible bed extractor 330. The attachment mechanism 336 is locked using the locking mechanism 340. The patient is lifted using the lift units 334. The horizontal member 338 is extended and the patient is moved horizontally by sliding the attachment mechanism 336 along the horizontal member 338. The patient is moved to a position above the desired destination (e.g., a chair, wheelchair, scooter, commode, etc.). The patient is then lowered using the lift units 334, the locking mechanism 340 is released, and the attachment coupling 316 is removed from the attachment mechanism 336. The extensible bed extractor 330 can then be moved away and the horizontal member 336 collapsed if desired.

Figure 29:
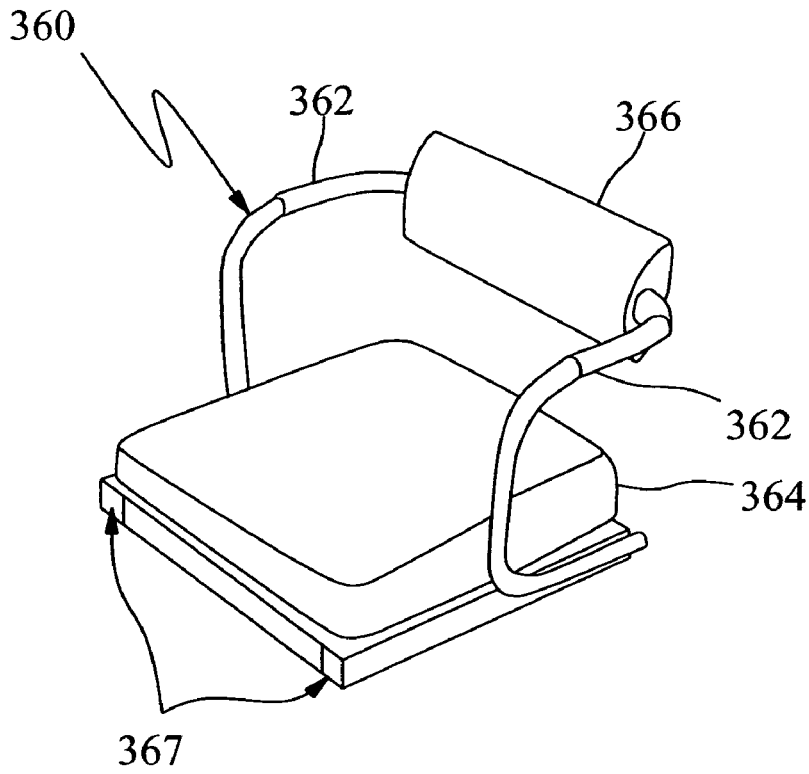
FIGS. 29 and 30 illustrate an optional pallet/seat for use in addition to various embodiments of the present invention disclosed in the present application; more specifically.

FIG. 29 shows a pallet 360 which is essentially in the form of a leg-less chair that includes a back support 366, arms 362, a seat 364, and receptacles 367 designed to mate with the forks 254 of the cart unit 250 (FIG. 23).

Figure 33:
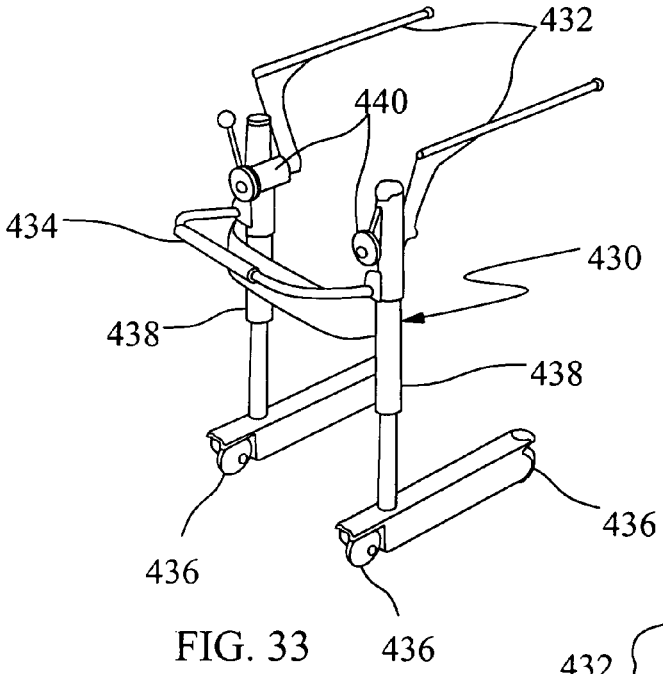

The pallet 360 is used to transport a patient with a cart unit 250 or rotating fork cart 430 (FIG. 33). The patient is placed on or removed from the pallet 360 using a frame assembly 200 or a frame assembly 300 with a lateral bed extractor 220 or extensible bed extractor 330, respectively. In a further embodiment of the invention, pallet 360 is used by the patient on other carts, wheelchairs, scooters, motor vehicles, etc.

Figure 30:
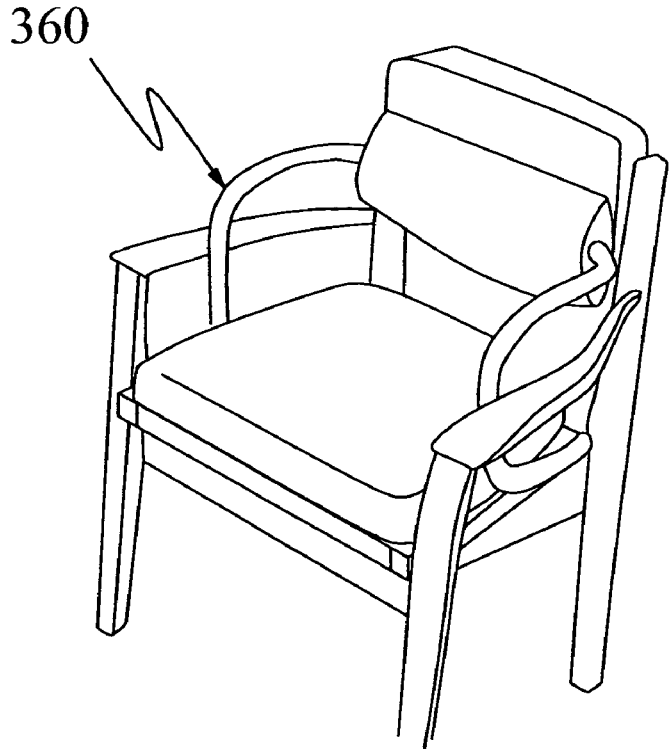

FIG. 30 shows a pallet 360 placed on a chair ready to receive a patient.

Figure 31:
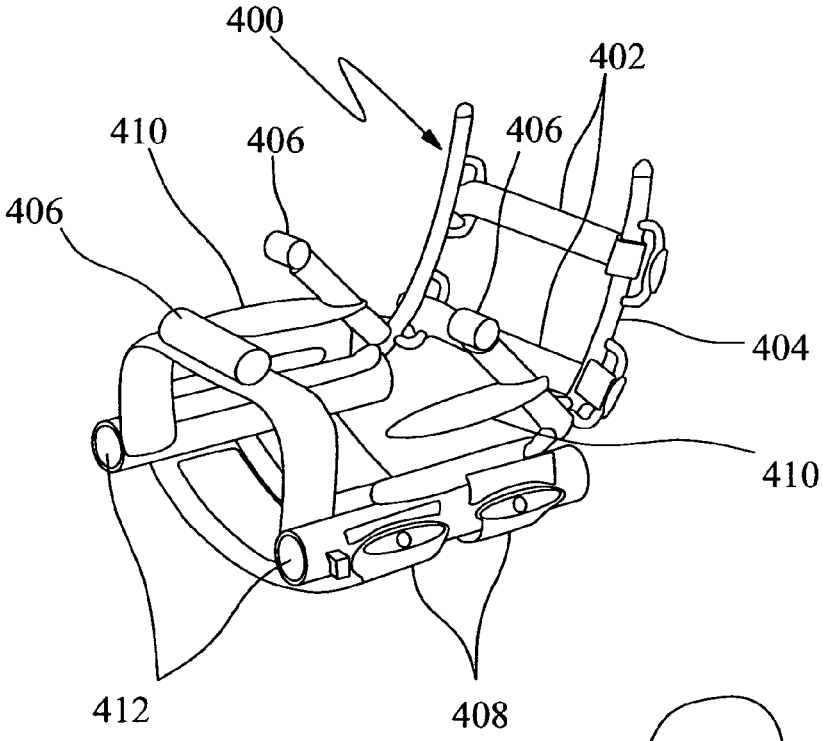
FIGS. 31-37 illustrate various perspective views and uses of an eighth embodiment of the present invention; more specifically.

Another exemplary embodiment of the system is shown in FIGS. 31-37. FIG. 31 shows a frame assembly 400 that includes a rigid frame 404 that comprises a pair of opposed curved vertical bars, where the upper portions of the bars extend vertically along a patient's back and the lower portions of the bars extend vertically along a patient's thighs. Back support webbing or straps 402 extend laterally across the upper portions of the opposed curved vertical bars, removable thigh webbing or straps 408 extend laterally across the lower portions of the opposed curved vertical bars. Arm rests 410 extend forwardly from each of the opposed curved vertical bars. Lateral receptacles 406 for the forks 432 of the rotating fork cart 430 are provided in the structural supports for the arm rests 410, and another lateral receptacle 406 is provided in a u-shaped lateral bar extending between the lower portions of the opposed curved vertical bars (and over the patient's thighs). Front receptacles 412 also designed to receive the forks 432 of the rotating fork cart 430 are provided in the lower ends of the opposed curved vertical bars.

Figure 32:
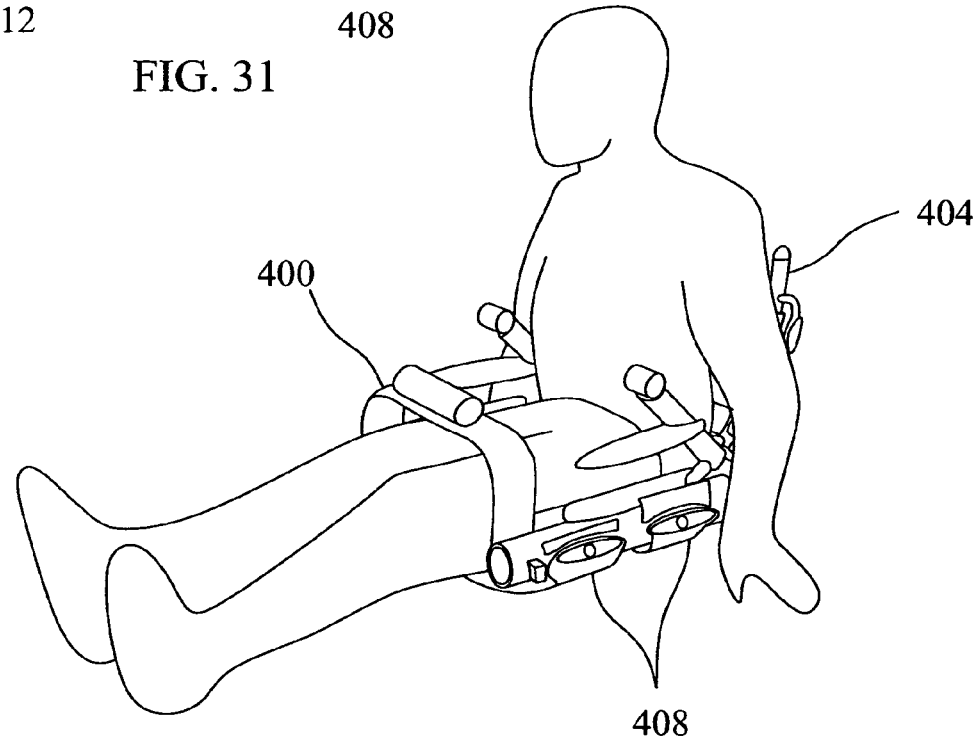

FIG. 32 shows the frame assembly 400 in place on a patient. The thigh straps 408 are attached to the frame 404 under the patient's thighs such that they will support the patient when the seat unit 400 is lifted. The frame assembly 400 is used by detaching the thigh straps 408 and placing it around the patient as shown. The thigh straps 408 are then placed under the patient's thighs and attached to the frame 404.

FIG. 33 shows a rotating fork cart 430 which includes forks 432 which can rotate when the locking mechanisms 440 are released. The forks 432 can be raised and lowered using the lift mechanisms 438 which are supported from the floor by wheels 436. The lift mechanisms 438 can be operated hydraulically, pneumatically, by a motorized mechanism, manually, or by any other means capable of raising and lowering the forks 432. The rotating fork cart 430 is moved using the handle 434. In this figure, the forks 432 are in their upper position which is used when a patient is to be moved to or from a bed using a frame assembly 400.

Figure 34:
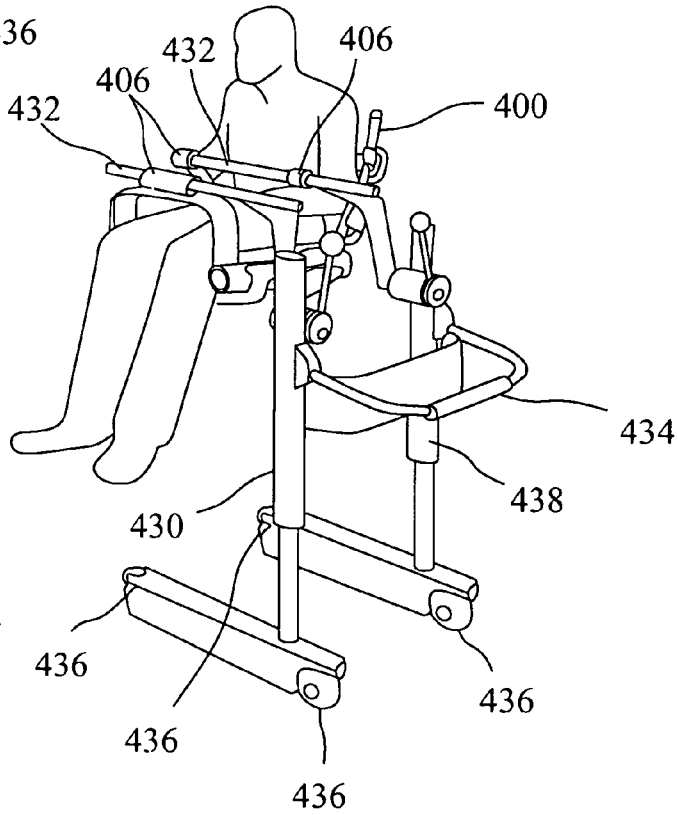

FIG. 34 shows a rotating fork cart 430 holding a patient who is fastened within a frame assembly 400. The forks 432 of the rotating fork cart 430 are mated with the lateral receptacles 406 of the frame assembly 400. The patient can be transported by using the handle 434 to push the rotating fork cart 430 on its wheels 436.

The rotating fork cart 430 is used by first placing the patient in a frame assembly 400 as discussed above. The rotating fork cart's 430 forks 432 are rotated to the upper position. The forks 432 are coupled with the lateral receptacles 406 on the frame assembly 400. The patient is lifted off the bed using the lift mechanisms 438. The rotating fork cart 430 is then moved away from the bed and the patient is placed above the chair, wheelchair, commode, etc. onto which the he or she is to be deposited. The patient is lowered using the lift mechanisms 438.

Figure 35:
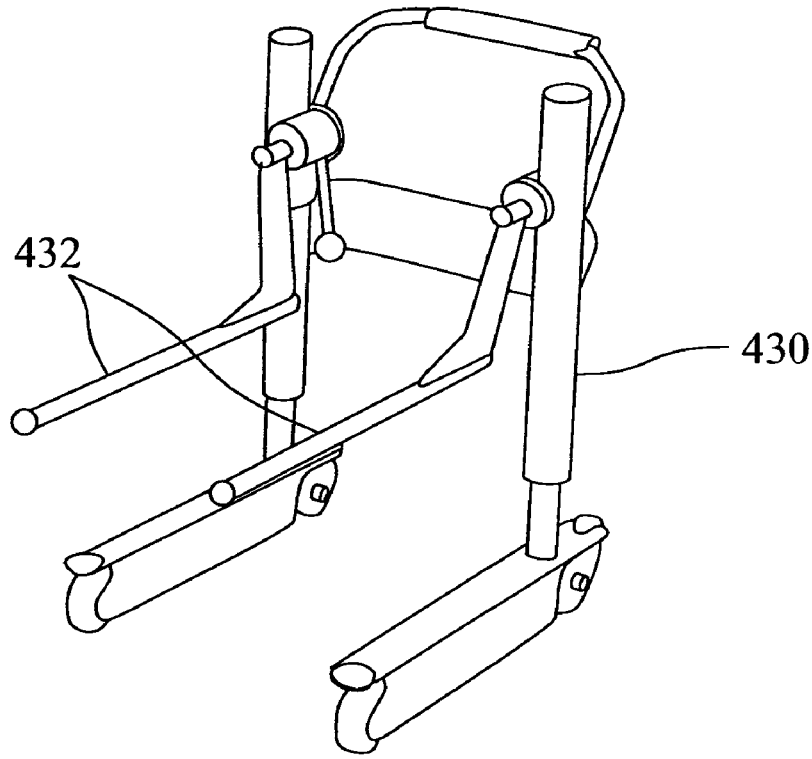

Once the patient is supported by a chair or other support device, the forks 432 are removed from the receptacles 406. The forks 432 can then be moved to their lower position as shown in FIG. 35. This configuration is used when the rotating fork cart 430 is to be stored and when a patient is to be transported using the front receptacles 412 on a frame assembly 400.

Figure 36:
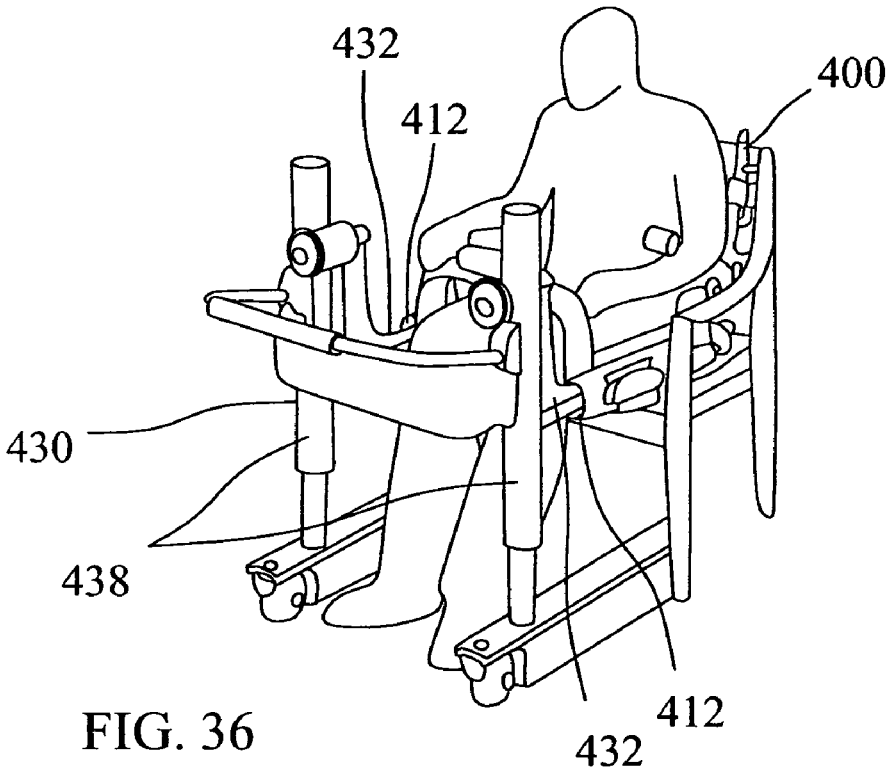

As shown in FIG. 36, the forks 432 are inserted into the front receptacles 412 of the frame assembly 400. The patient is lifted using the lift mechanisms 438 and the rotating fork cart 430 and the patient can be moved as necessary. If needed, an additional strap may be attached under the patient's buttocks to disperse his or her body weight.

Figure 37:
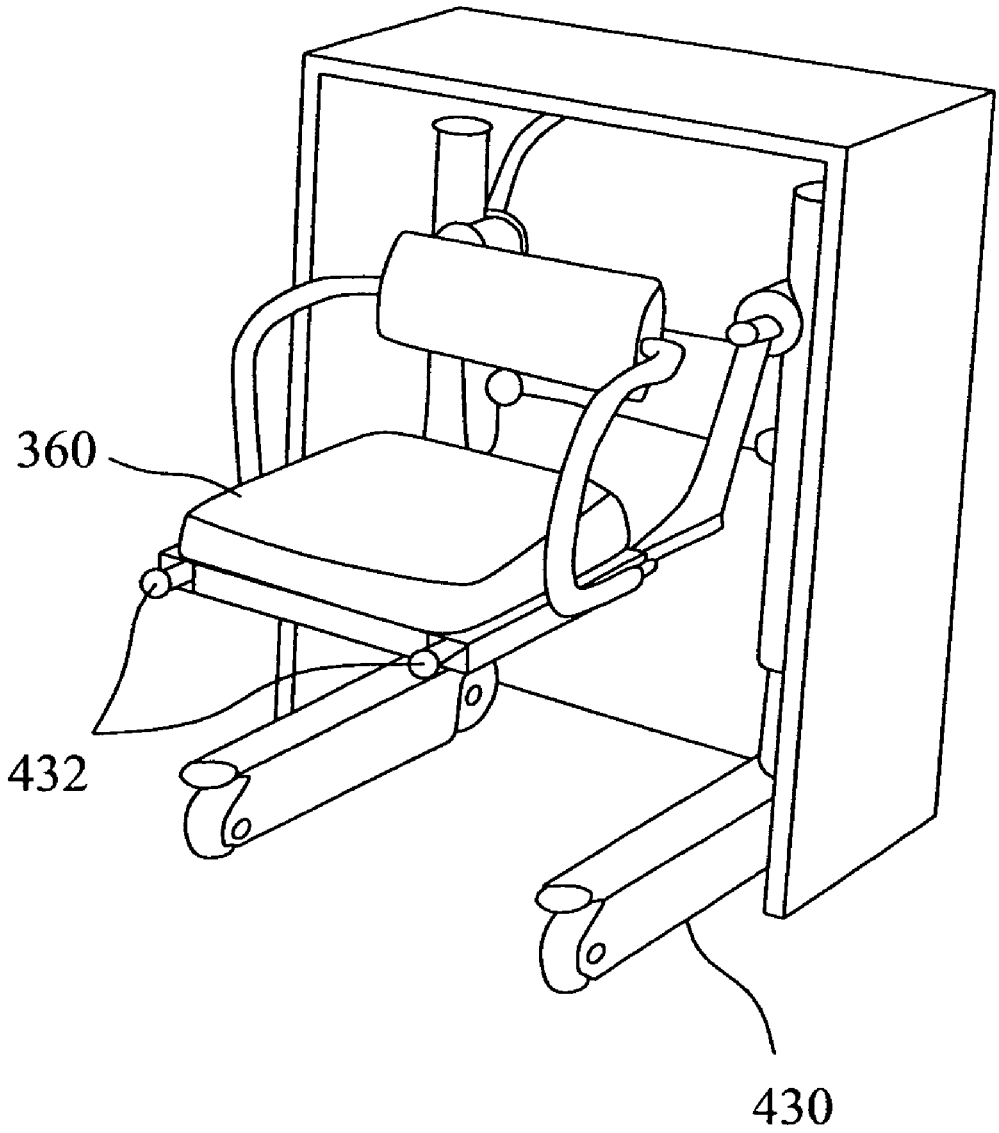

FIG. 37 shows a rotating fork cart 430 with its forks 432 mated with a pallet 360. This configuration can be used for storage and for transporting patients. Additionally, this configuration allows the rotating fork cart 430 and pallet 360 to be used as room furniture when they are not needed for moving a patient.

A further embodiment of the present invention is the use of a frame assembly 200, pallet 360, or similar device as a "persistent interface." The persistent interface device is used to assist in moving the patient from his or her bed and as a removable seat or equivalent for motorized scooters, wheelchairs, or other devices. For example, a patient is placed in the frame device while in bed. Using the frame device with an extractor, the patient is removed from the bed and placed on a motorized scooter. The frame device also serves as the seat for the scooter. If the patient requires transport in a wheelchair, the frame device serves as the seat for the wheelchair.

The use of a persistent interface device is advantageous for both patients and personnel assisting patients because once a patient is seated in the frame device, he or she does not have to move from seat-to-seat to move from a bed or a chair to a wheelchair or scooter. This results in less stress on patients and health care staff as well as a reduced risk of injury.

FIGS. 39A-39I depict yet another set of exemplary embodiments according to the present invention. In these embodiments, another type of pallet support 450 is provided, which includes a padded seat portion 452 and a padded backrest portion 454 extending upwardly from the seat portion 452. The seat portion includes a rigid base comprised of a pair of rectangular, stacked plates 456, 458 separated by four corner blocks 460 (positioned between the corners of the plates). The spaces between the corner blocks provide four identical receptacles 462, respectively facing forward, backward and to each side.

Figure 39A:
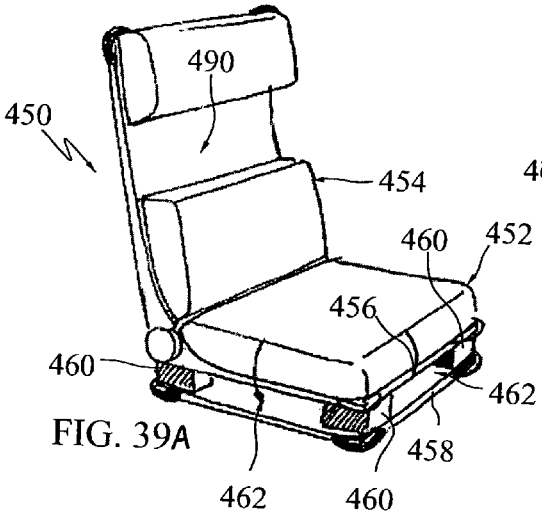
Figure 39B:
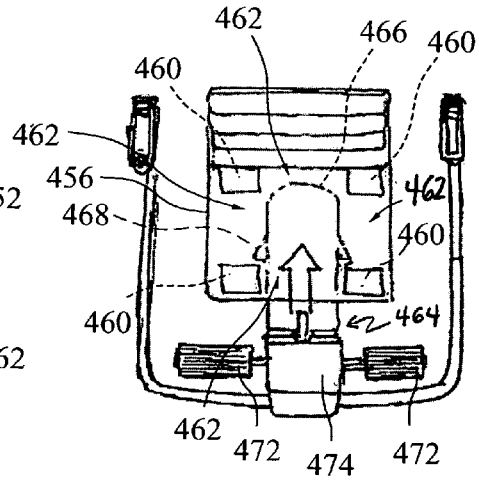
Figure 39C:
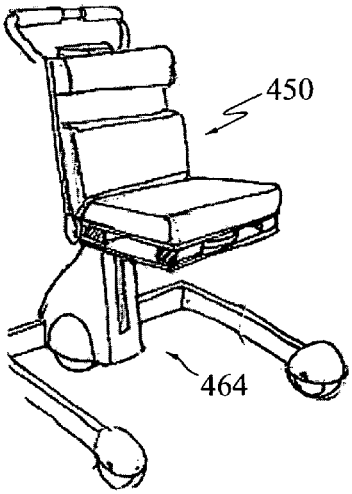
Figure 39D:
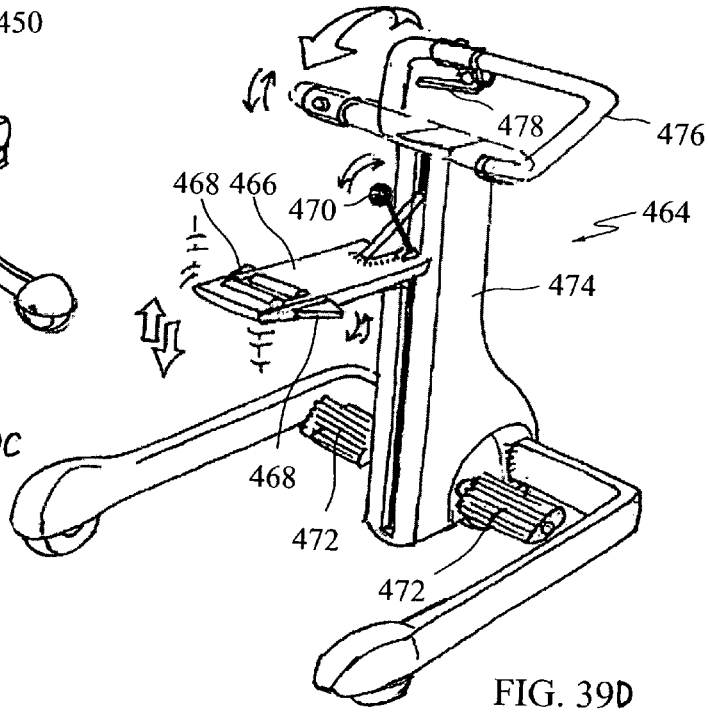

Referring to FIGS. 39B & 39D, the lift cart 464 includes a fork 466 for selectively coupling to one of the receptacles 462. The fork 466 includes a pair of recessable tangs 468 that have a tapered leading edge. The tangs 468 are biased out of the their corresponding recesses and provide the fork 466 with a width that is larger than the width of the receptacle. The tangs 468 are adapted to recess within the recesses as the fork 466 is inserted into the receptacle 462 and the leading edges of the tangs contact the corner blocks 460. Upon passing the corner blocks 460 the tangs 468, which are no longer in contact with the corner blocks, eject out again and provide a safety lock to lock the fork 466 within the receptacle. A lever 470 is mechanically linked to the tangs 468 such that actuation of the lever 470 recesses the tangs again and allows the fork 466 to be removed again from the receptacle 462.

The lift cart 464 may also double as a patient mobility device (or scooter). Referring to FIG. 39D, the lift cart 464 includes a powered drive wheel and breaks (optionally actuated by pedals 472). The lift column 474 includes a handle bar set 476 mounted thereon, which includes a throttle 478 (or some other control device). The handle bar set 476 in FIG. 39D faces outwardly from the position of the fork so that it is oriented for controlling by a nurse or some other assistant. However, the handle bar set 476 in these embodiments is capable of being rotated 180° so that it faces the patient. Thus, if the pallet support 450, having a patient seated thereon, is coupled to the fork 466 such that the pallet support 450 and patient faces the handle bar set 476, the patient may use the pedals 472, handle bar set 476 and/or throttle 478 to individually drive, steer and/or break the motion of the lift cart so that it now operates substantially as a powered patient mobility device.

Referring to FIGS. 39E-39I, a vertical support platform 480 may also be coupled to the lift column 474. The vertical support platform 480 includes two pair of hooks 482 and 484 for respectively hanging a back support strap 486 and a thigh support strap 488 thereto. As shown specifically in FIG. 39H, the vertical support platform 480 and associated straps 486/488 coupled to the lift cart 464 allows a patient to be supported below the platform 480 by the straps 486/488 and thus be transported by the lift cart 464. The vertical support platform 480 may be coupled to the vertical support column 474 by a manipulatable interface coupling 481 and associated control lever 483, which may used to vertically manipulate the vertical support platform up and down the platform as well as pivot the platform (as shown in FIG. 39I).

Referring to FIGS. 39A and 39I, the pallet support 450 includes a lateral recess 490 extending across the padded back-rest portion 454, which can be used to easily and comfortably recess the back support strap 486 therein. As shown primarily in FIG. 39I, this recess 490 allows the back support strap 486 to be easily positioned beneath the patient's back while seated within the pallet support 450 or to be easily removed from behind the patient's back while seated within the pallet support 450; thus, allowing convenient and safe transfer between the pallet support 450 and the vertical support platform and associated straps 486/488. It will be appreciated by those of ordinary skill that the straps 486/44 may be initially coupled to a bed frame, similar to the back-rest pad component 38 as shown in FIGS. 38C-38E, rather than the pallet support 450.

When not in use transporting a patient, the lift cart 464 can occupy the patient's room as a chair as shown in FIG. 39C with the pallet support 450 coupled to the fork 466, or as a table as shown in FIG. 39E with the vertical support platform 480 coupled to the fork 466.

Figure 40A:
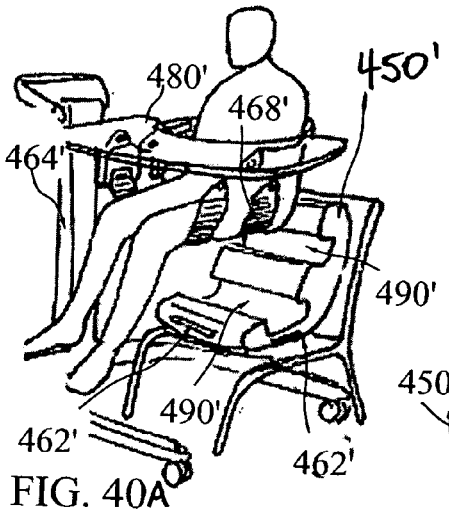
FIGS. 40A-40P illustrate various perspective and elevational views and uses of the ninth embodiment (and alternate designs thereof) of the present invention.
Figure 40B:
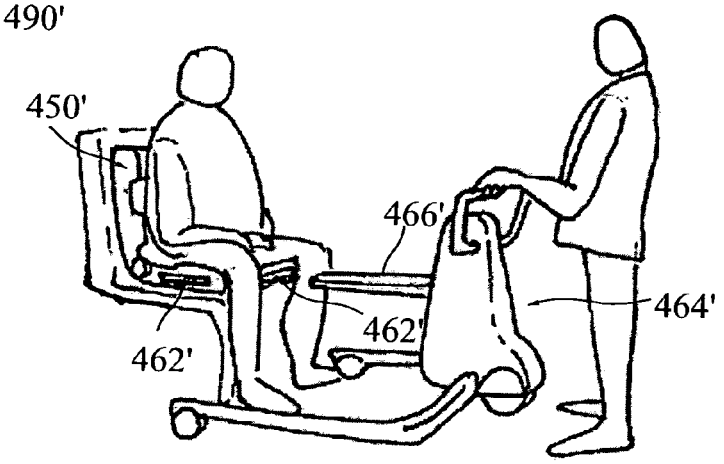
Figure 40C:
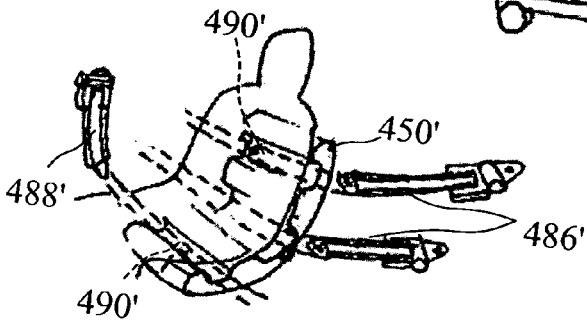
Figure 40D:
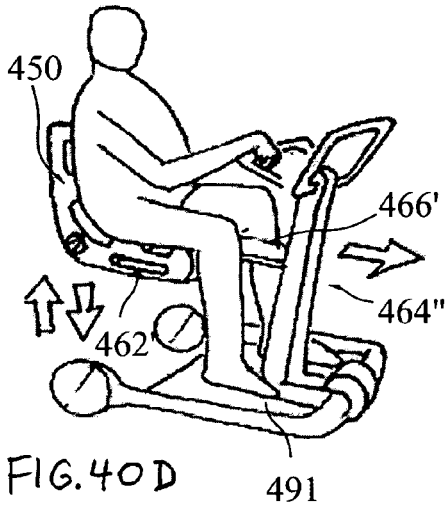
Figure 40E:
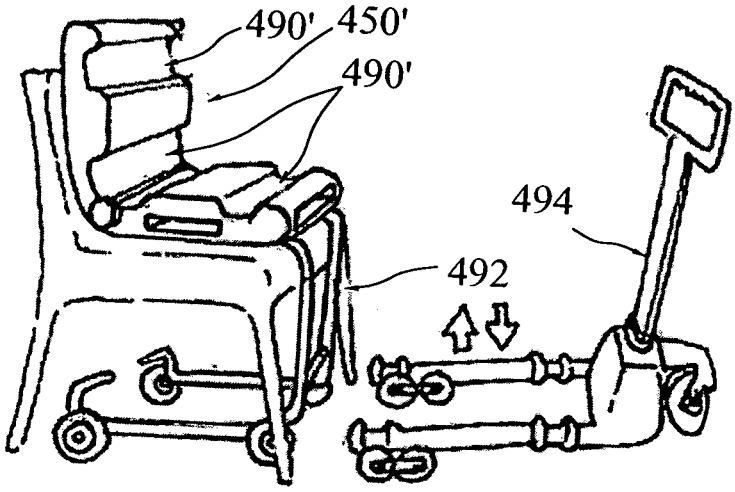
Figure 40F:
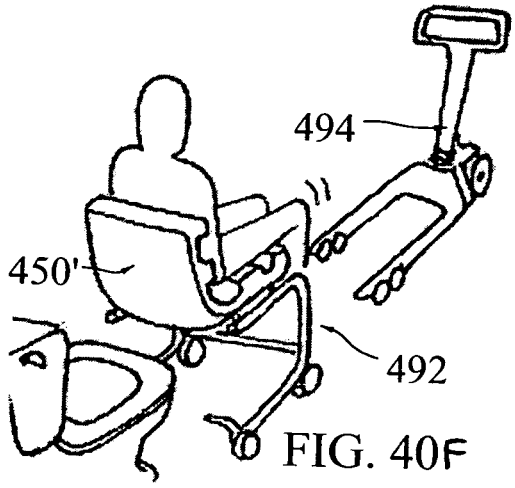
Figure 40G:
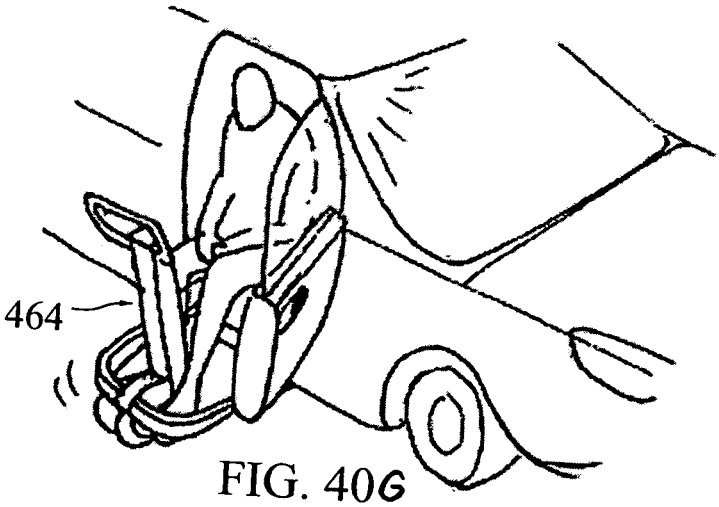
Figure 40H:
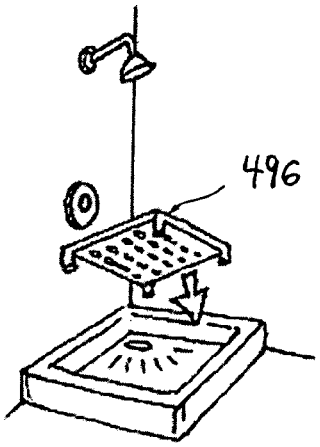
Figure 40I:
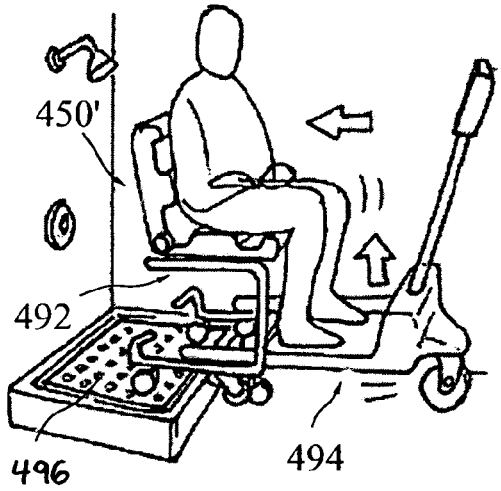
Figure 40J:
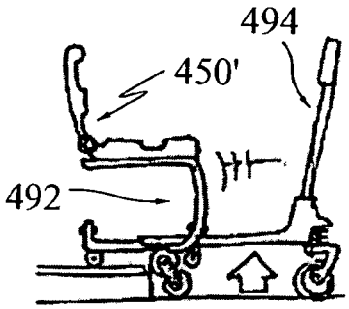
Figure 40K:
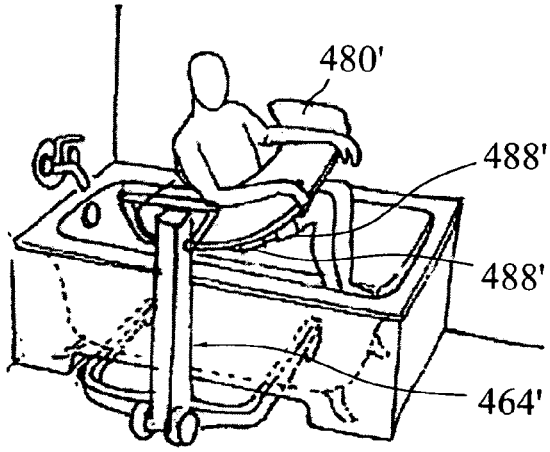
Figure 40L:
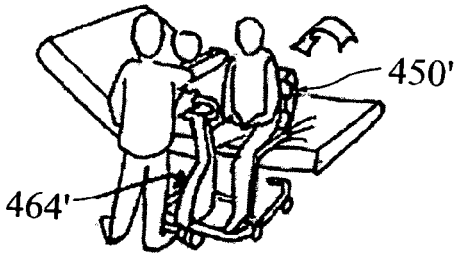
Figure 40M:
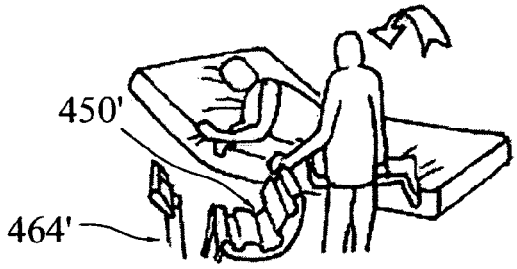
Figure 40N:
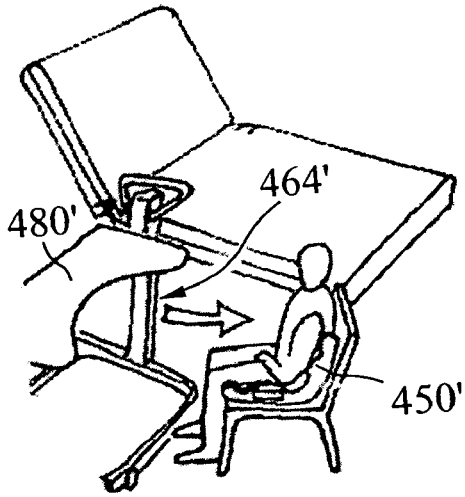
Figure 40O:
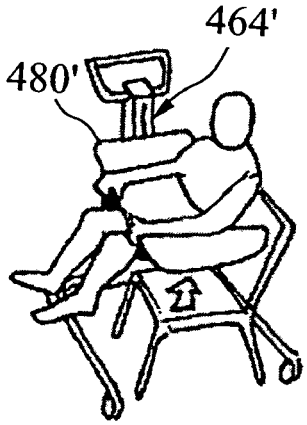
Figure 40P:
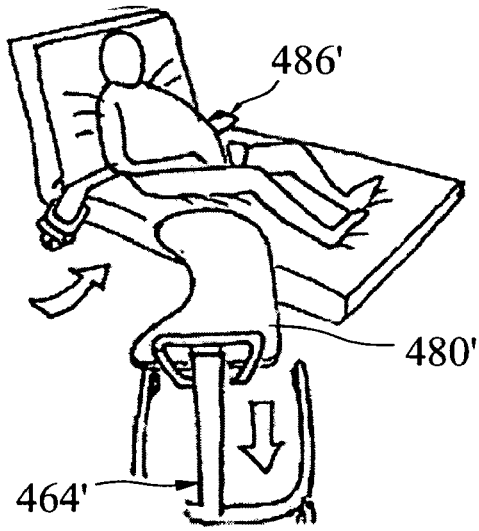

FIGS. 40A-40P depict a very similar embodiment of the pallet support 450' and associated components as described above in FIGS. 39A-39I. The pallet support 450' in this alternate embodiment includes additional recesses 490' in the seat portion and/or back portion of the pallet support 450' for corresponding straps 468'/488'. FIGS. 40A-40P depict various uses and activities facilitated by the embodiments of FIGS. 39A-39I and 40A-40P. FIG. 40D depicts another alternate cart 464" that includes a floor portion 491 allowing the patient to rest his or her feet when the cart is used as a scooter. This scooter is also shaped and configured to make room for the patient's legs and feet when used as a scooter. FIGS. 40E, 40F, 40I & 40J also show an optional set of wheeled legs 492 that may be mounted below the pallet support 450'. The cart 494 in this embodiment does not include a lift device because the wheeled legs 492 already elevate the pallet support 450'. Additional accessories, such as a shower platform 496 may also be utilized to facilitate associated activities.

Above, most of the embodiments indicated that the frames or pallets included receptacles or hollow spaces (female couplings) for receiving and being coupled to tines, forks, bars (male couplings) extending from the lift or mobility devices. As will be appreciated by those of ordinary skill in the art, it is certainly within the scope of the invention that the frames or pallets include male couplings and that the lift or mobility devices include female couplings. For example, referring now to FIGS. 41A-41F, it can be seen that the frame or pallet 500 includes a male arm 502 extending therefrom, which is received within and coupled to a female coupling 504 associated with a lift or mobility device. In the present embodiments, the female coupling includes a c-shaped receiver 506 having a lower, horizontally extending support beam 508 and an upper, horizontally extending clamping beam 510. The lower support beam 508 includes a textured upper surface 512 for mating with a correspondingly textured lower surface 514 of the leading end of the male arm 502. Additionally, the outward end of the lower support beam 508 includes a rib 509 extending laterally thereacross, adapted to be received within a pivot-channel 516 formed by a complementary pair of ribs 518 extending downwardly from the leading end of the male arm 502. To clamp the leading end of the male arm 502 within the c-shaped receiver 506, the pivot-channel 516 is first registered on the rib 509 of the support beam 508 and a piston 520 reciprocatably supported in the clamping beam 510 is actuated to press onto the upper surface of the leading end of the male arm 502 and push the leading end downward (pivoting on the rib 509) such that the corresponding textured surfaces 512/514 engage with other to form a secure coupling. In this embodiment, a lever is 522 is used to actuate the piston 520.

Figure 41A:
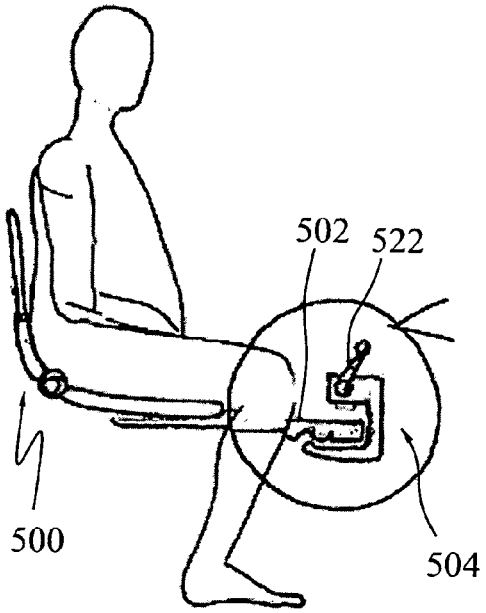
FIGS. 41A-41F illustrate another exemplary coupling between a frame/pallet device and a lift/mobility device according to the present invention.
Figure 41B:
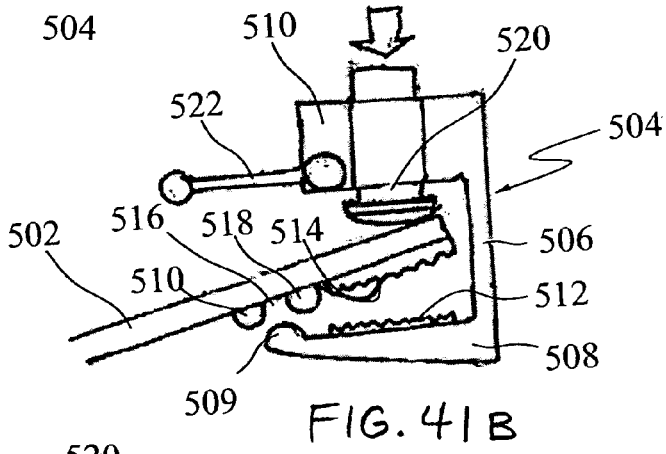
Figure 41C:
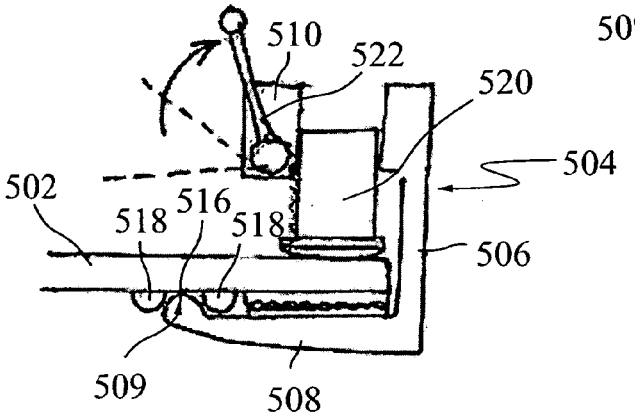
Figure 41D:
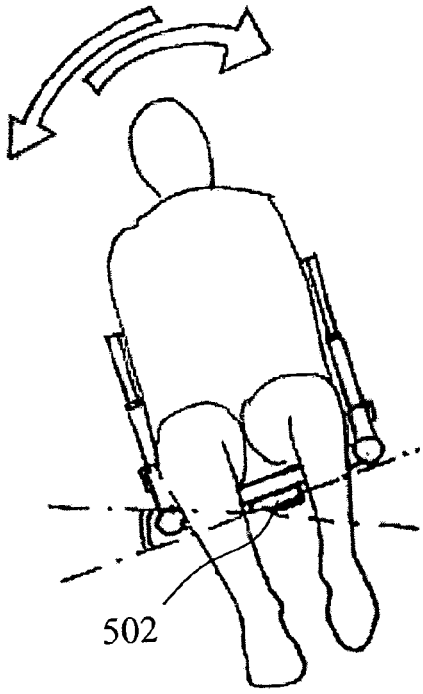
Figure 41E:
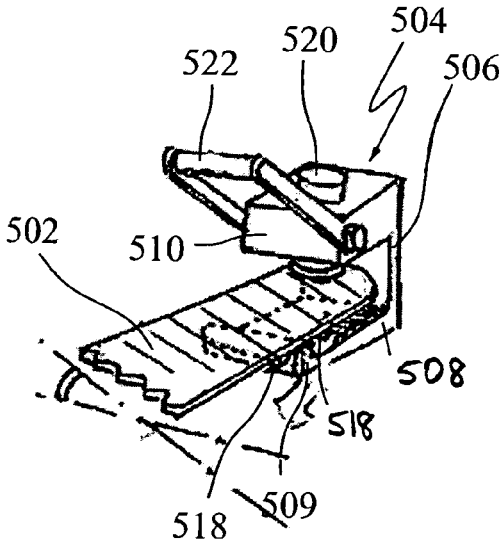
Figure 41F:
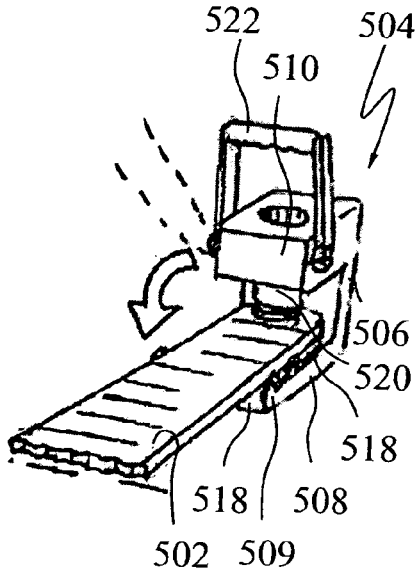

Referring to FIGS. 41D-41F, it can be seen that this design of the female coupling 504 allows the leading end of the male arm 502 to be received within the c-shaped receiver 506 at a substantial lateral and/or vertical angle. The subsequent registration by the complementary rib 509 and channel 516, followed by the clamping of initiated by the piston 520 will ensure a secure and substantially level coupling.

Figure 42A:
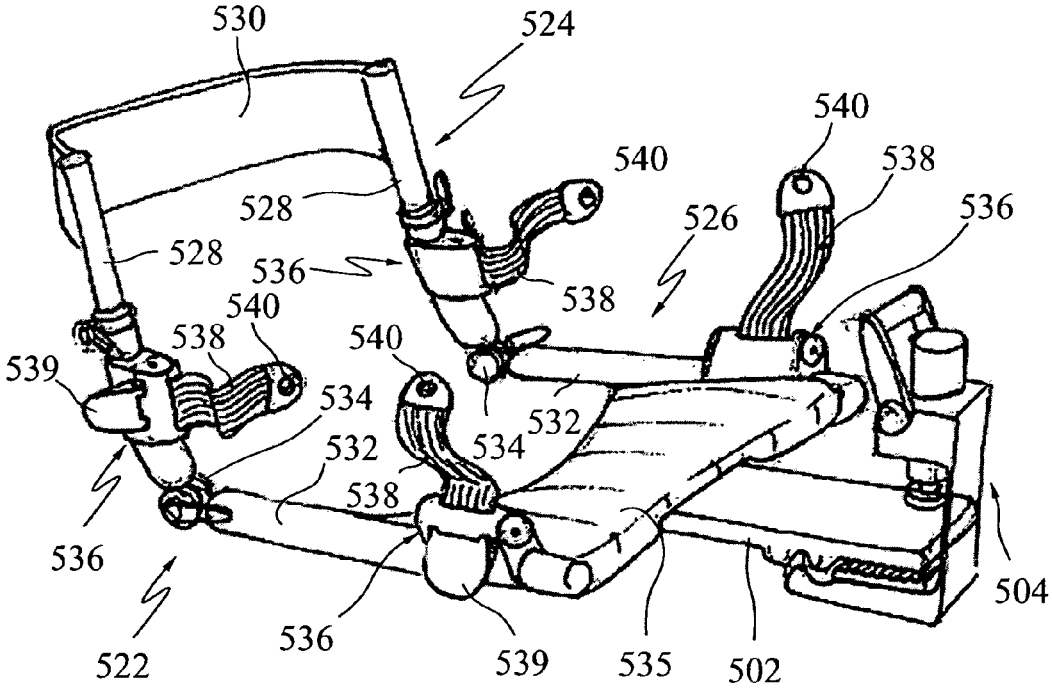
FIGS. 42A-42B illustrate various perspective views of a tenth embodiment of the present invention.
Figure 42B:
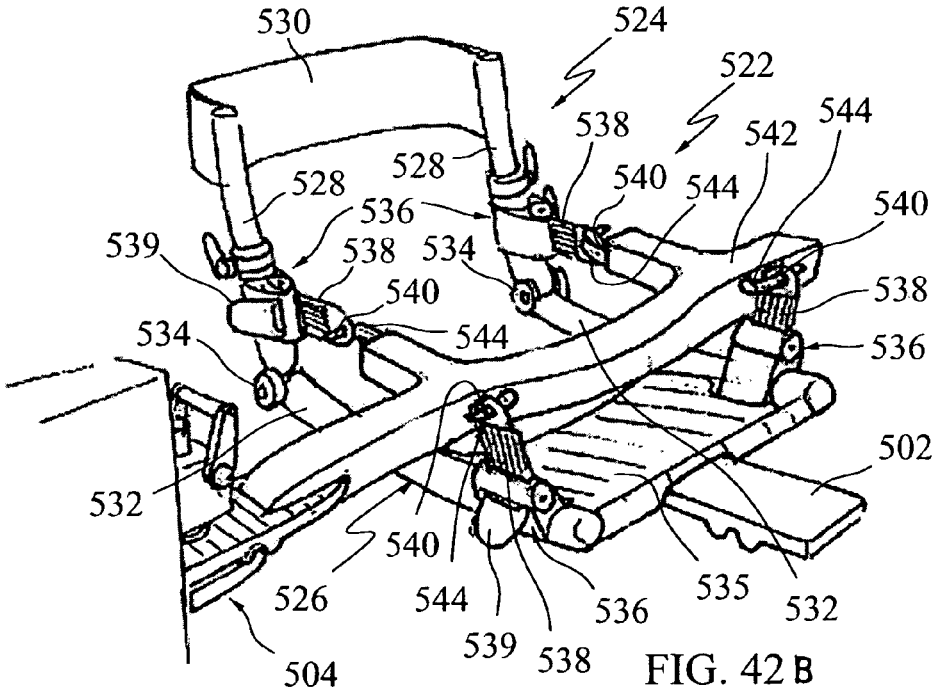

Referring to FIGS. 42A and 42B, an additional exemplary embodiment of a frame 522 for use with the present invention includes the male arm 502 for mating with the female coupling 504 described in detail above. The frame 522 of the present embodiment includes an upper frame section 524 for supporting a torso of a patient and a lower frame section 526 for supporting the thighs of a patient. The upper frame section 524 includes a pair of vertically extending, rigid bars 528 and back-support strap 530 extending laterally between the bars 528. The lower frame section 526 includes a pair of vertically extending, rigid bars 532 pivotally coupled at lockable hinges 534 to the corresponding rigid bars 528 of the upper frame section 524. A rigid seat 535 extends laterally between the lower ends of the rigid bars 532. In this embodiment, each of the rigid bars 528 of the upper frame section 524 and each of the rigid bars 532 of the lower frame section 526 include retractable (spooling) strap mechanisms 536 mounted thereto, each of which include a retractable strap 538 extended therefrom (or retracted therein) and an actuator 539 for initiating retraction of the associated strap 538 therein and/or lock the extension of the strap. In this embodiment, the straps 538 include eyelets 540, which may be used to couple to one or more buckle mechanisms (not shown) to provide a buckled strap or webbing extending over a patient seated thereon and/or a buckled strap extending beneath the patient, for example. It is also within the scope of the invention that one of the straps includes a female buckle component while the other end includes a male buckle component (like a seat belt, for example and without limitation); or, alternatively, it is within the scope of the invention that only one vertical bar includes a retractable strap that is adapted to extend completely across and couple to the opposing vertical bar. Referring specifically to FIG. 42B, the straps 538 may also be utilized for coupling the frame 522 to a support beam 542 extending from a lift device. In the present embodiment, the support beam 542 will extend over a patient's legs and includes hooks 544 for hooking onto the corresponding eyelets 540 of the straps.

Above embodiments discuss the coupling of the frames or pallets of the present invention to a patient mobility device such as a wheelchair or a scooter. Examples of such scooter interfaces are shown in FIGS. 43A-43D. The scooter 550 of FIGS. 43A & 43B includes a female clamping mechanism 552 (similar to those described above) for receiving and coupling to a male arm 554 extending from an appropriate frame or pallet component 556 according to the present invention. A pivotal support bar 558 is provided to pivot up from a base 560 of the scooter to provide additional support below the seat 562 of the frame/pallet 556 to for the patient carried by the scooter 550. This support bar 558 can be pivoted back to the base when the frame/pallet 556 is decoupled again from the scooter to allow for easier storage of the scooter (the base of the scooter can be rolled under a bed or a couch for example).

Figure 43A:
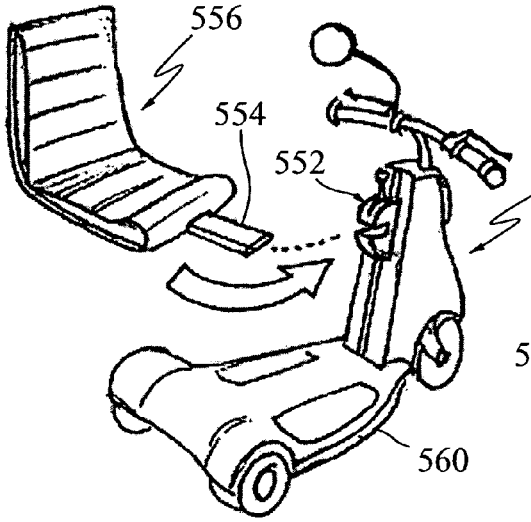
FIGS. 43A 43D illustrate various perspective and elevational views of certain modifications and uses applicable to many of the embodiments described herein.
Figure 43B:
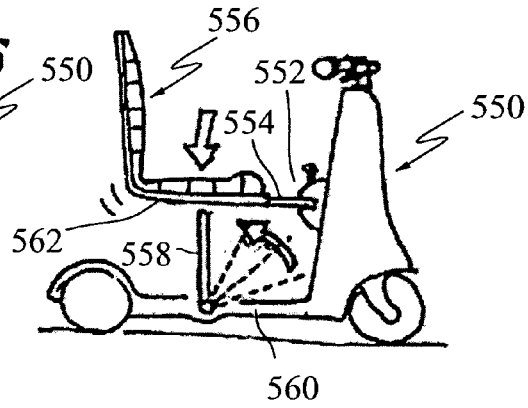
Figure 43C:
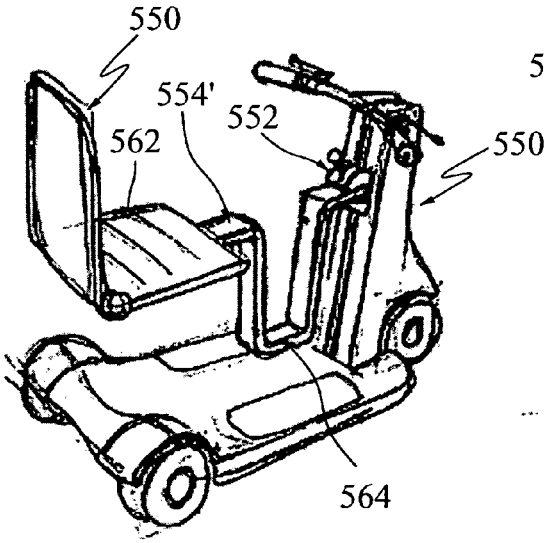
Figure 43D:
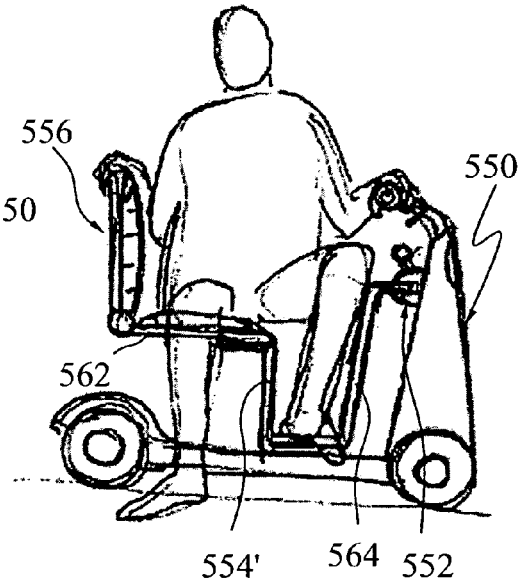

Referring to FIGS. 43C & 43D, the male arm 554' has been modified to provide a downward extending u-shaped portion 564 positioned between the seat 562 of the frame/pallet 556 and the female clamping mechanism 552 of the scooter. This downward extending u-shaped portion 564 allows easier entry and exit from the scooter 550.

Figure 44A:
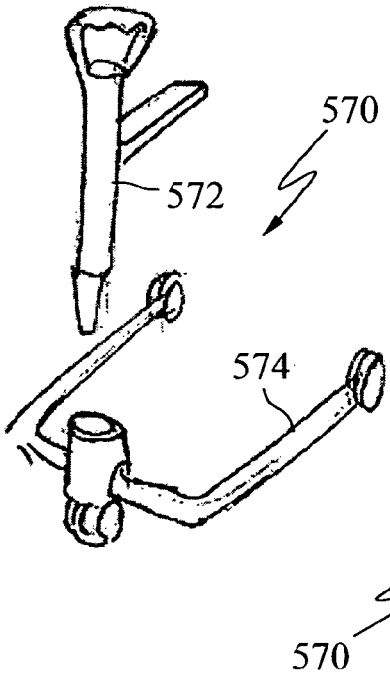
FIGS. 44A-44B illustrate an alternate light-weight lift mechanism usable for many of the embodiments described herein, capable of being disassembled or collapsed for use with vehicles.
Figure 44B:
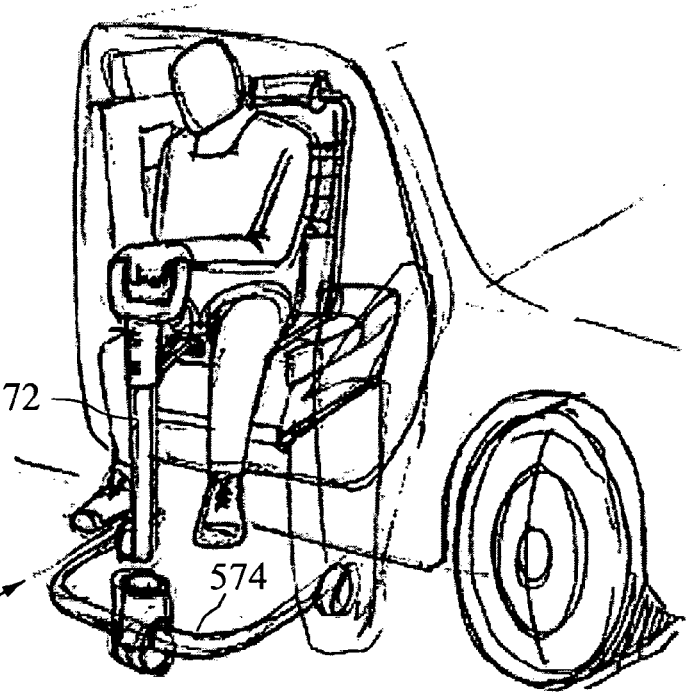

As shown in FIGS. 44A & 44B, a relatively lightweight detachable lift cart 570 is provided for use especially with automobiles. This lift is a scaled down version of the more sturdy lifts described above and is adapted to be taken apart and potentially stored in the vehicle. In this version, the lift column 572 is separable from the mobile base 574.

While the exemplary embodiments described herein utilize wheeled lifts, lift carts, mobility devices and/or scooters for coupling to and transporting the frames/pallets/patients, it is also within the scope of the invention that fixed/stationary lift/transport devices and/or overhead lift/transport and/or staircase lift/transport devices that include carriages for coupling to the various couplings of the frames could also be used.

In sum, the exemplary embodiments described herein all provide a form of rigid support to the human body; the shape and contour of most of the exemplary frames may be modified to aid with activities of daily living; and movement or transfer of the patient can be performed through use of a lifting or mobility cart, which articulates with the frame by inserting its arm(s)/tine(s) into a hollow-space/receptacle provided by or provided under the frame. The exemplary embodiments, therefore, as compared to the prior art devices, may eliminate need for intermediary transfer devices; may provide a more natural body position for transfer; may provide the ability to change body shape to suit a particular task; may utilize a more compact lifting/mobility device; may experience less patient anxiety (no hanging gravity effect as in certain prior art devices), may be less expensive; may require less or no infrastructure; and may ease the patient transfer steps.

While the exemplary frameworks described herein are primarily described utilizing "rigid" components, this term encompasses rigid or substantially rigid components such as metals, graphite composite materials and some plastic or rubber-like materials that provide suitable rigidity for the purposes and uses described herein. In other words, it will be appreciated by those of ordinary skill in the art that absolute rigidity is not necessary for such framework components to fall within the scope of the invention, and that some flexibility may even be desirable for certain applications. Furthermore, for the purposes of the present invention, the frame and pallet systems described herein utilize one or more "frame components" that comprise (a) rigid "framework(s)" (made up of rigid sub-component(s) or assemblies, such as—without limitation—rigid bars, seats, supports and the like) that provide primarily the structural support for the patient and, optionally, (b) flexible or resilient components (such as straps, webbing, cushions, and the like) coupled to or extending from the rigid frameworks that provide primarily (i) additional structural support (such as back straps or webbing, for example) and/or (ii) mechanisms to secure the patient to the rigid framework(s) (such as straps) and/or (iii) provide comfort to the patient (such as head rests or seat cushions).

Following from the above description of the invention, it should be apparent to those of ordinary skill in the art that, while the systems and processes herein described constitute exemplary embodiments of the present invention, it is to be understood that the invention is not limited to these precise systems and processes and that changes may be made therein without departing from the scope of the invention as defined by the claims. Additionally, it is to be understood that it is not necessary to meet any or all of the identified advantages or objects of the invention disclosed herein in order to fall within the scope of any claim, since inherent and/or unforeseen advantages of the present invention may exist even though they may not have been explicitly discussed herein.

What is claimed is:

1. A patient transfer system comprising:

a patient support frame, including a substantially rigid framework adapted to provide support for at least a portion of the patient's torso and the patient's thighs; and a patient transfer device including a vertical lift mechanism;

wherein the patient support frame includes at least two first coupling components and the vertical lift mechanism includes a complimentary coupling component for releasably coupling to either of the at least two first coupling components of the patient support frame;

wherein, when the complimentary coupling component is releasably coupled to the first of the at least two first coupling components, the patient support frame may face, with respect to the patient transfer device, in at least a first orientation selected from the group consisting of: forward-facing, backward-facing, left-facing, and right-facing; and wherein, when the complimentary coupling component is releasably coupled to the second of the at least two first coupling components, the patient support frame may face, with respect to the patient transfer device, in at least one orientation other than the first orientation.

2. The patient transfer system of claim 1, wherein the complimentary coupling component includes at least one tine of the vertical lift mechanism and the at least two first coupling components include at least one receptacle for receiving the tine.

3. The patient transfer system of claim 1, wherein the complimentary coupling component includes at least one tine of the vertical lift mechanism, the at least two first coupling components include at least one receptacle for receiving the tine, the substantially rigid framework includes a seat portion, and the at least one receptacle is connected to the underside of the seat portion.

4. The patient transfer system of claim 1, wherein the complimentary coupling component includes at least one tine of the vertical lift mechanism, the at least two first coupling components include at least one receptacle for receiving the tine, and the at least one receptacle receives the at least one tine by insertion of the at least one tine into the at least one receptacle.

5. The patient transfer system of claim 1, wherein the first of the at least two first coupling components has an orientation that is substantially perpendicular to the second of the at least two coupling components.

6. The patient transfer system of claim 1, wherein the complimentary coupling component includes at least two tines of the vertical lift mechanism and the at least two first coupling components include at least two receptacles for receiving the two tines.

7. The patient transfer system of claim 1, wherein the at least two first coupling components and the complimentary coupling component include a releasable lock for locking during transport of the patient support frame.

8. The patient transfer system of claim 1, wherein the vertical lift mechanism is a powered lift mechanism.

9. The patient transfer system of claim 8, wherein the patient transfer device is adapted to permit operation by the patient and by a caregiver.

10. The patient transfer system of claim 1, wherein the patient transfer device rests on wheels for wheeled transport.

11. The patient transfer system of claim 10, wherein the wheels are operatively coupled to a powered drive system.

12. The patient transfer system of claim 10, further comprising at least one leg extending generally horizontally from proximate a lower end of the lift mechanism, wherein at least one of the wheels is mounted to the leg.

13. The patient transfer system of claim 12, wherein the at least one leg includes two legs extending generally horizontally from proximate the lower end of the lift mechanism, each of the two legs having at least one of the wheels mounted thereto.

14. The patient transfer system of claim 1, wherein the patient transfer device is a patient mobility device taken from a group consisting of: a wheel-chair device, a scooter device, and a motorized vehicle, the patient mobility device adapted to receive and couple to the patient support frame.

15. The patient transfer system of claim 14, wherein the patient support frame includes at least one second coupling component adapted to be coupled to a complimentary coupling component of the patient mobility device.

16. The patient transfer system of claim 14, wherein the patient mobility device is adapted to permit operation by the patient and by a caregiver.

17. The patient transfer system of claim 14, wherein the patient mobility device includes a steering handle bar, the steering handle bar being pivotable between at least 2 orientations.

18. The patient transfer system of claim 14, wherein the patient mobility device includes a steering handle bar, the steering handle bar being pivotable between at least 2 orientations; and wherein the at least 2 orientations of the steering handle bar include a caregiver control orientation and a patient control orientation to permit operation of the patient mobility device by the patient or by a caregiver.

19. The patient transfer system of claim 1, wherein the substantially rigid framework comprises a seat adapted to support a patient in a sitting position, the seat including the at least two first coupling components adapted to be coupled to the complimentary component of the vertical lift mechanism.

20. The patient transfer system of claim 19, wherein the seat further comprises a thigh support portion and a torso support portion.

21. The patient transfer system of claim 1, wherein the patient support frame includes:

a first patient support frame component including at least a first substantially rigid framework;

a second frame component, including at least a second substantially rigid framework, releasably coupled to the first frame component.

22. The patient transfer system of claim 1, wherein the patient support frame further includes:

a substantially rigid framework including a pair of longitudinally extending, rigid vertical supports;

at least one of a webbing and a strap releasably coupled to, and laterally extending between the rigid vertical supports.

23. The patient transfer system of claim 1, wherein an angle of the patient support frame relative to the vertical lift mechanism is adjustable to vary the patient's posture.

24. The patient transfer system of claim 1, further comprising a vertical support platform that may be removably mounted to the vertical lift mechanism;

wherein the patient may be suspended beneath the vertical support platform, the patient's torso being supported by a first support strap and the patient's thighs being supported by a second support strap; wherein the first support strap and the second support strap are releasably coupled to the vertical support platform.

25. The patient transfer system of claim 1, wherein the patient transfer device includes a control device, the control device being pivotable between at least 2 orientations.

26. The patient transfer system of claim 25, wherein the at least 2 orientations of the control device include a caregiver control orientation and a patient control orientation.

27. A patient transfer system comprising:

a lift cart including a vertical support platform;

a lift column operable to raise and lower the vertical support platform relative to a supporting surface;

at least one coupling component mounted to the vertical support platform; and wheels interposed between the lift column and the supporting surface and operable to allow movement of the lift cart on the supporting surface;

at least two support straps including at least one complimentary coupling component that is releasably couplable to the at least one coupling component;

at least one back support strap;

at least one thigh support strap; and a patient support pallet adapted to seat a patient thereon;

wherein the patient support pallet includes a seating surface, the patient support pallet supporting a patient and including at least one laterally oriented recess extending into the seating surface, the recess being aligned with at least one of the back support strap and the thigh support strap.

28. The patient transfer system of claim 27, wherein:

the vertical support platform is removably mounted to the lift column; and the patient support pallet is adapted to be removably mounted to the lift column after the vertical support platform is removed from the lift column.

29. The patient transfer system of claim 27, further comprising a set of wheeled legs, the patient support pallet being releasably mountable to the wheeled legs.

30. The patient transfer system of claim 27, wherein the vertical support platform includes a tabletop.

31. The patient transfer system of claim 27, wherein the vertical support platform comprises a support beam.

32. The patient transfer system of claim 31, wherein the support beam includes a pair of arms adapted to flank a patient being supported thereunder.

33. The patient transfer system of claim 27, further comprising at least one leg extending generally horizontally from proximate a lower end of the lift column, wherein at least one of the wheels is mounted to the leg.

34. The patient transfer system of claim 33, wherein the at least one leg includes two legs extending generally horizontally from proximate the lower end of the lift column, each of the two legs having at least one wheel mounted thereto.

35. The patient support system of claim 27, wherein an angle of the vertical support platform relative to the lift column is adjustable.

* * * * *